US007651090B2

(12) United States Patent
Satoh et al.

(10) Patent No.: US 7,651,090 B2
(45) Date of Patent: Jan. 26, 2010

(54) PAPER CONVEYANCE APPARATUS

(75) Inventors: Keiichi Satoh, Miyagi (JP); Mituru Takahashi, Miyagi (JP); Yoshiyuki Araseki, Miyagi (JP); Tomotaka Osada, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 271 days.

(21) Appl. No.: 11/043,261

(22) Filed: Jan. 27, 2005

(65) Prior Publication Data

US 2005/0184443 A1 Aug. 25, 2005

(30) Foreign Application Priority Data

Jan. 29, 2004 (JP) ..... 2004-021709

(51) Int. Cl.
*B65H 7/02* (2006.01)

(52) U.S. Cl. ..... 271/265.02; 271/270; 271/182

(58) Field of Classification Search ..... 271/265.01, 271/265.02, 270, 272, 259, 182, 176
See application file for complete search history.

(56) References Cited

U.S. PATENT DOCUMENTS

| | | | | |
|---|---|---|---|---|
| 4,077,620 | A * | 3/1978 | Frank et al. | 271/10.03 |
| 4,573,673 | A * | 3/1986 | Haug | 271/111 |
| 5,383,656 | A * | 1/1995 | Mandel et al. | 271/258.01 |
| 5,412,462 | A * | 5/1995 | Matsuo et al. | 399/367 |
| 5,419,547 | A * | 5/1995 | Jeong | 271/263 |
| 5,423,527 | A * | 6/1995 | Tranquilla | 271/10.02 |
| 5,441,247 | A | 8/1995 | Quilliam | |
| 5,482,265 | A * | 1/1996 | Nakazato et al. | 271/242 |
| 5,676,363 | A * | 10/1997 | Kishida et al. | 271/10.01 |
| 5,742,318 | A * | 4/1998 | Miyauchi et al. | 347/134 |
| 5,995,801 | A * | 11/1999 | Katsuta et al. | 399/367 |
| 6,530,569 | B2 * | 3/2003 | Yamagishi | 271/270 |
| 2002/0063384 | A1 * | 5/2002 | Quesnel | 271/270 |
| 2004/0251589 | A1 * | 12/2004 | Satoh et al. | 271/10.01 |

FOREIGN PATENT DOCUMENTS

| | | |
|---|---|---|
| JP | 59-78028 | 5/1984 |
| JP | 59-223635 | 12/1984 |
| JP | 1-181630 | 7/1989 |
| JP | 5-32359 | 2/1993 |
| JP | 6-271104 | 9/1994 |

(Continued)

*Primary Examiner*—Patrick H Mackey
*Assistant Examiner*—Michael C McCullough
(74) *Attorney, Agent, or Firm*—Oblon, Spivak, McClelland, Maier & Neustadt, L.L.P.

(57) ABSTRACT

A paper conveyance apparatus includes a stacking portion; a feeding mechanism to extract and feed paper from the stacking portion one sheet at a time; and an intermediate portion for conveying the fed paper to the vicinity of a feeding port or feeding device of a main body of an image forming apparatus. The intermediate portion includes a plurality of conveyance devices and a plurality of paper detecting devices disposed from the upstream side to the downstream side of a conveyance path. The paper conveyance apparatus further includes a control device for reducing the conveyance speed of the plurality of conveyance devices when the leading edge of the paper is detected by a detecting device disposed at least one device further toward the upstream side than a paper detecting device disposed furthest downstream of the plurality of detecting devices.

7 Claims, 44 Drawing Sheets

FOREIGN PATENT DOCUMENTS

| | | |
|---|---|---|
| JP | 2000-141856 | 5/2000 |
| JP | 2001-139191 | 5/2001 |
| JP | 2002-2079 | 1/2002 |
| JP | 2002-029643 | 1/2002 |
| JP | 2002-265095 | 9/2002 |
| JP | 2002-302235 | 10/2002 |
| WO | WO 9216444 A1 * | 10/1992 |

* cited by examiner

FIG. 15

| PRINTING SPEED | PAPER LENGTH (FIRST TO EIGHTH SENSORS) | PAPER SIZE | INITIAL POSITION OF PAPER TRAILING EDGE: BETWEEN SENSORS | MEASUREMENT OF TIME BETWEEN SENSORS IN SPEED MEASURING ZONE | 2ND SHEET INTAKE SENSOR (CONVEYANCE TYPE) |
|---|---|---|---|---|---|
| 16rpm 30rpm | LONG SIZE | DLY, A3Y | 0−1 | 1−2 | 1ST SENSOR |
| | | B4Y, LEGAL Y | 1−2 | 2−3 | 2ND SENSOR |
| | SHORT SIZE | A4Y, B5Y, LETTER Y | 2−3 | 3−5 | 3RD SENSOR |
| | | A4T, LETTER T | 3−4 | 4−6 | 4TH SENSOR |
| | | B5T, B6Y | 4−5 | 5−7 | 5TH SENSOR |
| OTHER SPEEDS | LONG SIZE | DLY, A3Y | 0−1 | 1−2 | 1ST SENSOR |
| | | B4Y, LEGAL Y | 1−2 | 2−3 | 2ND SENSOR |
| | SHORT SIZE | A4Y, B5Y, LETTER Y | 2−3 | 3−5 | 3RD SENSOR |
| | | A4T, LETTER Y | 3−4 | 4−6 | 4TH SENSOR |
| | | B5T, B6Y | 4−5 | 5−7 | 5TH SENSOR |

FIG. 39
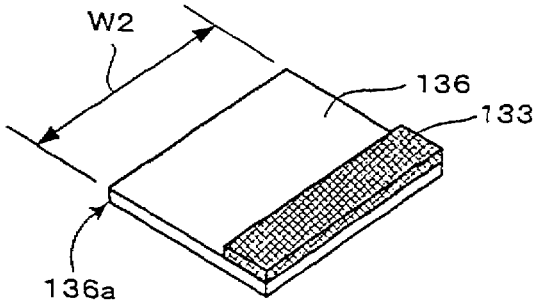
FIG. 40 PRIOR. ART
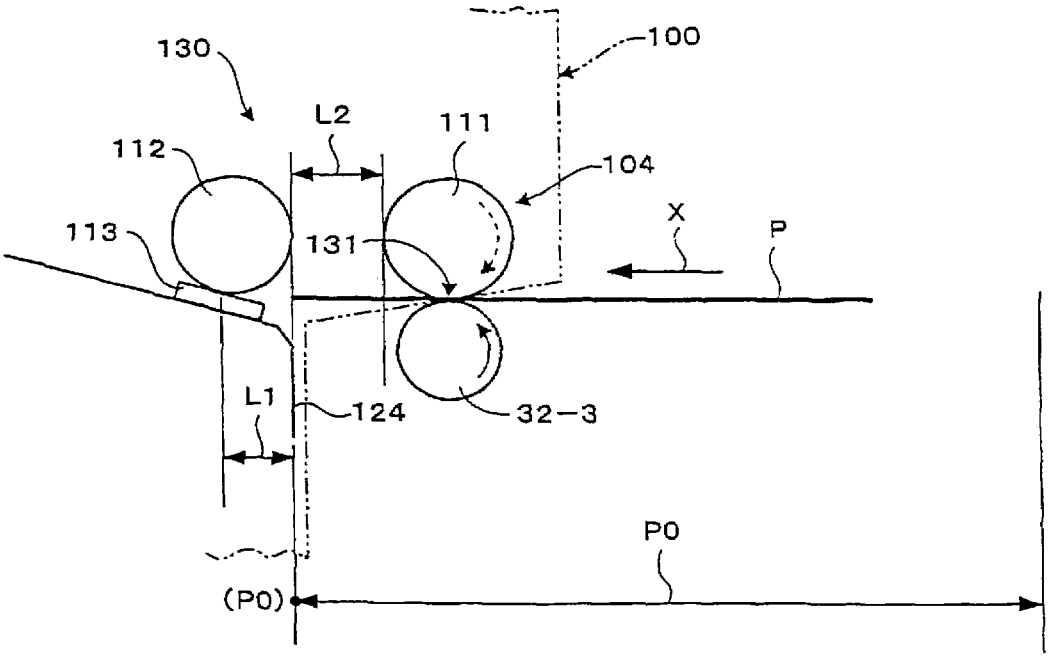

PAPER CONVEYANCE APPARATUS

BACKGROUND OF THE INVENTION

1. Field of the Invention

The present invention relates to a paper conveyance apparatus, including a bulk feeding apparatus having an intermediate conveyance portion for feeding a sheet-form recording medium (paper) on which an image is to be formed to an image forming apparatus such as a copier, printing machine, facsimile apparatus, printer, or plotter.

2. Description of the Background Art

In image forming apparatuses such as copiers, printing machines, facsimile apparatuses, printers including ink jet printers, and plotters, there is typically an upper limit of several hundred sheets to the paper stacking capacity (the number of sheets of paper that can be stacked) of a paper feeding apparatus provided in the main body of the image forming apparatus. Among such image forming apparatuses, an image forming apparatus such as a printing machine, especially a stencil printing machine or offset printing machine, differs from a copier or the like in that it employs an original image plate, and is therefore suited for use in bulk printing based on a plate created from a single original. Up to several thousand sheets may be printed from a single original.

In the work required for such bulk printing or other image formation, paper may be set on the paper feeding apparatus repeatedly, but such setting work is tiresome, and to eliminate wasted work time, an operator or user (to be referred to as "user" hereafter) must perform the troublesome work of monitoring the moment at which the paper runs out. To eliminate such trouble, in recent years numerous paper feeding apparatuses which can stack and supply several thousand sheets of paper to an image forming apparatus have been proposed. These paper feeding apparatuses (bulk feeding units) are attached as an option or provided as a dedicated unit (see Japanese Unexamined Patent Application Publication H6-271104, for example).

However, the first problem with such a paper feeding apparatus is that it is a dedicated apparatus which can only be attached to certain specific models, and is therefore lacking in versatility. Secondly, when such a paper feeding apparatus is to be attached to the main body of a printing machine which is already on the market, a major operation is required, which takes time and is undesirable from a service point of view. Hence such apparatuses have not been marketed widely. Thirdly, an electric connection with the printing machine main body side is required to receive information regarding the presence of paper and the paper size (in particular the length of the paper), and the work required to establish this connection is troublesome.

In consideration of these points, bulk feeding apparatuses having an intermediate conveyance portion, which are capable of supplying large volumes of paper for image formation while connected only mechanically to an image forming apparatus such as a printing machine in an offline (non-communicable) state, have been proposed and implemented in recent years (see U.S. Pat. No. 5,441,247, for example).

The bulk feeding apparatus having an intermediate conveyance portion described in U.S. Pat. No. 5,441,247 comprises a stacking portion comprising an elevatable bulk feeding table on which at least several thousand sheets of paper are stacked, a feeding mechanism portion for extracting and feeding the paper stacked on the stacking portion one sheet at a time, and an intermediate conveyance portion for feeding the paper fed from the feeding mechanism portion to the vicinity of a feeding port faced by a main body paper feeding table of a paper feeding portion, or a main body paper feeding device[i] of the paper feeding portion, on the image forming apparatus main body side. This invention relates to an apparatus for extracting cut and stacked paper (sheets of paper, also known as "cut paper", to be referred to as "paper" hereafter) from a storage apparatus and supplying the paper in conjunction with a graphic high speed printing machine, and a method therefore. According to this invention, a portable apparatus with a large paper storage capacity can be provided at a low cost. The apparatus is capable of responding to the production capacity of recent high speed printers and copiers, and is compatible with various machine types.

Incidentally, among the various image forming apparatuses to which the bulk feeding apparatus having an intermediate conveyance portion is connected, a stencil printing machine (to be referred to as "stencil printing apparatus" hereafter) uses a large variety of paper sizes. There are typically ten paper sizes, excluding "postcard size", in common use in stencil printing apparatuses, as will be described below. In such a stencil printing apparatus, an engraved thermal stencil master is rolled onto the outer peripheral surface of a print cylinder, also known as a printing drum, and by pressing a sheet of conveyed paper using a pressing device such as a pressure cylinder or press roller onto the outer peripheral surface of the print cylinder such that ink seeps through the porous part of the print cylinder and the perforated part of the thermal stencil master, the ink is transferred onto the paper to produce a printed image (see Japanese Unexamined Patent Application Publication 2002-2079, for example).

When the bulk feeding apparatus having an intermediate conveyance portion described in U.S. Pat. No. 5,441,247 is connected offline to the stencil printing apparatus described above in order to feed paper thereto, only a specific paper size, more specifically a paper length determined by the paper conveyance direction, can be conveyed, and hence although there is no problem when a paper conveyance system for the specific paper size is employed, the apparatus cannot be used by users of stencil printing apparatuses such as copiers in which a large variety of paper sizes is used.

In response, a novel bulk feeding apparatus having an intermediate conveyance portion which can solve this problem has been proposed in Japanese Patent Application 2003-064490, Japanese Patent Application 2003-065649, and so on.

However, even with the bulk feeding apparatus having an intermediate conveyance portion proposed in Japanese Patent Application 2003-064490, Japanese Patent Application 2003-065649, and so on, when using a large variety of paper sizes, the leading edge of the paper must be stopped in a predetermined position. More specifically, the stopping position of the leading edge of a sheet of paper conveyed from the intermediate conveyance portion must substantially match the stopping position of the leading edge of a sheet of paper set on the main body feeding table of the stencil printing apparatus or the like (corresponding to a stopping position P0 shown in FIG. 11 and a reset position serving as an initial set position). However, it was discovered that when small paper in particular is conveyed, the paper advances too far, as will be described in detail below with reference to the drawings.

SUMMARY OF THE INVENTION

The present invention has been designed in consideration of these circumstances, and it is a first object thereof to provide a paper conveyance apparatus which is capable of conveying paper in an identical manner to paper supplied from a main body feeding table, regardless of the paper size, by reducing the paper conveyance speed at which paper is conveyed from an intermediate conveyance portion during conveyance of the paper such that the leading edge of the paper is stopped in a predetermined stopping position, thereby obtaining a stable paper feeding quality with little variation in the stopping position of the paper, and which is capable of preventing damage to the leading edge of the paper caused by contact with a main body separating roller, for example, when the paper advances too far, and jams caused by deformation of the paper.

In addition to the first object, a second object of the present invention is to provide a paper conveyance apparatus which is capable of obtaining an even more stable paper feeding quality with even less variation in the stopping position of the paper, and of preventing deviation in the stopping position of the paper caused by slight oscillation or external force, particularly with small-sized paper having a short length, by reducing the paper conveyance speed at which paper is conveyed from the intermediate conveyance portion during conveyance of the paper in order to reduce inertia, and also applying a braking force or a load directly to the paper using a braking force applying device such as an elastic member.

In addition to the first and second objects, a third object of the present invention is to provide a paper conveyance apparatus which, as well as exhibiting effects to be described below, is capable of preventing skew generated when small-sized paper having a short length in particular is conveyed. When such short paper is conveyed, the trailing edge of the paper is not held down by a paper conveyance device, or else the length by which the paper is held down by the paper conveyance device is short, and hence if the elastic member is not located in a position of substantially linear symmetry in relation to the center line of the paper width direction when in contact with the paper, the braking force and load/pressure which act on the paper vary, causing such skew.

In accordance with the present invention, a paper conveyance apparatus comprises: a stacking portion on which paper can be stacked; a feeding mechanism portion for extracting the paper stacked on the stacking portion one sheet at a time and feeding this paper; and an intermediate conveyance portion for conveying the paper fed from the feeding mechanism portion to the vicinity of a feeding port faced by a main body feeding table of a feeding portion, or a main body feeding device of the feeding portion, on an image forming apparatus main body side. The intermediate conveyance portion comprises a plurality of paper conveyance devices disposed at intervals from an upstream side to a downstream side of an intermediate conveyance path, for conveying the paper fed from the feeding mechanism portion, and a plurality of paper detecting devices disposed at intervals from the upstream side to the downstream side of the intermediate conveyance path, for detecting at least a leading edge of the conveyed paper from among the leading edge and trailing edge of the paper. The paper conveyance apparatus further comprises a control device for reducing the paper conveyance speed of the plurality of paper conveyance devices when the leading edge of the paper is detected by a paper detecting device disposed at least one device further toward the upstream side than a furthest-downstream paper detecting device which is disposed furthest downstream of the plurality of paper detecting devices and nearest to the main body feeding device.

BRIEF DESCRIPTION OF THE DRAWINGS

The above and other objects, features, and advantages of the present invention will become more apparent from the following detailed description taken with the accompanying drawings in which:

FIG. 15 is a table showing a summary of the data and so on used in a paper conveyance control pattern in the above unpublished embodiment;

FIG. 39 is a perspective view showing a modification of the elastic member;

FIG. 40 is a front view illustrating conventional problems relating to the stopping position of a sheet of paper.

DESCRIPTION OF THE PREFERRED EMBODIMENTS

Before describing the present invention, the background art and the problems therein will be described with reference to the drawings.

As described above, even with the bulk feeding apparatuses having an intermediate conveyance portion proposed in Japanese Patent Application 2003-064490, Japanese Patent Application 2003-065649, and so on, when a large variety of paper sizes is used, the leading edge of the paper must be stopped in a predetermined position. More specifically, the stopping position of the leading edge of a sheet of paper conveyed from the intermediate conveyance portion must substantially match the stopping position of the leading edge of a sheet of paper set on the main body feeding table of the stencil printing apparatus or the like, or in other words a position corresponding to the stopping position P0 shown in FIG. 11 and a reset position serving as an initial set position. However, when small paper in particular is conveyed, a problem arises in that the paper advances too far, as will be described below.

Figure 41:
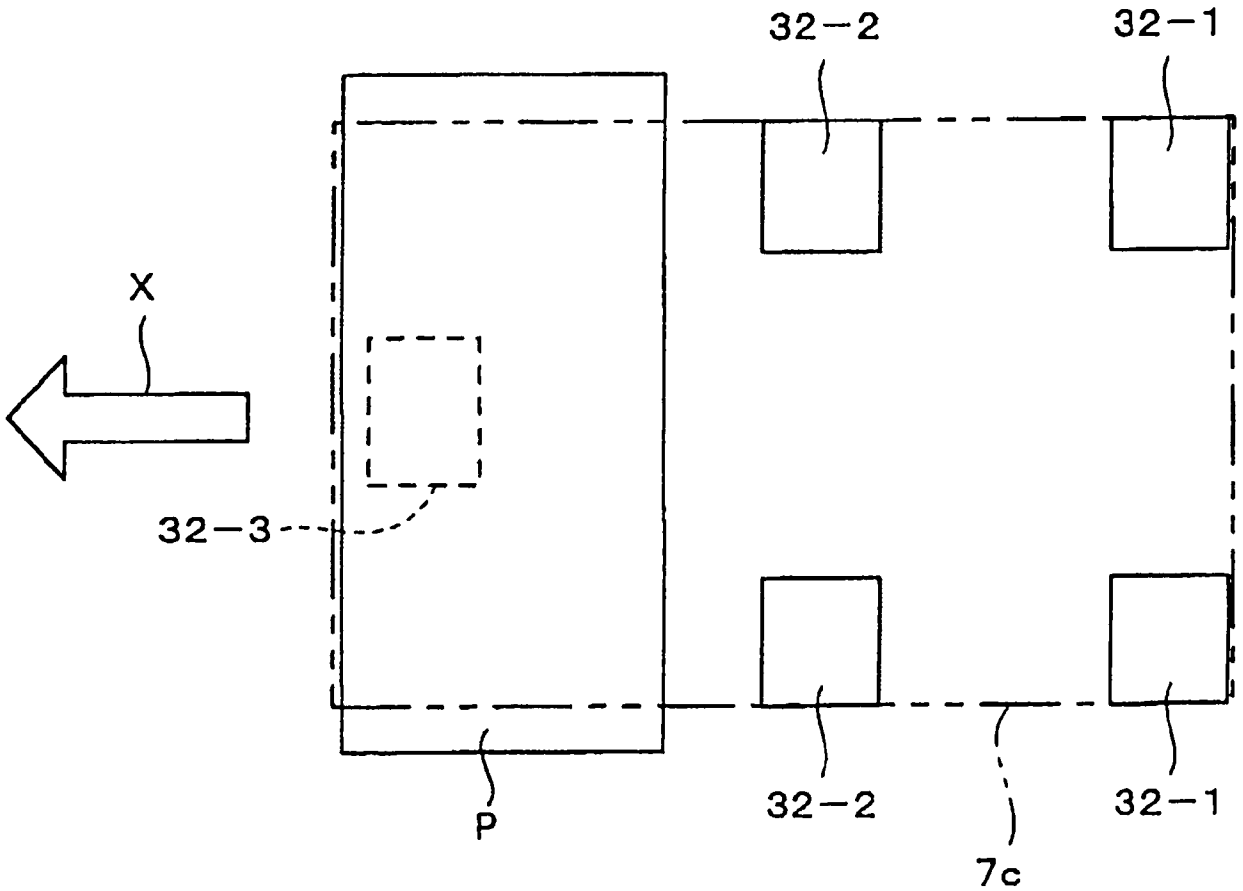
FIG. 41 PRIOR ART
FIG. 41 is a plan view illustrating conventional problems relating to the stopping position of a sheet of paper.

As shown in FIGS. 40 and 41, a main body feeding portion 104 on a stencil printing apparatus 100 side is provided with a main body feed roller 111, a main body separating roller 112, and a main body separator pad 113, constituting a main body feeding mechanism 130. In an offline state, in which the bulk feed/conveyance unit (bulk feeding apparatus having an intermediate conveyance portion) is connected to the main body side of the stencil printing apparatus 100 only mechanically, a third conveyance roller 32-3 disposed furthest downstream on the intermediate conveyance portion side is pressed against the main body feed roller 111 from below so as to contact the lower outer peripheral surface of the main body feed roller 111, thereby forming a nip portion 131, and thus a sheet of paper P fed from the bulk feed/conveyance unit can be passed securely.

In FIG. 40, when the paper P is conveyed to the downstream side of a paper conveyance direction X by the rotation of a first conveyance roller 32-1 and second conveyance roller 32-2, the third conveyance roller 32-3 is driven to rotate before the leading edge of the paper P enters the nip portion 131. When the third conveyance roller 32-3 rotates in a counter-clockwise direction, the main body feed roller 111 is rotated in a clockwise direction, as shown by the broken line, and thus the leading edge portion of the paper P enters the nip portion 131 smoothly.

However, referring to the aforementioned Japanese Patent Application 2003-064490 and FIG. 9 of the embodiments of the present invention to be described below, although a one-way clutch, not shown in the drawing, is inserted into a shaft portion of the main body feed roller 111, and the main body feed roller 111 and main body separating roller 112 are connected by timing pulleys 119, 120 and a timing belt 121, the action of the one-way clutch disposed on the main body feed roller 111 side causes the main body feed roller 111 to rotate idly in the clockwise direction such that the rotary force of the third conveyance roller 32-3 is not transmitted to the main body separating roller 112 through the main body feed roller 111. If, as a result, the leading edge of the paper P advances beyond the predetermined stopping position, the leading edge portion of the paper P impinges on the main body separating roller 112, which is not rotating as described above, thus damaging the leading edge portion of the paper P and causing the leading edge portion of the paper P to deform such that a jam occurs. As is shown clearly in FIG. 9, the outer peripheral portion of the main body separating roller 112 is formed with small jagged indentations in saw-tooth form in order to increase friction and separation force with the paper P, and hence when the leading edge portion of the paper P impinges on this part, such damage and deformation is even more likely to occur.

Further, by setting the paper conveyance speed on the intermediate conveyance portion side in alignment with the printing speed and paper conveyance speed on the stencil printing apparatus 100 main body side to be as fast as possible while preventing sheets of the paper P from contacting each other, the paper P can reach the paper stopping position (the paper leading edge position when the paper P is fed to the stencil printing apparatus 100 main body side) with a time surplus for conveyance of the following sheet of paper P. Accordingly, the paper conveyance speed may be raised on the intermediate conveyance portion side. In such a case, however, the rotation speed of the third conveyance roller 32-3 in particular increases, as does inertia, and hence variation in the paper stopping position also increases.

Note that a jam also occurs when the leading edge of the paper P does not advance to the paper stopping position since the uptake timing of the paper P on the stencil printing apparatus 100 main body side is fixed (if the leading edge of the paper P does not reach a main body side paper leading edge position detection sensor within a fixed time, a jam occurs). Normally, the paper conveyance speed is determined in accordance with the stencil printing apparatus 100 main body side with a time surplus, and hence no problems occur when the paper P does not advance. In this case, the problem lies in selecting the paper conveyance speed, which is outside of the scope of the present invention.

To summarize the items described above, a stopping position P0 of the paper P in FIG. 40 is preferably set, in terms of both technology and design, to $P0-L2<P0<P0+L1$.

As shown in FIG. 41, particularly when small size paper P with a short length in the paper conveyance direction X (more specifically, paper P of a B6Y size or a B5T size shown in FIG. 11, to be described below) is in a stopped state, only the leading edge portion thereof is held between the main body feed roller 111 and the third conveyance roller 32-3, and the trailing edge of the paper P is in a free state with no load applied thereon. In other words, no pressure is applied to the paper P, and hence the stopping position of the paper P may shift as a result of slight oscillation or external force. If the paper P is transferred to the stencil printing apparatus 100 main body side having shifted from its target stopping position, the image position shifts on the stencil printing apparatus 100 main body side, or in the worst case, a jam occurs.

On the other hand, when large size paper P having a long length in the paper conveyance direction X (more specifically, paper P of nine sizes, excluding the B5T size shown in FIG. 11, to be described below) is in a stopped state, the trailing edge portion side thereof receives a load from being pressed between the second conveyance roller 32-2 and a second pressure roller 31-2, and also between the first conveyance roller 32-1 and a first pressure roller 31-1. Hence, in comparison with the small size paper P, the stopping position is stable, and problems such as those described above are unlikely to occur.

Embodiments of the present invention will now be described with reference to the drawings. In each embodiment, modification, and so on, constitutional elements (members and constitutional components) and the like having identical functions, form, and so on will be described once, and then allocated an identical reference symbol so that subsequent description can be omitted. Constituent elements in the drawings that are configured in pairs and require no separate description are instead described by appropriately noting one member of the pair in order to simplify the description thereof. In order to simplify the drawings and description, constituent elements that would otherwise be shown in the drawing are omitted as appropriate if these constituent elements require no special description in the drawing. When constitutional elements of Japanese Unexamined Patent Publications and so on are cited, parentheses are provided around their reference symbol to differentiate them from corresponding elements in the embodiments.

First, referring to FIGS. 1 through 32, an overall description of an apparatus constitution, including a bulk feeding apparatus having an intermediate conveyance portion according to an unpublished conventional embodiment (to be referred to hereafter as "unpublished embodiment" for convenience) to which the present invention is applied, will be provided.

Figure 1:
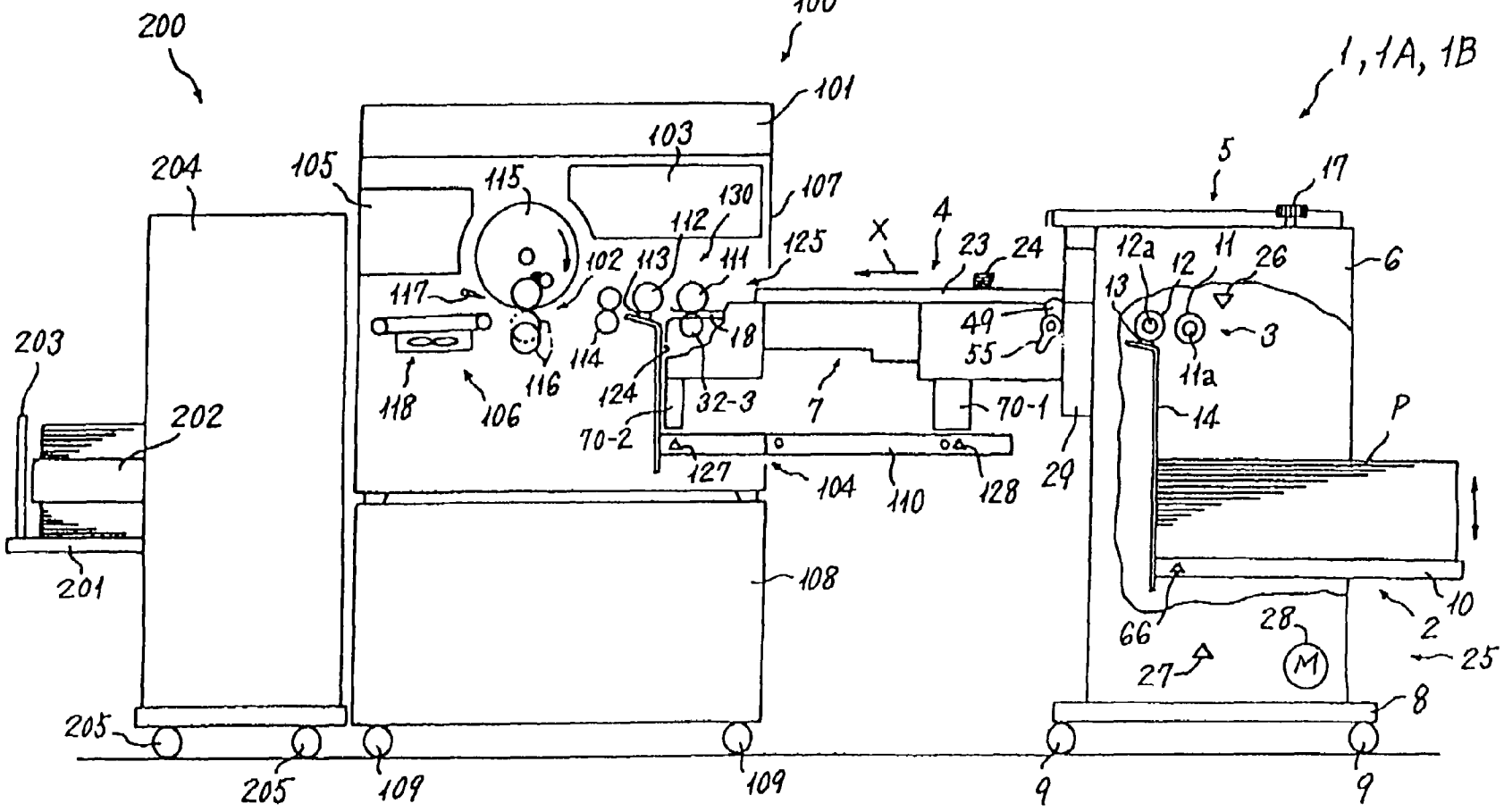
FIG. 1 is a schematic, partially cut away front view showing an overall apparatus in an unpublished embodiment, in which a bulk feed/conveyance unit and a stencil printing apparatus main body are connected offline, according to a first and a second embodiment of the present invention.
Figure 2:
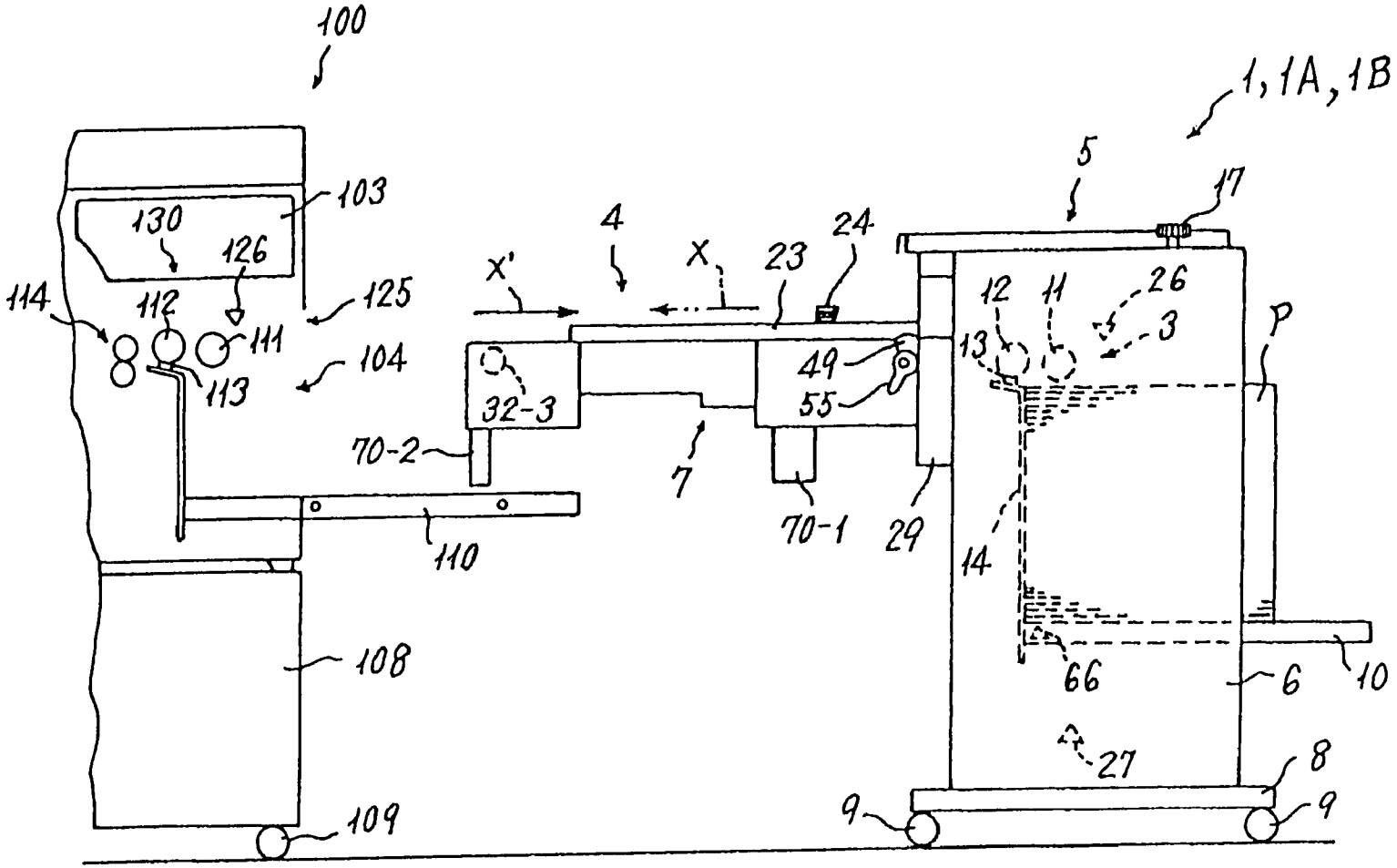
FIG. 2 is a schematic front view showing the bulk feed/conveyance unit occupying a non-connected position.

In FIGS. 1 and 2, the reference numeral "1" indicates a bulk feeding apparatus having an intermediate conveyance portion, which serves as a paper conveyance apparatus (referred to hereafter as "bulk feed/conveyance unit"), the reference numeral "100" indicates a stencil printing apparatus serving as an example of an image forming apparatus, and the reference numeral "200" indicates a bulk discharge and storage unit serving as a bulk discharge and storage apparatus.

The bulk feed/conveyance unit 1 is electrically connected to the bulk discharge and storage unit 200 by a power supply cable not shown in the drawing. The bulk feed/conveyance unit 1 and stencil printing apparatus 100 receive a supply of electric power respectively from commercially available external power sources, for example, through a power supply cable and plug (not shown in the drawing) or the like which are connected to the external power sources. The bulk feed/conveyance unit 1 and stencil printing apparatus 100 are set in a so-called "offline" state in which communication and signal exchange therebetween are impossible. Also, the bulk feed/conveyance unit 1 can be attached to and detached from, and thereby mechanically connected to, the stencil printing apparatus 100, and the bulk discharge and storage unit 200 can be attached to and detached from, and thereby mechanically connected to, the stencil printing apparatus 100. FIG. 1 shows these components in their mechanically connected state.

The bulk feed/conveyance unit 1 can be moved along the paper conveyance direction X, as shown in FIG. 1, into a connected position at which a third conveyance roller 32-3 of an intermediate conveyance portion 4 described hereafter (also referred to as "intermediate conveyance unit 4" hereafter) is inserted under the main body feed roller 111 on the stencil printing apparatus 100 side, and pressed against the outer peripheral surface portion of the main body feed roller 111 such that the paper P fed from the bulk feed/conveyance unit 1 can be securely transferred. Alternatively, the bulk feed/conveyance unit 1 can be moved along an opposite direction X' to the paper conveyance direction X, as shown in FIG. 2, into a non-connected position in which the third conveyance roller 32-3 of the intermediate conveyance portion 4 and the main body feed roller 111 are disengaged from each other. As described above, when the bulk feed/conveyance unit 1 occupies the connected position, the relationship between the positions is set such that the third conveyance roller 32-3 receives a pressing force that corresponds to a moderate paper feed pressure from the main body feed roller 111.

In other words, as depicted in FIGS. 1 and 2, the bulk feed/conveyance unit 1 is configured so as to be movable between, first, a connected position in which paper P fed from the intermediate conveyance unit 4 can be taken in by the main body feed roller 111 and fed, by the bulk feed/conveyance unit 1 being moved along the paper conveyance direction X, such that the intermediate conveyance unit 4 constituting the bulk feed/conveyance unit 1 is placed on a main body feeding table 110 retained at a predetermined height (in this unpublished embodiment, the unit is placed on the main body feeding table 110 in its minimum position, which is the lowermost position of the main body feeding table 110 detected by a minimum detecting sensor (not pictured) disposed in the feeder side panel), or specifically, placed in a state occupying the minimum position without elevating the main body feeding table 110, and, second, an non-connected position that is spaced apart from the aforementioned connected position, by being moved along an opposite direction X' from the paper conveyance direction X as depicted in FIG. 2.

The connected position is not limited to "a state occupying the minimum position without elevating the main body feeding table 110," and may also be such that the main body feeding table is slightly elevated from the minimum position to occupy a feedable position, or more specifically, a position in which the intermediate conveyance unit 4 is placed on the main body feeding table 110 retained at a predetermined height, and the paper P fed from the intermediate conveyance unit 4 can be received by the main body feed roller 111 and fed.

In FIGS. 1 and 2, the reference numeral "6" indicates a main body housing that forms the frame of the bulk feeding device main body for accommodating a carrying portion 2 and a paper feeding mechanism 3 (described hereinafter) of the bulk feed/conveyance unit 1, the reference numeral "7" indicates a housing that forms the frame of the intermediate conveyance portion main body (described hereinafter) of the bulk feed/conveyance unit 1, the reference numeral "107" indicates a main body housing that forms the frame of the main body side of the stencil printing apparatus 100 serving as the body of the image forming apparatus, and the reference numeral "204" indicates a discharge unit housing that forms the frame of the main body side of the bulk discharge and storage unit 200 serving as the discharge and storage apparatus main body.

For convenience of description, the stencil printing apparatus 100, bulk discharge and storage unit 200, and bulk feed/conveyance unit 1 will be described in order.

The stencil printing apparatus 100 has substantially the same structure as, for example, the stencil printing apparatus according to FIG. 1 of Japanese Unexamined Patent Application Publication H8-67061. Specifically, the stencil printing apparatus 100 is equipped with: an image reading portion 101 for reading an original image, mounted on top of the main body housing 107; an engraving and plate feeding portion 103 for engraving and feeding a rolled thermal stencil master plate (not pictured) based on image information read by the image reading portion 101 or image information inputted by a personal computer or other externally connected device (not pictured); a main body feeding portion 104 serving as the paper feeding portion on the main body side of the image forming apparatus, for separately feeding printing paper (hereinafter referred to simply as "paper") (not pictured) that is stacked on the main body feeding table 110, or paper P fed from the bulk feed/conveyance unit 1 side, toward a printing unit 102 described hereinafter; the printing portion 102 serving as an image forming portion for forming a printed image on the paper P fed thereto, having a printing drum 115 provided with a print cylinder on the outer peripheral portion thereof for winding the thermal stencil master (not pictured) engraved by the engraving and plate feeding portion 103 or the like onto the outer peripheral surface of the drum; a plate discharging portion for peeling the used thermal stencil master from the outer peripheral surface of the print drum 115 and discharging it into a plate discharging box, not pictured; a discharge portion 106 for discharging a printed image to the outside of the main body housing 107, and so on. The stencil printing apparatus 100 is placed on a dedicated table 108 having casters 109, via the main body housing 107.

The main body feeding portion 104 comprises the elevatable main body feeding table 110 for carrying the paper P, disposed to the right of the main body housing 107, the main body feed roller 111 for conveying the uppermost sheet of paper (not pictured) on the main body feeding table 110 or paper P fed from the bulk feed/conveyance unit 1, the main body separating roller 112 for separating the conveyed paper P into single sheets and feeding the paper toward a pair of registration rollers 114, the main body separating pad 113 serving as a frictional member for separating the paper P into single sheets in cooperation with the main body separating roller 112, the pair of registration rollers 114 for conveying the paper that has been separated and fed sheet by sheet to the printing portion 102 serving as an image forming portion at a predetermined timing, and so on.

The main body feeding table 110 can be folded so as to occupy a position that covers a feeding port 125 of the main body housing 107 and the position shown in FIG. 1. A paper detecting sensor 127 serving as a paper detecting device for detecting the presence of paper on the main body feeding table 110 and a paper length sensor 128 serving as a paper length detecting device for detecting the length of the paper on the main body feeding table 110 are disposed inside the main body feeding table 110. The paper length sensor 128 constitutes a paper size detecting device for detecting both the longitudinal and transverse paper sizes in conjunction with a paper-aligning operation of a left/right pair of side fences (not pictured) capable of moving on the main body feeding table 110 in a paper width direction Y. Both the paper detecting sensor 127 and the paper length sensor 128 consist of reflection photosensors (sometimes referred to hereafter simply as "reflection sensors") provided with a light emitting element and a light receiving element.

Figure 3:
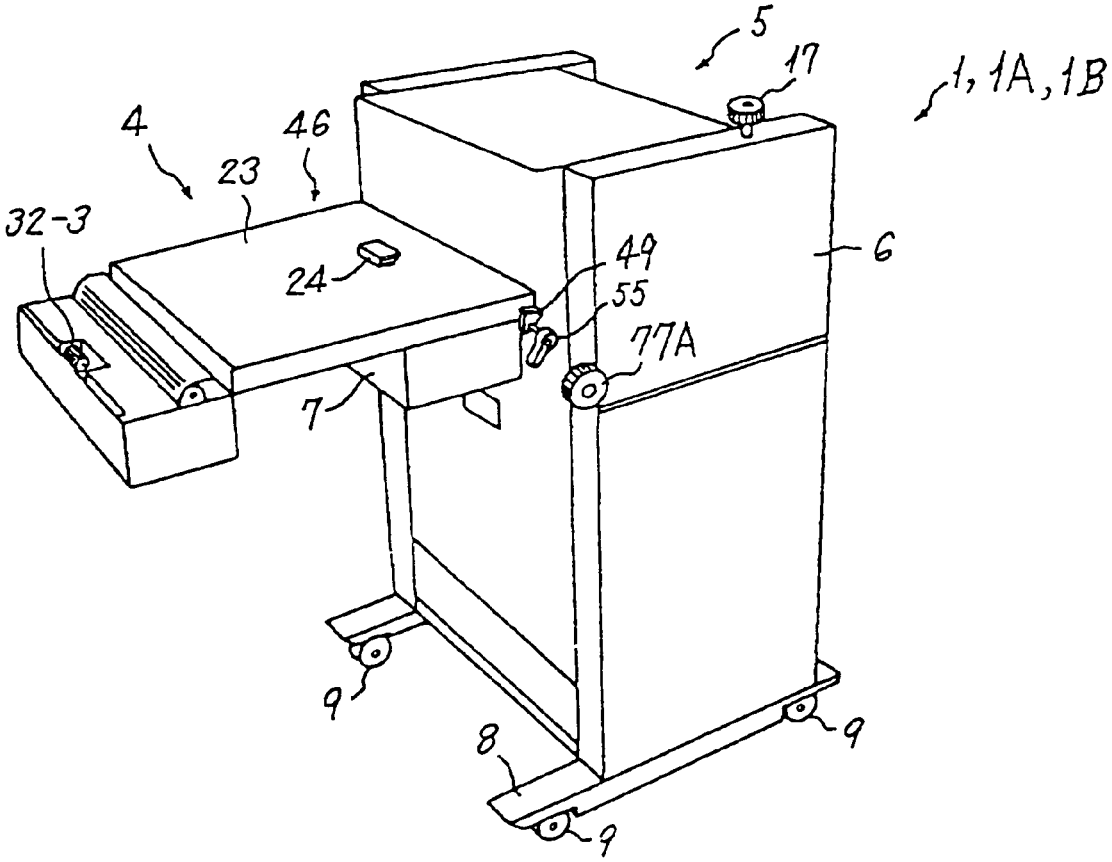
FIG. 3 is a perspective view showing the external form of the front of the bulk feed/conveyance unit.
Figure 8:
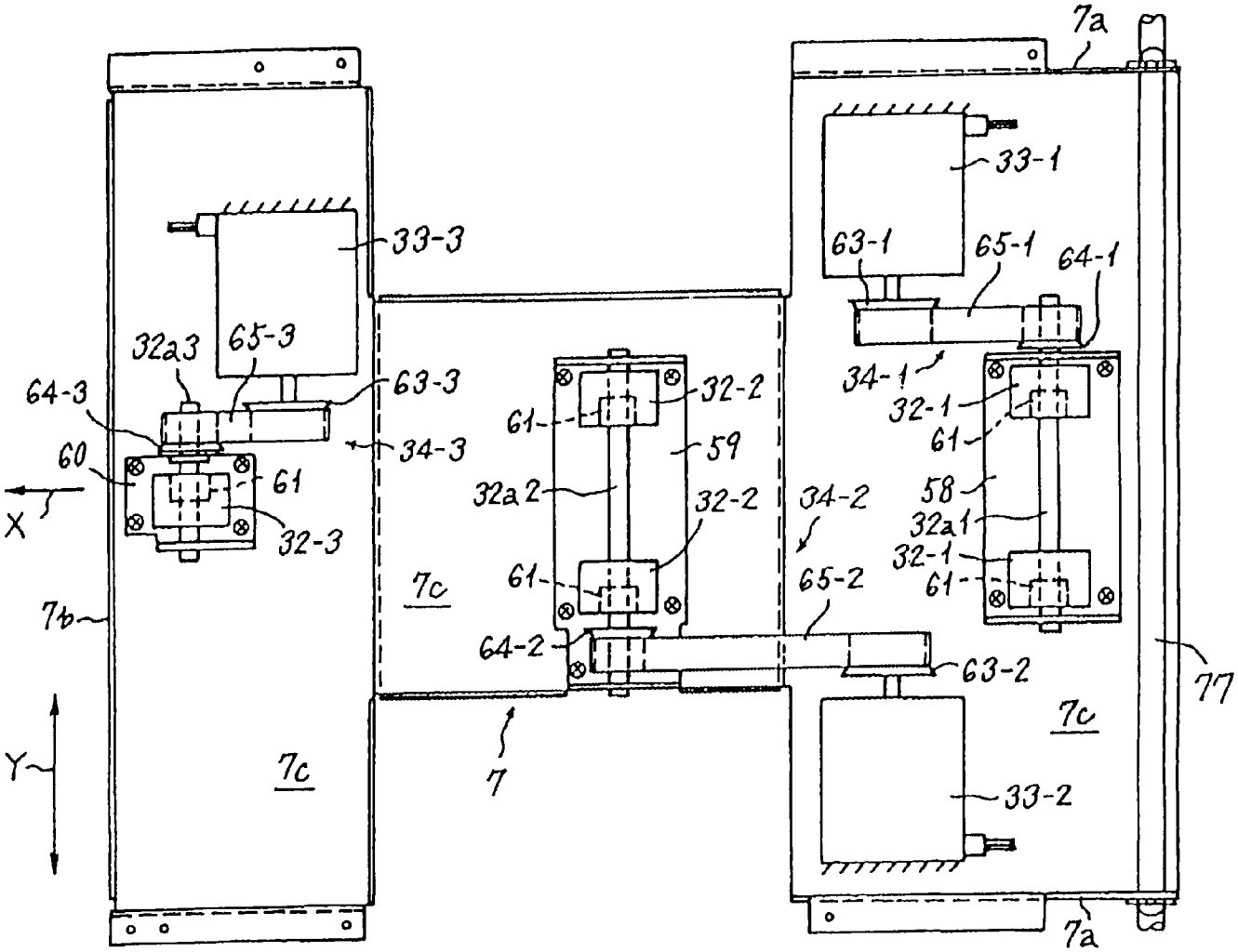
FIG. 8 is a plan view showing the main constitution of the periphery of a housing when the upper cover, upper guide plate, and lower guide plate are removed.

The main body feeding table 110 employs, for example, a hoisting mechanism provided with the same structure as the automatic intermittent hoisting mechanism depicted in FIGS. 3 and 8 of Japanese Utility Model Publication H5-18342, and can be raised and lowered while carrying a plurality or a large number of sheets of paper P. By means of the aforementioned hoisting mechanism, the main body feeding table 110 is driven up and down in a controlled manner so that the top sheet of the stacked paper is always in a feeding position in contact with the main body feed roller 111 at a predetermined feed pressure (a pushing pressure at which the paper can be conveyed).

The hoisting mechanism of the main body feeding table 110 is not limited to the aforementioned constitution, and a mechanism that uses a wire or the like such as that depicted in FIG. 1 of Japanese Unexamined Patent Application Publication S59-124633, for example, may also be used.

The main body feed roller 111 constitutes a feeding device of the main body feeding portion 104. The main body separating roller 112 and main body separating pad 113 constitute a separating and feeding device of the main body housing 107. Note that the feeding device is not limited to the constitution described above, and also includes constitutions comprising a combination of a feed roller and separating pad, or a pair of separating rollers. A friction separation system such as the aforementioned separating and feeding device, in other words a friction pad separating system, has the advantages of a simple constitution and low cost in comparison with a so-called reverse roller separating system in which paper is separated and fed sheet by sheet by a pair of two separating rollers.

Figure 9A:
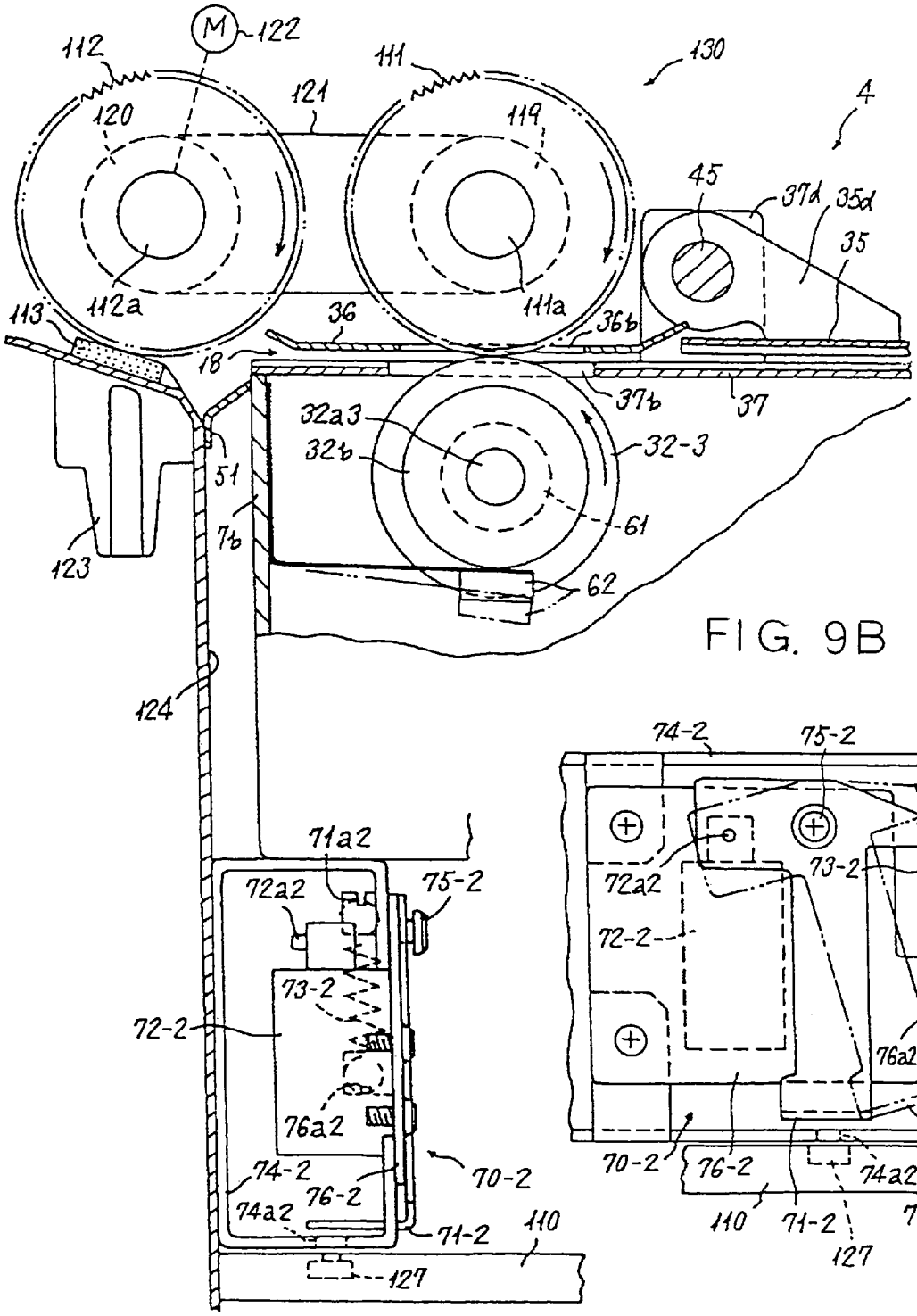
FIGS. 9A and 9B are sectional views showing the main constitution of the periphery of the intermediate conveyance portion when the stencil printing apparatus main body and bulk feed/conveyance unit are connected.
Figure 9B:
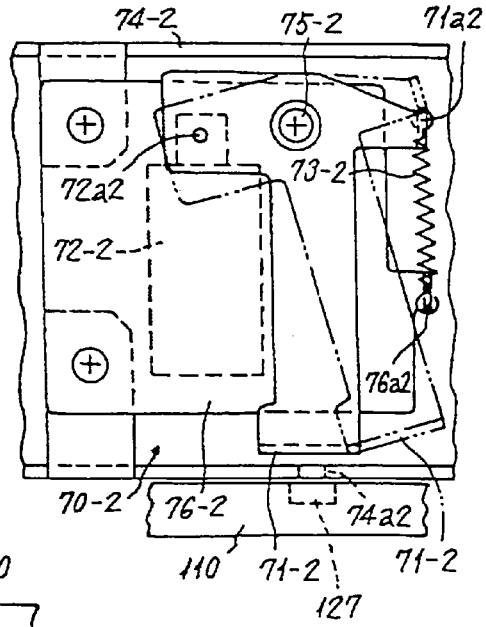

As depicted in detail in FIGS. 9A and 9B, the main body feed roller 111 is mounted on the free end portion of a feeding arm (in a cross-sectional horseshoe shape that opens downward) not shown in the drawing, so as to be able to pivot and rotate about a shaft 111*a*. The feeding arm is supported on a feeding side plate (not pictured) on the main body housing 107 side in the feeding port 125 of the main body feeding portion 104 so as to be able to pivot about a shaft 112*a* of the main body separating roller 112. The main body feed roller 111 and main body separating roller 112 are driven to rotate by a main body feeding mechanism 130 depicted in FIGS. 9A and 9B, which is the same as the feeding drive device (30) depicted in FIGS. 1 through 3 of Japanese Unexamined Patent Application Publication 2002-326732, for example, which was proposed by the present applicant.

Specifically, as shown by the simplified depiction in the diagrams, a one-way clutch (not pictured) is disposed between the main body feed roller 111 and the shaft 111*a* thereof, and between the main body separating roller 112 and the shaft 112*a* thereof. A timing pulley 119 is mounted on the shaft 111*a* of the main body feed roller 111, and a timing pulley 120 is mounted on the shaft 112*a* of the main body separating roller 112. A timing belt 121 is wrapped around the timing pulley 119 and timing pulley 120, and the main body separating roller 112 and main body feed roller 111 transmit a driving force to one another via the timing belt 121 and one-way clutches (not pictured). The clutch locking direction (linking direction of the driving force) of the one-way clutches not pictured in the diagrams is set to the clockwise direction indicated by the arrows in the diagram, in which the main body separating roller 112 and main body feed roller 111 are rotated so as to separate and feed the paper P. As a result, the main body separating roller 112 and main body feed roller 111 can rotate only in a clockwise direction. The main body separating roller 112 is driven to rotate by a feed motor 122 serving as a main body paper feed driving device.

The shaft 112*a* of the main body separating roller 112 and the output shaft (not pictured) of the feed motor 122 transmit a driving force to one another via timing pulleys (not pictured) and a timing belt (not pictured) wrapped around the timing pulleys. The feed motor 122 consists of a stepping motor. Consequently, in the case of paper feeding, by the normal rotation of the feed motor 122, for example, the main body separating roller 112 and main body feed roller 111 rotate together in a clockwise direction, and the uppermost sheet of paper (not pictured) stacked on the main body feeding table 110 or paper P fed from the bulk feed/conveyance unit 1 is fed toward the pair of registration rollers 114 depicted in FIG. 1.

A feeding filler (not pictured), also referred to as a light-shielding plate, is attached to the aforementioned feeding arm. A correct height detecting sensor 126 (see FIG. 2) made up of a transmission photosensor (hereinafter referred to simply as "transmission sensor") provided with a light emitting element and light receiving element for detecting the feeding position is fixed to an immobile member (not pictured) disposed on the main body housing 107 side near the aforementioned feeding filler, so as to selectively straddle the free end of the aforementioned feeding filler. In FIG. 9, "123" indicates a movable separating pad holder for accommodating a compression spring serving as a biasing member for biasing the main body separating pad 113 in the direction in which pressure is applied to the outer peripheral surface of the main body separating roller 112, and "124" indicates a front surface plate for aligning the leading edges of paper (not pictured) stacked on the main body feeding table 110.

The printing portion 102 is disposed in the substantial center of the main body housing 107, and comprises the printing drum 115 having an ink supplying device in its interior and an engraved thermal master plate wrapped around its outer peripheral surface, a press roller 116 serving as a pressing device for pressing paper P fed from the main body feeding portion 104 or bulk feed/conveyance unit 1 onto the outer peripheral surface of the printing drum 115 and transferring ink thereon, and so on. A pressure cylinder or the like provided with a paper clamp (retaining device) for retaining the leading edge of a sheet of paper on its outer peripheral portion, which has an outer peripheral surface of a substantially equal diameter to that of the printing drum 115, and which rotates in synchronization with the printing drum 115, such as that illustrated in FIG. 1 and so on of Japanese Unexamined Patent Application Publication 2000-141856, for example, is also used as the pressing device.

As described in the aforementioned Japanese Unexamined Patent Application Publication 2000-141856, for example, the printing drum 115 is constituted rotatably so that printing can be performed at a "plate-making speed" (for example 16 sheets/min: 16 rpm, or 30 sheets/min: 30 rpm), and a plurality of printing speeds used during a normal printing operation (in this embodiment, there are five printing speeds, for example 60, 75, 90, 105, and 120 sheets/min: 60, 75, 90, 105, 120 rpm) Here, 120 sheets/min: 120 rpm, for example, is the maximum printing speed of the stencil printing apparatus 100.

The printing drum 115 is driven to rotate by a well-known printing drum drive mechanism (not pictured) comprising a main motor constituted by a DC motor which serves as a driving device for driving the printing drum 115 to rotate. This main motor is similar to that shown in FIG. 3 of Japanese Unexamined Patent Application Publication 2002-36511, for example, which was proposed by the present applicant.

An operating panel (not pictured) for providing instructions to the various apparatuses and portions of the stencil printing apparatus 100 so that they operate as desired, and for recognizing and confirming the state and so on of these various apparatuses and portions, is disposed on top of the image reading portion 101. The operating panel is constituted substantially identically to an operating panel (90) disclosed in FIG. 17 of the aforementioned Japanese Unexamined Patent Application Publication 2000-141856, for example, and comprises: an engraving start key for generating a start signal which activates a series of operations from image reading of ah original image to plate feeding; a numeral keypad for setting and inputting the number of printed sheets and so on; a printing start key for generating a printing start signal which activates a printing operation to print the number of sheets inputted on the numeral keypad; printing speed setting keys comprising a speed down key and a speed up key, which serve as a printing speed setting device for rotating the printing drum 115 selectively at one of the five printing speeds (first speed through fifth speed); a speed display device comprising a group of LED lamps for displaying the printing speed set by the speed down key or speed up key; an LCD (liquid crystal display apparatus) display portion for displaying, as needed, information that is set or detected during the various operational steps from original image reading through printing; and so on, none of which are shown in the drawings.

The plate discharging portion 105 is constituted similarly to that shown in FIG. 1 of Japanese Unexamined Patent Application Publication 8-67061, for example, and comprises the aforementioned plate discharging box, a pair of plate discharge peeling rollers for peeling a used thermal stencil master away from the outer peripheral surface of the printing drum 115, a pair of plate discharge conveyor belts wrapped around the plate discharge peeling rollers and a pair of plate discharge rollers, for conveying and discharging the used and peeled thermal stencil master to the plate discharging box, and so on, none of which are shown in the drawings.

The discharge unit 106 is disposed on the left side of the main body housing 107, and has a peeling claw 117 for peeling printed paper from the outer peripheral surface of the printing drum 115, a suction conveyance unit 118 for using suction to discharge the peeled paper from a paper discharge port (not pictured) of the main body housing 107 to the externally located bulk discharge and storage unit 200, and so on.

The bulk discharge and storage unit 200 has substantially the same structure as the discharge and storage apparatus (1) depicted in FIGS. 1 through 9 of the aforementioned Japanese Unexamined Patent Application Publication 2002-226122, and performs substantially the same operations. The only important difference between the bulk discharge and storage unit 200 and the discharge and storage apparatus (1) is that the bulk discharge and storage unit 200 has a single bulk discharge table 201 instead of a first discharge tray (23) and second discharge tray (24) possessed by the discharge and storage apparatus (1). Therefore, description of the structural details and operations thereof has been omitted.

In FIG. 1, "202" indicates a pair of side fences disposed on both sides of the bulk discharge table 201 along the paper discharge direction for aligning the discharged paper in the width direction (the end surfaces of the discharged paper on both sides), and "203" indicates an end fence for aligning the leading edges of the discharged paper. The bulk discharge table 201 is a well-known table that is supported movably (elevatably) on a discharge unit housing 204 via a movable body (not pictured), in the same manner as the first discharge tray (23) and second discharge tray (24) in the aforementioned publication. Needless to say, the bulk discharge and storage unit 200 is not limited to this constitution and may have the same structure as the discharge and storage apparatus (1) depicted in FIGS. 1 through 9 of Japanese Unexamined Patent Application Publication 2002-226122, for example. The bulk discharge and storage unit 200 is constituted to be movable, by means of casters 205 provided on the bottom of the discharge unit housing 204, between a discharge connection position, in which a connection is established with a discharge port, not shown, of the discharge portion 106 of the stencil printing apparatus 100, and a non-discharge connection position, in which the bulk discharge and storage unit 200 is removed from the discharge connection position.

As described above, the bulk feed/conveyance unit 1 comprises the intermediate conveyance unit 4 serving as an intermediate conveyance portion, and a bulk feeding unit 5 serving as a bulk feeding apparatus. The bulk feeding unit 5 comprises a carrying portion 2 which is capable of carrying a large quantity of the paper P, a paper feeding mechanism 3 for picking up and feeding the paper P stacked on the carrying portion 2 one sheet at a time, and the main body housing 6 described above. The intermediate conveyance unit 4 is equipped with a function/structure for conveying a single sheet of paper fed from the paper feeding mechanism 3 to the vicinity of the feeding port 125, which faces the main body feed roller 111 of the main body feeding portion 104. The bulk feeding unit 5 is fixedly attached to a base 8 having casters 9 provided on the bottom of the main body housing 6.

The carrying portion 2, paper feeding mechanism 3, and intermediate conveyance portion 4 will be described in detail hereinafter, but in order to simplify description of the positioning of constituent elements thereof, the near side of the paper surface viewed in the paper conveyance direction X will be referred to occasionally as the "left" or "operating side," and the far side of the paper surface will be referred to occasionally as the "right" or "counter-operating side." For the same purpose, the downstream side of the paper conveyance direction X may be referred to as the "front," and the upstream side as the "rear." A pair of auxiliary side plates 29 are placed upright on the right and left sides of the main body housing 6 depicted in FIG. 1.

The carrying portion 2 is equipped with the elevatable bulk feeding table 10 which is capable of carrying a large quantity of the paper P, a left/right pair of side fences 15, 16 (see FIG. 4) serving as a paper width-aligning member for aligning the width (right and left ends) of the paper P on the bulk feeding table 10, a feeding table hoisting mechanism 25 serving as a feeding table hoisting device for raising and lowering the bulk feeding table 10, a correct height sensor 26 serving as a feeding position detecting device or maximum detecting device for detecting the maximum position of the bulk feeding table 10 or detecting that the feed roller 11 is in the feeding position, and a minimum sensor 27 serving as a minimum detecting device for detecting the minimum position of the bulk feeding table 10. The correct height sensor 26 and minimum sensor 27 both consist of transmission sensors. The correct height sensor 26 and minimum sensor 27 are disposed in predetermined positions within the main body housing 6.

The bulk feeding table 10 has an elevatable structure capable of carrying at least 3,000 sheets of regular A3-size paper, for example, and a helical groove 10*a* in four locations to allow the side fences 15 and 16 to move in the paper width direction Y. A paper detecting sensor 66 serving as a paper detecting device for detecting the presence of paper P on the bulk feeding table 10 is disposed in the interior of the bulk feeding table 10. The paper detecting sensor 66 consists of a reflection sensor. Unless specified otherwise, "paper size" as mentioned in this embodiment refers to the paper length of at least the paper P along the paper conveyance direction X.

Figure 4:
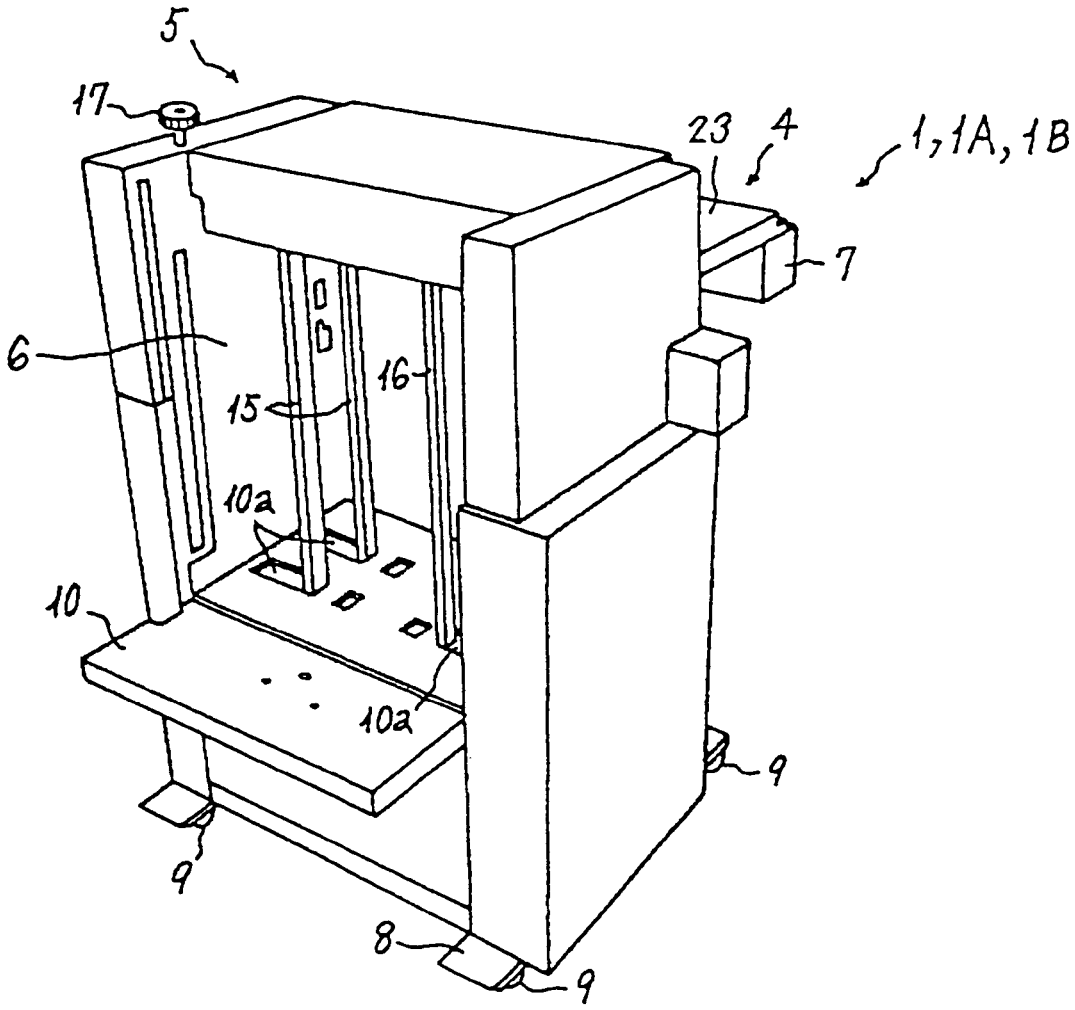
FIG. 4 is a perspective view showing the external form of the rear of the bulk feed/conveyance unit of FIG. 3.

As depicted in FIG. 4, the side fences 15 and 16 form rectangular pillars having hollow rectangular cross-sections, and are provided to the front and rear of the paper conveyance direction X and to the right and left of the paper width direction Y. The side fences 15 and 16 are configured such that by rotatably operating a side fence operating handle 17, the side fences 15 and 16 are moved in the paper width direction Y via a pair of side fence centering mechanisms (not pictured) mounted to the top and bottom of the main body housing 6 to enable the side fences 15 and 16 to be centered.

Figure 7:
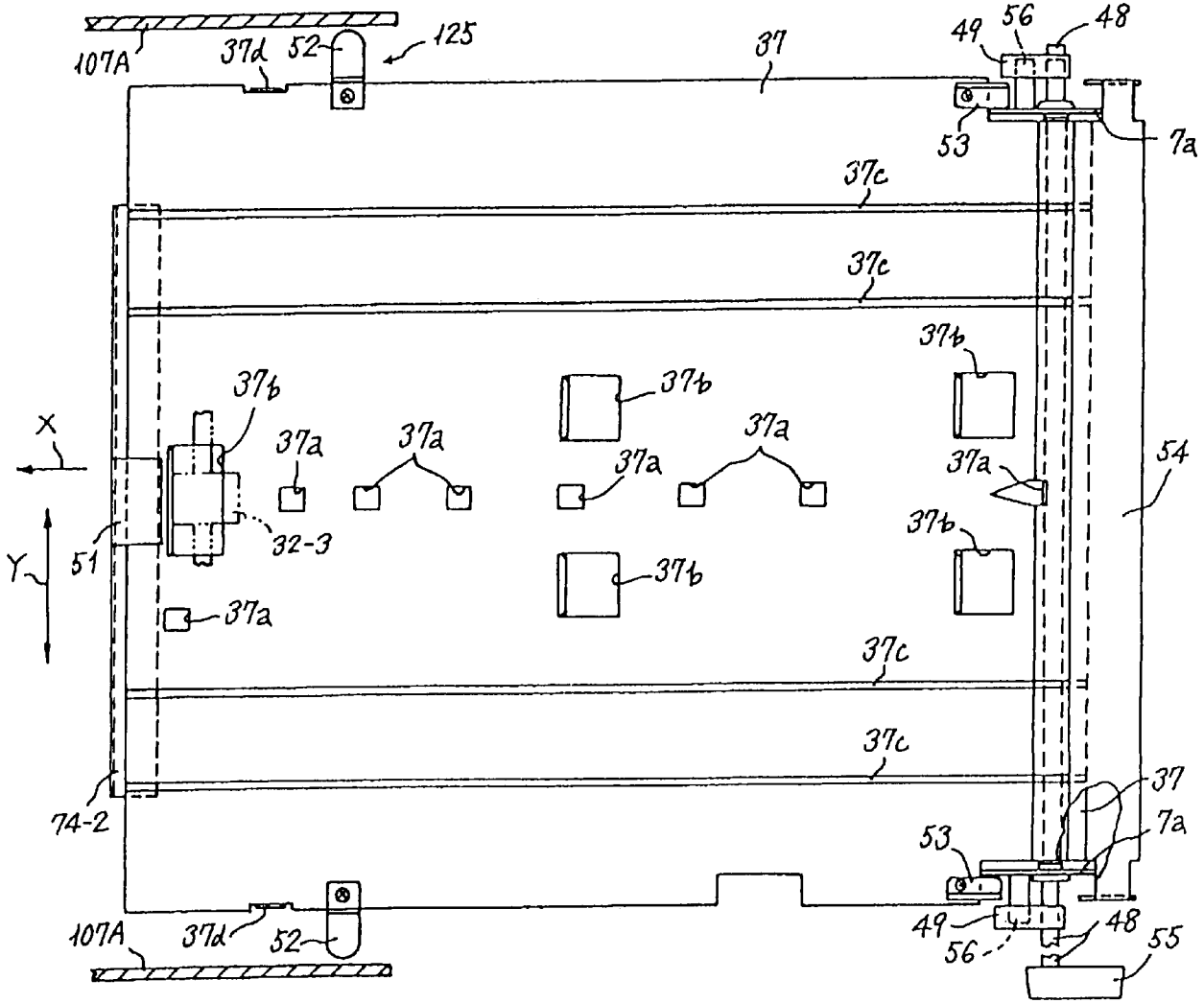
FIG. 7 is a plan view showing the main constitution of the periphery of a lower guide plate when the upper cover, upper guide plate, and conveyance rollers are removed.

The feeding table hoisting mechanism 25 has substantially the same basic structure as the tray hoisting mechanism (25) and movable body (57) of the discharge and storage apparatus (1) disclosed in FIGS. 7 and 8 and paragraph Nos. 0024 through 0026 of Japanese Unexamined Patent Application Publication 2002-226122, for example, and is configured so as to raise and lower the bulk feeding table 10 while keeping it in a substantially horizontal position. The feeding table hoisting mechanism 25 consists of a known structure, as described above, and therefore detailed description thereof has been omitted. In this unpublished embodiment, it is sufficient to cite the reversible elevating motor 28 depicted schematically in FIG. 1, which serves as an elevatable driving device for elevatably driving the bulk feeding table 10. The bulk feeding table 10 is controlled by a control apparatus to be described below so as to occupy the feeding position, in which the top sheet of the stacked paper continually contacts the feed roller 11 at a predetermined feed pressure (a pushing pressure at which the paper can be conveyed) via the feeding table hoisting mechanism 25.

The paper feeding mechanism 3 is mounted around the pair of auxiliary side plates 29 above the position of the carrying portion 2. As depicted in a basic fashion in FIG. 5, in which the thickness and other attributes of members are ignored, the paper feeding mechanism 3 has the same function/structure as the main body feeding mechanism 130, which is equipped with the feeding device, separating and feeding device, feeding drive device, and driving force transmitting device of the main body feeding portion 104 described above, and hence a detailed description will instead be given of the main body feeding mechanism 130 by subtracting "100" from each of the numbers used to label the constituent elements thereof to avoid redundant description. The separating roller 12 and feed roller 11 are driven to rotate by a feed motor 22 constituted by a stepping motor and serving as a feed driving device. The feed motor 22, driving force transmitting device, and the like are mounted on the surface of the outer wall of the auxiliary side plates 29 on the far side of the paper surface in FIG. 1.

A feeding filler (not pictured), also referred to as "the same feeding filler as the one for the main body feeding portion 104," is attached to the same feeding arm (not pictured) as the one provided for the main body feeding mechanism 130 which rotatably supports the feed roller 11 and separating roller 12. The correct height detecting sensor 26 is affixed to an immobile member (not pictured) disposed on the main body housing 6 side near the above-mentioned feeding filler, so as to selectively straddle the free end of the aforementioned feeding filler.

When the bulk feeding table 10 rises such that the uppermost surface of the paper P pushes the feed roller 11 upward, the feeding filler oscillates such that the other end portion thereof switches the correct height sensor 26 ON (or OFF). As a result, the control apparatus to be described below, which is disposed on the bulk feed/conveyance unit 1 side, controls the elevating motor 28 to stop. Thus the bulk feeding table 10 is stopped in a position where the uppermost surface of the paper P thereon occupies the feeding position.

Figure 5:
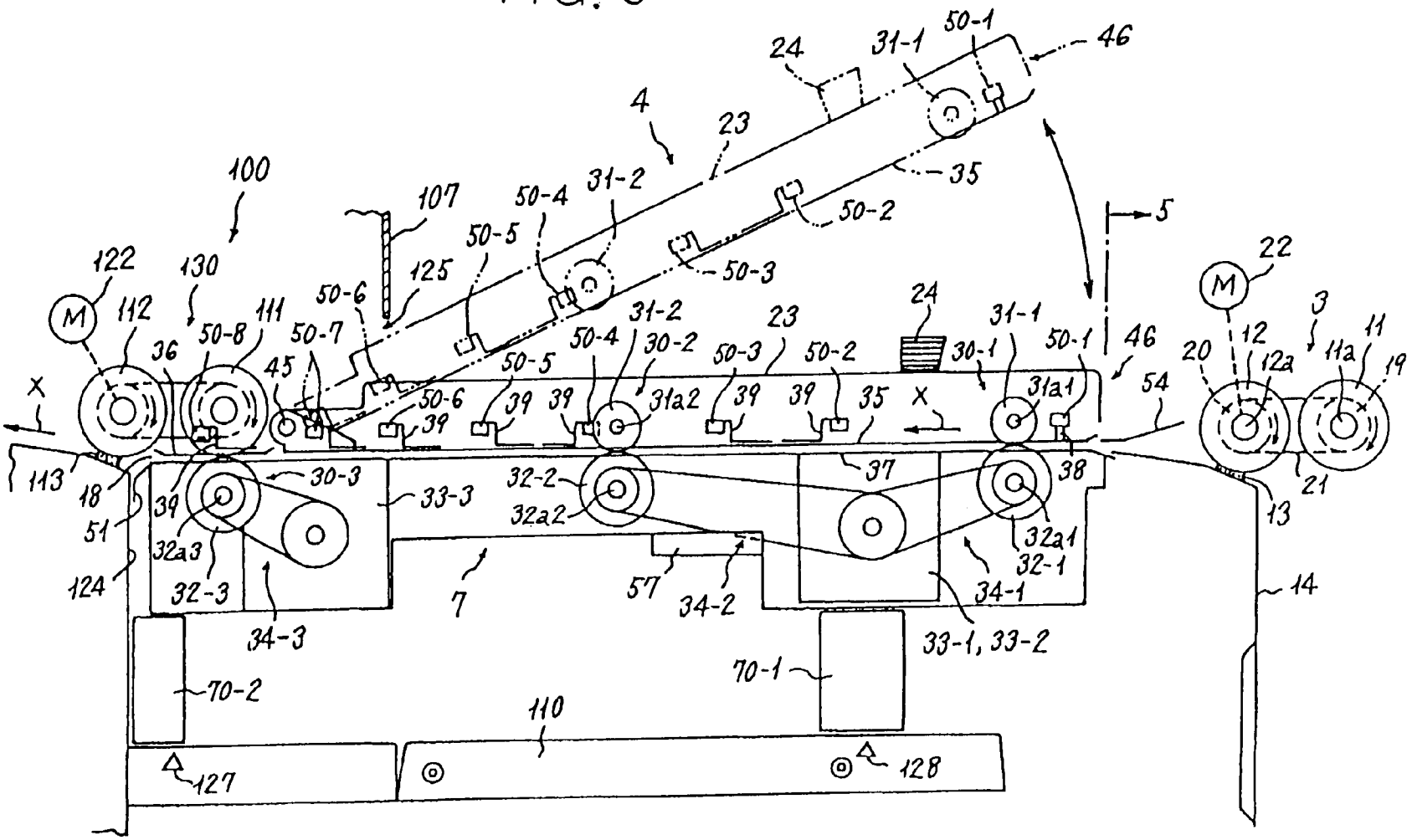
FIG. 5 is a front view showing the main constitution of the periphery of an intermediate conveyance portion when the stencil printing apparatus main body and bulk feed/conveyance unit are connected, and the open/closed state of an upper guide unit comprising an upper guide plate.

Meanwhile, as the paper P is fed such that the number of stacked sheets decreases gradually, the feeding filler oscillates such that the correct height sensor 26 is switched OFF (or ON). As a result, the control apparatus controls the elevating motor 28 to rotate, whereby the bulk feeding table 10 rises again, thus maintaining the correct position at all times. In this manner, the bulk feeding table 10 is set to the correct height at all times by the control apparatus and the correct height sensor 26. The lowest position of the bulk feeding table 10 is restricted by the minimum sensor 27. In FIGS. 1, 2, and 5, "14" indicates a face plate for aligning the leading edges of the paper P stacked on the bulk feeding table 10. The face plate 14 is affixed to the pair of auxiliary side plates 29 by a screw or other fastening device.

The bulk feeding apparatus is not limited to the bulk feeding unit 5 described above, and the feeding apparatus (100) disclosed in Japanese Unexamined Patent Application Publications H8-259008 and H8-259009, for example, may be used as a bulk feeding unit. Specifically, the unit may consist of a bulk feeding unit having a structure which is equipped with an LCT (large-capacity feeding table) and can be raised, and with which paper can be fed with the aid of a feeding device or separating and feeding device.

Next, the intermediate conveyance portion 4 will be described. In FIGS. 1, 5, 9A, 9B, 10, and so on, "18" indicates an intermediate conveyance path for conveying paper P fed from the paper feeding mechanism 3 to the feeding port 125 of the stencil printing apparatus main body 100. The intermediate conveyance portion 4 is removably attached to the pair of auxiliary side plates 29 of the main body housing 6.

As depicted in FIG. 5 and the like, the intermediate conveyance portion 4 comprises: a plurality of paper conveyance devices (three in this unpublished embodiment) constituted by a first paper conveyance device 30-1, second paper conveyance device 30-2, and third paper conveyance device 30-3 for conveying paper P fed from the paper feeding mechanism 3; a plurality of paper conveyance motors (three in this unpublished embodiment) constituted by a first motor 33-1, second motor 33-2, and third motor 33-3, which serve as driving devices for independently driving the conveyance devices, and which are provided respectively for the first paper conveyance device 30-1, second paper conveyance device 30-2, and third paper conveyance device 30-3; a first drive power transmitting device 34-1, second drive power transmitting device 34-2, and third drive power transmitting device 34-3 for transmitting the rotational drive power of the first motor 33-1, second motor 33-2, and third motor 33-3 to the first paper conveyance device 30-1, second paper conveyance device 30-2, and third paper conveyance device 30-3; an upper guiding member and lower guiding member (described hereinafter) constituting a pair of paper guiding members disposed in the intermediate conveyance path 18 for guiding paper P conveyed by the first through third paper conveyance devices 30-1 to 30-3 to the vicinity of the feeding port 125 on the stencil printing apparatus main body 100 side; the housing 7 described above for housing the first through third paper conveyance devices 30-1 through 30-3 and the pair of paper guiding members; and eight sensors consisting of a first sensor 50-1 through an eighth sensor 50-8, serving as paper detecting devices for detecting, as paper information, at least the leading edge, from among the leading edge and trailing edge (in this unpublished embodiment, both the leading edge and trailing edge of the paper P), of the conveyed paper P, and disposed in the upper guiding member at predetermined intervals from the upstream to downstream sides of the intermediate conveyance path 18.

The first paper conveyance device 30-1 is made up of a first conveyance roller 32-1 and a first pressure roller 31-1 that presses against the first conveyance roller 32-1. The second paper conveyance device 30-2 is made up of a second conveyance roller 32-2 and a second pressure roller 31-2 that presses against the second conveyance roller 32-2. The third paper conveyance device 30-3 is made up of a third conveyance roller 32-3. The first paper conveyance device 30-1, second paper conveyance device 30-2, and third paper conveyance device 30-3 are arranged in that order at predetermined intervals from the upstream to downstream sides of the intermediate conveyance path 18. The third paper conveyance device 30-3 serves as a furthest-downstream paper conveyance device, disposed furthest downstream of the first through third paper conveyance devices 30-1 to 30-3 in the intermediate conveyance path 18, and closest to the vicinity of the main body feeding device (main body feed roller 111).

The outer peripheral portion of the first pressure roller 31-1, including at least the outer peripheral surface thereof, is made of resin. The outer peripheral portion of the first conveyance roller 32-1, including at least the outer peripheral surface thereof, is formed by an appropriate rubber or other high-friction elastic body having a high coefficient of friction with the paper P used by the bulk feed/conveyance unit 1. The second pressure roller 31-2, second conveyance roller 32-2, and third conveyance roller 32-3 are constituted similarly.

Hereafter, because the first paper conveyance device 30-1 and second paper conveyance device 30-2 differ from one another only in placement and location, and have the same constituent elements, in order to unify description thereof, description of aspects other than placement and location thereof will be given by extension of the detailed description of one to the other. In the description of the above-mentioned structure and the like, numbers following a hyphen after a symbol indicate an order of placement from upstream to downstream along the intermediate conveyance path 18, and the prefixes "first" through "third" are sometimes omitted. As described above, because the first motor 33-1, second motor 33-2, and third motor 33-3 differ from one another only in placement and location and have the same constituent elements, in order to unify description thereof, description of aspects other than placement and location thereof will be given by extension of the detailed description of one to the others.

In the same manner, because the first sensor 50-1 through eighth sensor 50-8 differ from one another only in placement and location and are identical to each other, in order to unify description thereof, description of aspects other than placement and location thereof will be given by extension of the detailed description of the first sensor 50-1, for example, to the others. In the description of the above-mentioned structure and the like, numbers following a hyphen after a symbol indicate an order of placement from upstream to downstream along the intermediate conveyance path 18, and the prefixes "first" through "eighth" are sometimes omitted.

The housing 7 will first be described. As depicted in FIGS. 1, 2, 3, 8, and elsewhere, the housing 7 forms the frame of the intermediate conveyance portion 4, is H-shaped when viewed from above, and is formed in a substantial box shape that is open at the top. The housing 7 is formed integrally of sheet metal subjected to appropriate surface processing, for example. In FIG. 8, the rear panel of the housing 7 is labeled "7*a*," the front panel of the housing 7 is labeled "7*b*," and the bottom panel is labeled "7*c*." As shown in FIGS. 5, 8, and elsewhere, the bottom panel 7*c* has a graded shape as viewed from the front. In FIG. 5, "57" indicates a belt cover shown only in that diagram. The belt cover 57 protects the timing belt of the second drive power transmitting device 34-2 from exposure to the outside.

The area around the aforementioned pair of paper guiding members will be described with reference to FIGS. 5, 6, 9A, 9B, 10, and others. As depicted in FIG. 5, the pair of paper guiding members is made up of an upper guide plate 35 and an auxiliary upper guide plate 36 serving as upper guide members constituting the upper guiding member, and a lower guide plate 37 serving as a lower guiding member disposed opposite. The upper guide plate 35, auxiliary upper guide plate 36, and lower guide plate 37 are each formed integrally of sheet metal subjected to appropriate surface processing, for example. The space defined by the upper guide plate 35, auxiliary upper guide plate 36, and lower guide plate 37 forms the intermediate conveyance path 18.

As depicted in FIGS. 5, 6, 9A, and 9B, shaft supports 35*d* turned upwards are integrally formed at both ends of the front end of the upper guide plate 35. These shaft supports 35*d* are fitted over a support shaft 45 indicated by the double-dashed line in FIG. 6 together with shaft receivers 37*d*, which are integrally formed at both ends of the leading end of the lower guide plate 37 depicted in FIG. 7, and the assembly is fastened by retaining rings. Thus the upper guide plate 35 is configured such that the anchoring end thereof is able to turn a predetermined angle around the support shaft 45, or, specifically, such that the free end thereof can pivot with respect to the lower guide plate 37, and the upper guide plate 35 can be opened.

Figure 6:
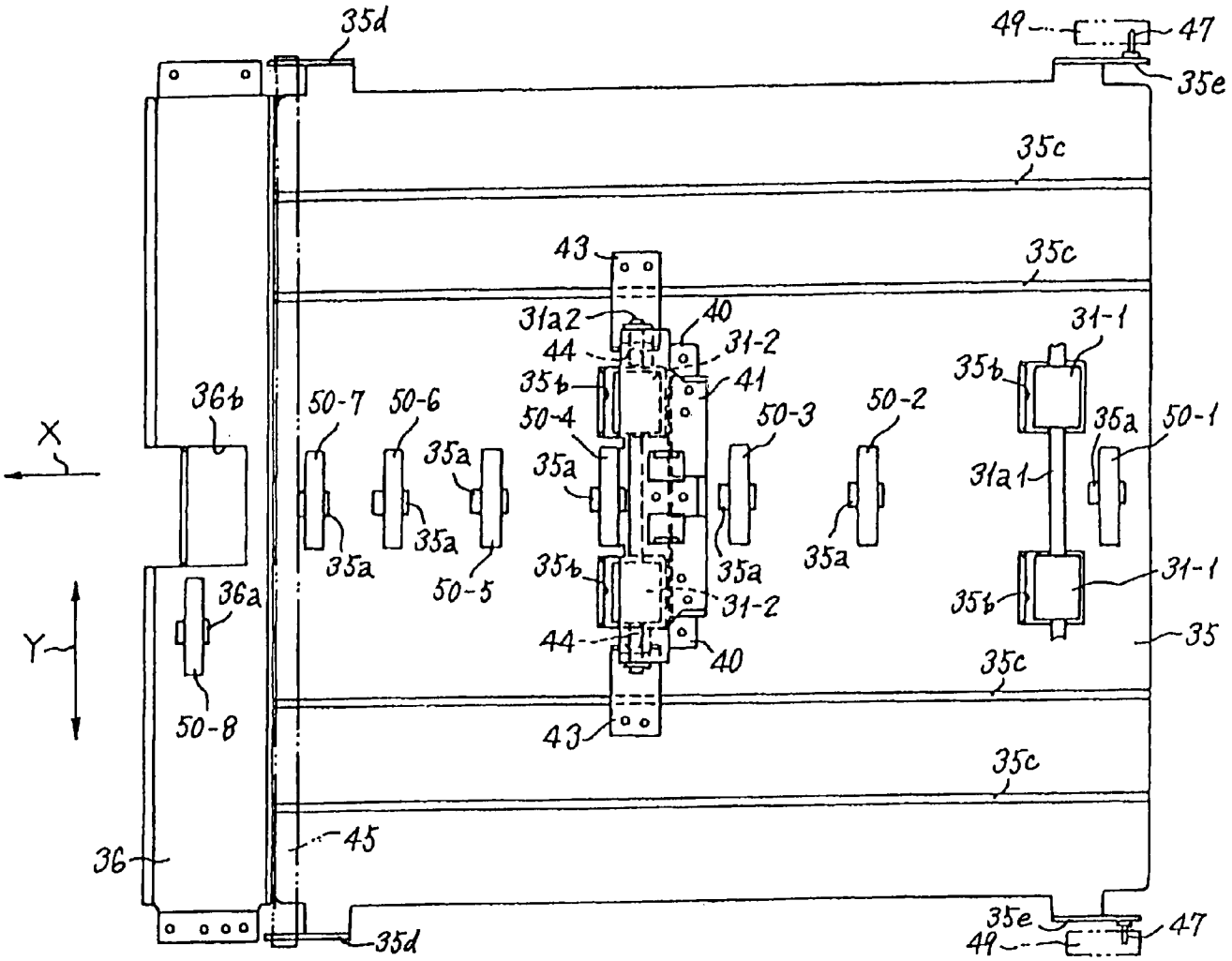
FIG. 6 is a plan view showing the main constitution of the periphery of the upper guide plate when an upper cover is removed.

Meanwhile, as depicted in FIG. 6, upturned parts 35*e* that are turned upwards are integrally formed in both ends of the trailing end of the upper guide plate 35. An outwardly protruding fixed shaft 47 is attached to each of the upturned parts 35*e*. As depicted in FIGS. 7 and 8, the fixed shafts 47 are selectively engaged and fixed/locked by the oscillation of an opening and closing cam 49 (indicated by the double-dashed line in FIG. 6) held in place by an upper guide plate-fixing through-shaft 48 (hereinafter referred to as "through-shaft 48"), disposed on the right and left ends of the rear panel 7*a* of the housing 7 so as to be able to rotate by a predetermined angle. In FIG. 7, "51" indicates a tilted member formed of sheet metal, for example, that is fixed to the leading end portion of the lower guide plate 37.

In FIGS. 6, 9A, 9B, and 10, "35*c*" indicates a convex reinforcing rib facing downward. An appropriate number of other reinforcing ribs 35*c* are also formed in the center of the upper guide plate 35 as well as those shown in the diagram.

As depicted in FIGS. 5 and 6, the first sensor 50-1 is mounted/affixed on the upper guide plate 35 via a sensor mounting member 38, and the second sensor 50-2 through seventh sensor 50-7 are mounted/affixed on the upper guide plate 35 via a sensor mounting member 39, by screws (not pictured) or another fastening device. Note that in FIG. 6, depiction of the sensor mounting members 38 and 39 is omitted.

Figure 10:
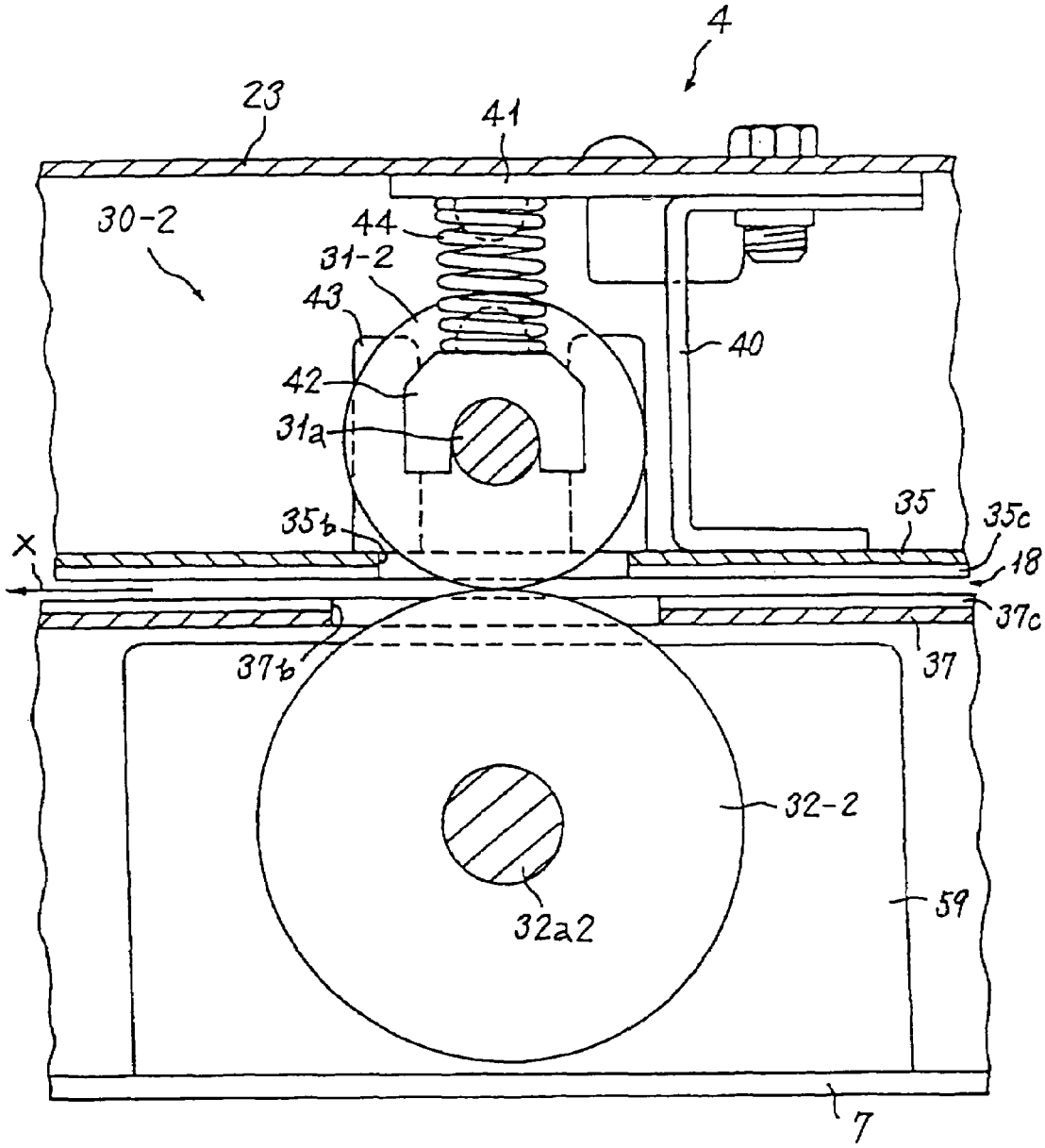
FIG. 10 is a sectional view showing a state of pressing contact between a second pressure roller and a second conveyance roller in the intermediate conveyance portion.

The first sensor 50-1 through eighth sensor 50-8 are constituted by reflection sensors. Openings 35*a* are formed in seven locations in the upper guide plate 35, corresponding respectively to the first through seventh sensors 50-1 to 50-7, for transmitting projected light and reflected light from the sensors 50-1 to 50-7. As depicted in FIGS. 6 and 10, two each of openings 35*b* are formed to the front and rear, and right and left, in the upper guide plate 35 for allowing part of the outer peripheral portion of the first pressure roller 31-1 and second pressure roller 31-2 to protrude. The eighth sensor 50-8 is affixed to the auxiliary upper guide plate 36 by a fastening device such as a screw (not shown) via a sensor attaching member 38. An opening (not pictured) is also formed in the auxiliary upper guide plate 36 similarly to the aforementioned openings 35*a*, for transmitting projected light and reflected light from the eighth sensor 50-8.

The eighth sensor 50-8 serves as the furthest-downstream paper conveyance device, disposed furthest downstream of the first through eighth sensors 50-1 to 50-8 in the intermediate conveyance path 18, and closest to the vicinity of the main body feeding device (main body feed roller 111).

As depicted in FIGS. 5, 6, 9A, and 9B, both the front and back ends of the auxiliary upper guide plate 36 are turned so as to tilt upward. As depicted in FIG. 9, an opening 36*b* is formed in the center of the downstream end of the intermediate conveyance path 18 of the auxiliary upper guide plate 36, for allowing part of the outer periphery of the main body feed roller 111 to protrude when the bulk feed/conveyance unit 1 occupies the connected position depicted in FIG. 1. As depicted in FIG. 5, part of the outer periphery of the third conveyance roller 32-3 described hereinafter is exposed downward near the opening 36*b*.

The upper guide plate 35 is mounted in a substantially integrated fashion on a top cover 23 disposed above the upper guide plate 35, by means of a supporting member 40 depicted in FIG. 10. Hereinafter, the top cover 23 and upper guide plate 35 are sometimes referred to together as the "upper guiding unit 46." Only one is shown in FIG. 10, but a supporting member 40 is also placed near the first pressure roller 31-1 and used to engage the upper guide plate 35 with the top cover 23. The top cover 23 is formed integrally of sheet metal subjected to appropriate surface processing, for example. As in the aforementioned constitution, the free end of the upper guiding unit 46 toward the bulk feeding unit 5 is configured so as to be able to pivot with respect to the lower guide plate 37 around the support shaft 45. In other words, the upper guiding unit 46 including the upper guide plate 35 is able to open and close between the closed position indicated by the solid line in FIG. 5 and the open position indicated by the double-dashed line in the same figure.

A picker 24 used for opening and closing the upper guiding unit 46 with respect to the lower guide plate 37 is attached to the upper surface of the top cover 23 in the direction of the bulk feeding unit 5 (paper feeding mechanism 3) Thus, when a paper jam occurs in the intermediate conveyance portion 4, jammed paper can be removed easily since the upper guiding unit 46, or in other words the upper guide plate 35 and top cover 23, can be opened using the picker 24. Also, when cleaning the pressure rollers 31-1 and 31-2 or the conveyance rollers 32-1 through 32-3, maintenance is facilitated by the ability to perform cleaning with the upper guide plate 35 and top cover 23 opened. Paper dust and contamination adhering to the surface of the sensors 50-1 through 50-7 constituted by reflection photosensors can also be removed easily.

Furthermore, placing the support shaft 45 as a fulcrum on the side of the stencil printing apparatus main body 100 provides more room for safely performing that operation because there is a large space for manual access when removing jammed paper. For example, if the support shaft 45 is mounted in the bulk feeding unit 5 in contrast to the constitution described above, and manual access is attempted from the side of the stencil printing apparatus main body 100, the main body housing 107 presents an obstacle that makes such access difficult, as depicted in FIG. 1.

As depicted in FIG. 6, the first pressure roller. 31-1 is formed integrally with its shaft 31*a*1, and provided in a pair of segments having a symmetrical relationship on the right and left ends of the shaft 31*a*1. The second pressure roller 31-2 is arranged in the same manner. The first pressure roller 31-1 and second pressure roller 31-2 are mounted by the support structure depicted in FIGS. 6 and 10 (the first pressure roller 31-1 side is not illustrated, but its support structure is identical) so as to be able to rotate between the top cover 23 and upper guide plate 35, and the first and second pressure rollers 31-1 and 31-2 are mounted so that part of the outer periphery thereof protrudes downward from the opening 35*b* of the upper guide plate 35 and approaches the intermediate conveyance path 18.

The aforementioned support structure is constituted mainly by: a lateral pair of spring guides 42 for supporting the shaft 31*a*2 of the pair of second pressure rollers 31-2 at both ends so as to allow the shaft to rotate; a lateral pair of upper and lower guiding members 43 attached by welding to the upper guide plate 35, for guiding the spring guides 42 so they can move upwards and downwards; a spring fixing member 41 fixed with a screw to the supporting member 40 so as to cover the pair of spring guides 42 from above; and a lateral pair of compression springs 44 disposed in the space between an upward protrusion integrally formed in the spring guides 42 and a downward protrusion integrally formed in the spring fixing members 41.

A material having low frictional resistance and good abrasion resistance is appropriately selected for the spring guides 42 in order to provide support that allows the shaft 31*a*2 to rotate. The compression springs 44 function as a biasing member for biasing the outer peripheral surface of the second pressure rollers 31-2 to press against the outer peripheral surface of the second conveyance rollers 32-2 protruding down from the lower guide plate 37. The pair of first pressure rollers 31-1 is arranged in the same manner.

This unpublished embodiment is not limiting, and the pressure rollers may be mounted on the lower guiding member side and the conveyance rollers on the upper guiding member side, with a biasing member (the aforementioned compression springs, for example) for biasing the pressure rollers against the conveyance rollers disposed on the lower guiding member side.

The area around the upper part of the lower guide plate 37 and housing 7 will next be described with reference to FIGS. 5, 7, 9A, 9B, and 10. The lower guide plate 37 is mounted/affixed to the upper part of the box-shaped housing 7 that is opened upward by a screw (not pictured) or other fastening device, via an appropriate reinforcing member or the like. Eight openings 37*a* are formed in the lower guide plate 37 at lower sites that correspond to the seven openings 35*a* formed in the upper guide plate 35 and the single opening 36*a* formed in the auxiliary upper guide plate 36. These eight openings 37*a* are for transmitting projected light corresponding to each of the first sensor 50-1 through eighth sensor 50-8 mounted in the upper guide plate 35.

As depicted in FIGS. 7, 9A, 9B, and 10, two each of openings 37*b* are formed forward and backward and right and left in the lower guide plate 37 for allowing part of the outer peripheral portion of the first conveyance rollers 32-1 and second conveyance rollers 32-2 to protrude from the trailing end thereof. An opening 37*b* is also formed at the center of the leading end of the lower guide plate 37, for allowing part of the outer peripheral portion of the third conveyance roller 32-3 to protrude.

As depicted in FIGS. 7 and 9A and 9B, a tilted member 51 whose leading end is tilted downward is affixed to the leading end of the lower guide plate 37. The tilted member 51 is designed to pivot the feeding filler (not pictured) toward engagement with the correct height sensor 126, via the pivoting of the above-mentioned feeding arm (not pictured), by smoothly contacting the main body feed roller 111 and a roller at the lower end of the feeding filler (not pictured) when the bulk feed/conveyance unit 1 moves in the paper conveyance direction X to occupy the connected position depicted in FIG. 1.

Positioning members 52 are fastened/fixed by screws on the right and left ends of the lower guide plate 37 toward the leading edge thereof. The positioning members 52 position the paper width direction Y with respect to a lateral pair of feeding side plates 107A secured to the main body housing 107 to the right and left of the feeding port 125 when the bulk feed/conveyance unit 1 moves in the paper conveyance direction X to occupy the connected position depicted in FIG. 1. Contacting members 53 having a predetermined thickness are fastened/fixed by screws on the right and left ends of the lower guide plate 37 toward the trailing edge thereof. The contacting members 53 are designed to form a consistent intermediate conveyance path 18 by maintaining a constant gap (maintaining a paper height of 1.2 mm, for example) between the bottom surface of the upper guide plate 35 and the top surface of the lower guide plate 37 when the upper guiding unit 46 (top cover 23 and upper guide plate 35) occupy the closed position.

As depicted in FIG. 7, part of the rear side panel 7*a* of the housing 7 is shown to the rear of the lower guide plate 37 (to the right in the figure). Part of the through-shaft 48 described above is supported so as to be able to pivot via a shaft-receiving member at the top of the rear side panel 7*a* on both the right and left sides opening and closing cams 49 in phase with each other are affixed to both the right and left ends of the through-shaft 48. An opening and closing handle 55 is affixed as a fixing device at the left end of the through-shaft 48.

Groove portions (not pictured) running along the fixed shaft 47 depicted in FIG. 6 and engaging portions (not pictured) for locking/fixing are in communication/formed in the opening and closing cams 49. The opening and closing cams 49 and opening and closing handle 55 depicted in FIGS. 1 through 3 are shown in a position such that the upper guiding unit 46 that includes the upper guide plate 35 is fixed in a closed position. Specifically, when the opening and closing handle 55 is pivoted clockwise in FIG. 7 with respect to the upper guiding unit 46 in a closed position, the two opening and closing cams 49 oscillate around the through-shaft 48, thereby causing the opening and closing cams 49 to be in phase with respect to the fixed shaft 47 depicted in FIG. 6, and the aforementioned engaging portions to engage. Thus the upper guiding unit 46 can be securely fixed near the closed position. An opening and closing sensor 67 (shown in FIGS. 12 and 13) is affixed to the auxiliary side plates 29 (not pictured) to the right (far side of paper surface, counter-operating side) of FIG. 7 as a fixed-state detecting device for detecting that the engaging portions of the opening and closing cams 49 are engaged with the fixed shaft 47 on the upper guiding unit 46 side, and that the upper guiding unit 46 that includes the upper guide plate 35 is fixed/locked with respect to the lower guide plate 37. The opening and closing sensor 67 is constituted by a transmission sensor.

In FIGS. 7, 9A, 9B, and 10, "37*c*" indicates a convex reinforcing rib facing upward. An appropriate number of other reinforcing ribs 37*c* are also formed in the center of the lower guide plate 37 as well as those shown in the diagram. In FIGS. 5 and 7, "54" indicates an upper feeding plate fixed to the main body housing 6 side. In FIG. 7, "56" indicates a stopper fixed to the rear side panel 7*a* near the opening and closing cams 49. The stopper 56 contacts the opening and closing cams 49 to regulate the opening position.

As described above, by means of this unpublished embodiment, advantages are demonstrated whereby both the upper guide plate 35 and auxiliary upper guide plate 36, serving as an upper guide member constituting the upper guiding member, and the opposing lower guide plate 37 serving as the lower guiding member, extend together to the vicinity of the feeding port 125, allowing the paper P to be reliably conveyed and transferred from the paper feeding mechanism 3 of the bulk feeding unit 5 to the main body feed roller 111 on the stencil printing apparatus main body 100 side by way of the intermediate conveyance portion 4 even if the paper P has inconsistent quality with wide variations in stiffness, such as ground wood paper, for example. As a result, instances of the leading edge of the paper P catching on the protrusions on the main body feed roller 111 (the jagged portions formed on the outer peripheral portion of the roller), edge tearing or damage to the paper P, jamming, and so on, are eliminated.

If advantages equivalent to those achieved by the unpublished embodiment described above are not deemed necessary, a constitution may be adopted wherein at least one of either the upper guiding member or lower guiding member extends to the vicinity of the main feeding table 110 or feeding port 125. In this case, "extending" to the vicinity of the main feeding table 110 or feeding port 125, as is apparent from the depiction of this unpublished embodiment in FIG. 5, means that a case in which the auxiliary upper guide plate 36 is separate from, and independent of, the lower guide plate 37 is also included.

The area around the housing 7 will now be described with reference to FIGS. 5 and 8 through 10. The first through third motors 33-1 to 33-3 each consist of stepping motors that operate by pulse input. The motors 33-1 to 33-3 are each mounted/fixed to the bottom panel 7*c* of the housing 7 via a motor bracket (not pictured) by a screw or other fastening device so as to be slightly movable and capable of adjusting the tension of the timing belts that constitute the first through third drive power transmitting devices 34-1 to 34-3.

If advantages equivalent to those achieved by this unpublished embodiment are not deemed necessary, it is possible to adopt a constitution that is not limited to this unpublished embodiment and involves having at least one driving device (stepping motor, for example) for driving the conveyance rollers 32-1 to 32-3 to rotate, for example. In this case, a magnetic clutch or the like, for example, may be disposed in at least two of the conveyance rollers 32-1 through 32-3, and the driving force of the driving device (stepping motor, for example) may be switchably (ON/OFF) controlled at an appropriate timing.

As depicted in FIG. 8, the first conveyance rollers 32-1 are mounted as a pair of segments at both the right and left ends of the shaft 32*a*1 thereof. These first conveyance rollers 32-1 are rotatably supported by a first bracket 58 mounted/fixed by a screw to the bottom panel 7*c* via the shaft 32*a*1 and a bearing (not pictured). A one-way clutch 61 serving as a device for transmitting driving force in one direction is interposed between the first conveyance rollers 32-1 and the shaft 32*a*1 such that the first conveyance rollers 32-1 are capable of rotating only in the counterclockwise direction of FIG. 5, or in other words only in the direction in which paper P fed from the paper feeding mechanism 3 is conveyed in the paper conveyance direction X. The second conveyance rollers 32-2 are also rotatably supported by a second bracket 59 mounted/fixed by a screw to the bottom panel 7*c* via the shaft 32*a*2 and a bearing (not pictured) in the same manner as described above.

As depicted in FIG. 10, the first and second conveyance rollers 32-1 and 32-2 are both disposed so that part of the outer peripheral portion thereof protrudes upward from the opening 37*b* in the lower guide plate 37 and approaches the intermediate conveyance path 18. Among the first through third conveyance rollers 32-1 to 32-3, the third conveyance roller 32-3 is disposed furthest downstream in the intermediate conveyance path 18, and is constituted by a single roller. The third conveyance roller 32-3 is rotatably supported by a third bracket 60 mounted/fixed by a screw to the bottom panel 7*c* via the shaft 32*a*3 and a bearing (not pictured) thereof. A one-way clutch 61 identical to that described above is interposed between the third conveyance roller 32-3 and the shaft 32*a*3 such that the third conveyance roller 32-3 is capable of rotating only in the counterclockwise direction of FIG. 5, or in other words only in the direction in which paper P fed from the paper feeding mechanism 3 is conveyed in the paper conveyance direction X.

As depicted in FIGS. 9A and 9B, the third conveyance roller 32-3 is also disposed so that part of the outer peripheral portion thereof protrudes upward from the opening 37*b* in the lower guide plate 37 and approaches the intermediate conveyance path 18. The third conveyance roller 32-3 is disposed in a position facing the main body feed roller 111 on the stencil printing apparatus main body 100 side, and is disposed in a predetermined position of the housing 7 of the intermediate conveyance portion 4 depicted in the diagrams so as to be able to slip under and press against the outer peripheral surface of the main body feed roller 111 when the bulk feed/conveyance unit 1 occupies the connected position depicted in FIG. 1.

As depicted in FIGS. 9A and 9B, a plate spring 62 is mounted/fixed inside the front side panel 7*b* of the housing 7 by a screw or other fastening device as a braking force applying device for applying an appropriate level of braking force to the third conveyance roller 32-3. As indicated by the solid line in the same diagrams, the braking force applied by the plate spring 62 is applied to a core portion 32*b* serving as the shaft of the third conveyance roller 32-3, to which the rotational driving force of the third motor 33-3 is transmitted via the third drive power transmitting device 34-3 and one-way clutch 61.

This constitution is not limiting, and a constitution may be adopted whereby the braking force of the plate spring 62 is applied to the third conveyance roller 32-3 itself, to which the rotational driving force of the third motor 33-3 is transmitted via the third drive power transmitting device 34-3 and one-way clutch 61, as indicated by the double-dashed line in the same figures. Needless to say, in this case braking force is applied in a range that imparts durability to the third conveyance roller 32-3 or that does not place an excessive load on the third motor 33-3 constituting the driving device thereof. By applying this appropriate braking force, the effects of inertia in the third conveyance roller 32-3 during conveyance can be minimized, and a consistent stopping position for the paper can be maintained, resulting in enhanced paper conveyance precision.

This unpublished embodiment is not limiting, and the one-way clutch 61 serving as a device for transmitting rotational driving force in one direction may be disposed in the shaft of the third conveyance roller 32-3, which is disposed furthest toward the downstream side of the intermediate conveyance path 18. Also, a constitution may be adopted whereby the braking force applied by the plate spring 62 serving as the braking force applying device is applied appropriately to include the second conveyance rollers 32-2 or first conveyance rollers 32-1 disposed on the downstream side of the intermediate conveyance path 18. In this case, the braking force applied by the plate spring 62 should be set to a level that increases toward the main body feed roller 111 of the stencil printing apparatus main body 100.

The first drive power transmitting device 34-1 is constituted mainly by a timing pulley 63-1 fixed to the output shaft (rotating shaft) of the first motor 33-1, a timing pulley 64-1 fixed to one end of the shaft 32*a*1 of the first conveyance rollers 32-1, and a timing belt 65-1 wrapped around the timing pulley 63-1 and timing pulley 64-1.

The second drive power transmitting device 34-2 is constituted mainly by a timing pulley 63-2 fixed to the output shaft (rotating shaft) of the second motor 33-2, a timing pulley 64-2 fixed to one end of the shaft 32*a*2 of the second conveyance rollers 32-2, and a timing belt 65-2 wrapped around the timing pulley 63-2 and the timing pulley 64-2.

In the same manner, the third drive power transmitting device 34-3 is constituted mainly by a timing pulley 63-3 fixed to the output shaft (rotating shaft) of the third motor 33-3, a timing pulley 64-3 fixed to one end of the shaft 32*a*3 of the third conveyance roller 32-3, and a timing belt 65-3 wrapped around the timing pulley 63-3 and the timing pulley 64-3.

As depicted in FIGS. 1, 5, 9A, and 9B, the bottom of the housing 7 is provided with a paper length sensor shutter mechanism 70-1 serving as a paper length detection shutter mechanism for selectively shielding the opposing paper length sensor 128 that is disposed inside the main feeding table 110, and a paper detection sensor shutter mechanism 70-2 serving as a paper detection shutter mechanism for selectively shielding the opposing paper detecting sensor 127, when the bulk feed/conveyance unit 1 occupies the connected position depicted in FIG. 1. Since the paper length sensor shutter mechanism 70-1 and the paper detection sensor shutter mechanism 70-2 have a substantially identical structure, the structure of the paper detection sensor shutter mechanism 70-2 will be described in detail, and description of the structure of the paper length sensor shutter mechanism 70-1 will be omitted.

As depicted in detail in the front view of FIG. 9A and side view of FIG. 9B, the paper detection sensor shutter mechanism 70-2 is constituted mainly by a shutter 71-2 serving as a shielding member, a pulling-type solenoid 72-2 serving as a shielding drive device, a tension spring 73-2 serving as a biasing device, a shutter mechanism protecting member 74-2, a fulcrum shaft 75-2, and a holder 76-2.

The shutter mechanism protecting member 74-2 is an immobile member made of sheet metal, for example, and is formed roughly into a horseshoe shape as viewed from the front. The shutter mechanism protecting member 74-2 is mounted/fixed to the lower surface of the bottom panel 7*c* of the housing 7 by a screw or other fastening device. An opening 74*a*2 for transmitting projection light and reflection light from the paper detecting sensor 127 is formed in the bottom panel of the shutter mechanism protecting member 74-2. A holder 76-2 for mounting/fixing the solenoid 72-2 and anchoring the fulcrum shaft 75-2 by a screw is mounted/fixed by screws to the right-hand surface in FIG. 9A of the shutter mechanism protecting member 74-2. Thus, the holder 76-2 becomes an immobile member in the same manner as the shutter mechanism protecting member 74-2. A spring latch 76*a*2 for catching on/engaging with one end of the tension spring 73-2 is folded back at the central right end of the holder 76-2 in FIG. 9B.

The shutter 71-2 is made of sheet metal, for example, and is configured so that the free end thereof is able to oscillate around the fulcrum shaft 75-2 between a virtual "paper present" position that blocks/reflects the projection light of the paper detecting sensor 127 via the opening 74*a*2 as depicted by the solid line in FIG. 9B, and a virtual "paper absent" position that transmits the projection light of the paper detecting sensor 127 as depicted by the double-dashed line in FIG. 9B. A spring latch 71*a*2 for catching on/engaging with the other end of the tension spring 73-2 is folded back at the upper right end of the shutter 71-2 in FIG. 9B. An interlocking hole for loosely interlocking a pin 72*a*2 pushed in by the leading end of the plunger of the solenoid 72-2 is formed in the upper left end of the shutter 71-2 in FIG. 9B. The pin 72*a*2 of the solenoid 72-2 is connected to the shutter 71-2 through a pin insertion tube (not pictured) opened in the holder 76-2 and the above-mentioned interlocking hole in the shutter 71-2.

The lower part of the shutter 71-2 is folded back into an L shape, and appropriate surface processing is applied on the lower surface thereof for reflecting projection light from the paper detecting sensor 127 to the same degree as the paper surface. The tension spring 73-2 extends between the spring latch 76*a*2 of the holder 76-2 and the spring latch 71*a*2 of the shutter 71-2, and continually urges the free end of the shutter 71-2 (lower surface in the figure) in the clockwise direction in FIG. 9B toward the virtual "paper present" position. Also, the biasing force of the tension spring 73-2 aids the return of the plunger of the solenoid 72-2 and the pin 72*a*2 via the shutter 71-2.

An operation of the paper detection sensor shutter mechanism 70-2 will now be described in advance. When electric power is supplied to the solenoid 72-2 so that the solenoid 72-2 is turned ON, the plunger and pin 72*a*2 are moved substantially downward in FIGS. 9A and 9B against the biasing force of the tension spring 73-2 by the magnetic attraction thereof, and the free end of the shutter 71-2 thereby pivots around the fulcrum shaft 75-2 in the counterclockwise direction in FIG. 9B to occupy the virtual "paper absent" position indicated by the double-dashed line in FIG. 9B. On the other hand, when electrical power is cut from the solenoid 72-2 so that the solenoid 72-2 is turned OFF, the plunger and pin 72*a*2 are moved substantially upward in FIGS. 9A and 9B by the biasing force of the tension spring 73-2, and the free end of the shutter 71-2 thereby pivots around the fulcrum shaft 75-2 in the clockwise direction in FIG. 9B to occupy the virtual "paper present" position indicated by the solid line in FIG. 9B.

When the bulk feed/conveyance unit 1 occupies the connected position depicted in FIGS. 1, 9A, and 9B, the solenoid 72-2 is turned OFF by a command from the control apparatus to be described below, and the free end of the shutter 71-2 is thereby brought to the virtual "paper present" position that blocks/reflects the projection light of the paper detecting sensor 127. When paper on the carrying portion 2 and intermediate conveyance portion 4 then runs out, the free end of the shutter 71-2 pivots around the fulcrum shaft 75-2 in the counterclockwise direction of FIG. 9B against the biasing force of the tension spring 73-2 to occupy the virtual "paper absent" position indicated by the double-dashed line in FIG. 9B by means of the solenoid 72-2 being turned ON by a command from the above-mentioned control apparatus, allowing the control apparatus (not pictured) on the stencil printing apparatus 100 side to recognize that there is no paper. On the other hand, when paper is present in the intermediate conveyance portion 4, the solenoid 72-2 is turned OFF by a command from the control apparatus, whereby the free end of the shutter 71-2 is brought into the virtual "paper present" position in the same manner as described above. Thus the control apparatus on the stencil printing apparatus 100 side recognizes that paper is present, and passage of the paper from the intermediate conveyance portion 4 to the stencil printing apparatus main body 100 side becomes possible.

The paper detection sensor shutter mechanism 70-2 differs mainly from the paper length sensor shutter mechanism 70-1 in possessing a function whereby the shutter mechanism protecting member 74-2 comes into contact with the front panel 124 of the main body feeding portion 104 and performs connection positioning together with the tilted member 51 when the bulk feed/conveyance unit 1 occupies the connected position depicted in FIGS. 9A and 9B. Consequently, although the paper length sensor shutter mechanism 70-1 has a partially different structure to the paper detection sensor shutter mechanism 70-2, it comprises substantially the same constituent elements, and hence description thereof will be omitted by adding "1" after the hyphenated symbols of the constituent elements.

In FIG. 8, "77" indicates a rotating shaft used for print centering (width-directed adjustment of the paper P). A male screw (not pictured) is cut into one end of the rotating shaft 77. The male screw on one end of the rotating shaft 77 is screwed into a screw member (not pictured) formed by cutting a female screw into the upper portion of the pair of auxiliary side plates 29 on the left and right of the main body housing 6, and movement in the paper width direction Y by this screw mechanism is used to adjust the width direction of the paper P. As shown in FIG. 3, an operating handle 77A for manual operations is attached and fixed to the other end portion of the rotating shaft 77.

An electric control structure for controlling an operation of the bulk feed/conveyance unit 1, to be described below, will now be described with reference to FIGS. 11 through 13. Note that to simplify the figures, sensors 26, 27, 66, 67, the first through eighth sensors 50-1 to 50-8, and so on are indicated by triangles, and the motors 22, 28, 33-1 to 33-3, solenoids 72-1 and 72-2, and so on are depicted schematically and in simplified fashion. The first through eighth sensors 50-1 to 50-8 are depicted as though they were disposed on the lower guide plate 37 side in FIGS. 11 through 13, but this is merely intended to simplify description of the control structure and operation, and does not change the fact that the first through eighth sensors 50-1 to 50-8 are disposed on the upper guide plate 35 side as described above.

A supplementary description of the positioning of the first through eighth sensors 50-1 to 50-8 and the like will first be given on the basis of FIG. 11. Specifically, the first through eighth sensors 50-1 to 50-8 are disposed/fixed on the upper guide plate 35 at the dimensional intervals shown in FIG. 11 from the upstream to downstream side of the paper conveyance direction X in the intermediate conveyance path 18. As indicated by the parentheses in the same figure and as depicted in FIG. 15, this is based on the fact that the length of the paper P along the paper conveyance direction X corresponds to ten types of paper sizes (11 types including B6Y (landscape)). In FIGS. 11 and 15, the A3Y (landscape) size corresponds to a length of 420 mm along the paper conveyance direction X, the A4T (portrait) size corresponds to a length of 210 mm along the paper conveyance direction X, and the DLY (double letter) size corresponds to a maximum length in this unpublished embodiment of 432 mm along the paper conveyance direction X.

Also, the paper conveyance length of the intermediate conveyance path 18 is set to 480 mm in accordance with the DLY size. In FIG. 11, examples are cited in which the distance from the center of the nip portion formed by the first pressure roller 31-1 and first conveyance roller 32-1 to the center of the nip portion formed by the second pressure roller 31-2 and second conveyance rollers 32-2 is 170 mm, and in which the distance from the center of the nip portion formed by the second pressure roller 31-2 and second conveyance roller 32-2 to the center of the nip portion formed by the main body feed roller 111 of the main body feeding portion 104 and the third conveyance roller 32-3 is 170 mm.

A supplementary description will be given herein of an embodiment of the main positional relationships between the printing unit 102 of the stencil printing apparatus main body 100, the main body feeding portion 104, and the intermediate conveyance portion 4 when the bulk feed/conveyance unit 1 occupies the connected position depicted in FIG. 1. The distance from the center of the nip portion formed when the printing drum 115 and press roller 116 are pressed together to the center of the nip portion formed by the registration roller pair 114 is approximately 120 mm, the distance from the center of the nip portion formed by the registration roller pair 114 to the center of the nip portion formed when the main body feed roller 111 is pressed against the third conveyance roller 32-3 is approximately 120 mm, and the distance from the center of the nip portion formed between the printing drum 115 and press roller 116 to the center of the nip portion formed between the main body feed roller 111 and the third conveyance roller 32-3 is approximately 240 mm. Consequently, when feeding is performed from the intermediate conveyance portion 4 to the main feeding portion 104 using the shortest size B5T (182 mm), the region from the point at which the leading edge of the B5T reaches the nip portion between the printing drum 115 and press roller 116 to the position of the trailing edge of the B5T is equal to the space between the registration roller pair 114 and the main body separating roller 112.

This description is approximate, but the upper roller of the registration roller pair 114 is configured so as come into and out of contact with the lower roller by means of a connecting and separating mechanism equipped with a biasing device such as a timing cam or tension spring (not pictured). By means of this constitution, when the leading edge of the paper is held fast in the nip portion between the printing drum 115 and press roller 116 by a certain length, the upper roller of the registration roller pair 114 is separated from the lower roller by the above-mentioned contact mechanism, thereby preventing a load produced by the pressing contact at the nip portion between the registration roller pair 114 from being imposed on the paper, the rotation of the printing drum 115, and so on. For the same reasons, a constitution is put in place whereby as little as possible of the load created by the driving force transmitting device, feed motor 122 (stepping motor), and other components connected to the main body separating roller 112 and main body feed roller 111 by the one-way clutch mounted to the shafts of the main body separating roller 112 and main body feed roller 111 is applied to the conveyed paper, the rotation of the printing drum 115, and the like.

Also, high-precision paper conveyance can be performed easily since the first through third motors 33-1 to 33-3 consisting of shared stepping motors are used in this unpublished embodiment, and the paper conveyance distance (or the quantity of paper conveyed) can be controlled by the number of pulses delivered to the stepping motors when paper is conveyed along the intermediate conveyance path 18 having the predetermined distances described above or along the paper conveyance path on the side of the stencil printing apparatus main body 100. The same applies to the feed motor 22, the feed motor 122 on the side of the stencil printing apparatus main body 100, and a registration motor (not pictured) constituted by a stepping motor for driving the registration roller pair 114 of the main body feeding portion 104 to rotate.

A description of the constituent elements of the control system used by the present embodiment, including a supplementary description of the constituent elements described above, will now be given with reference to FIG. 12. In FIG. 12, "78", depicted by a double-dashed line, indicates a power supply table, "78*a*" indicates a power cable for connecting to a commercially available external power supply, for example, "79," depicted by a double-dashed line, indicates a control table on which the hereinafter described control apparatus and the like are mounted, "80" indicates a power switch for switching the electrical power that is supplied to the entire bulk feed/conveyance unit 1 via the power cable 78*a* ON and OFF, "81" indicates a reset switch serving as an initial setting device for initializing an operation of the bulk feed/conveyance unit 1, or in other words providing an instruction to activate an initialized (or initial setting) state, and "82" indicates a feeding table lowering switch which is depressed or operated for a predetermined time to control the elevating motor 28 such that the bulk feeding table 10 is set in a final lowered position.

The power switch 80 is disposed in the left-hand panel on the operating side, and the reset switch 81 and feeding table lowering switch 82 are disposed on top of the main body housing 6, which can also be referred to as an operating panel for the bulk feed/conveyance unit 1. When paper is to be replenished/added to the bulk feeding table 10 of the carrying portion 2, the feeding table lowering switch 82 is operated to lower the bulk feeding table 10 by an amount corresponding to the amount of paper to be added, whereupon paper is supplied thereto, and when jamming or the like occurs in the paper feeding mechanism 3 or the like, the feeding table lowering switch 82 is operated to lower the bulk feeding table 10 slightly so that the jam or the like can be dealt with.

Figure 12:
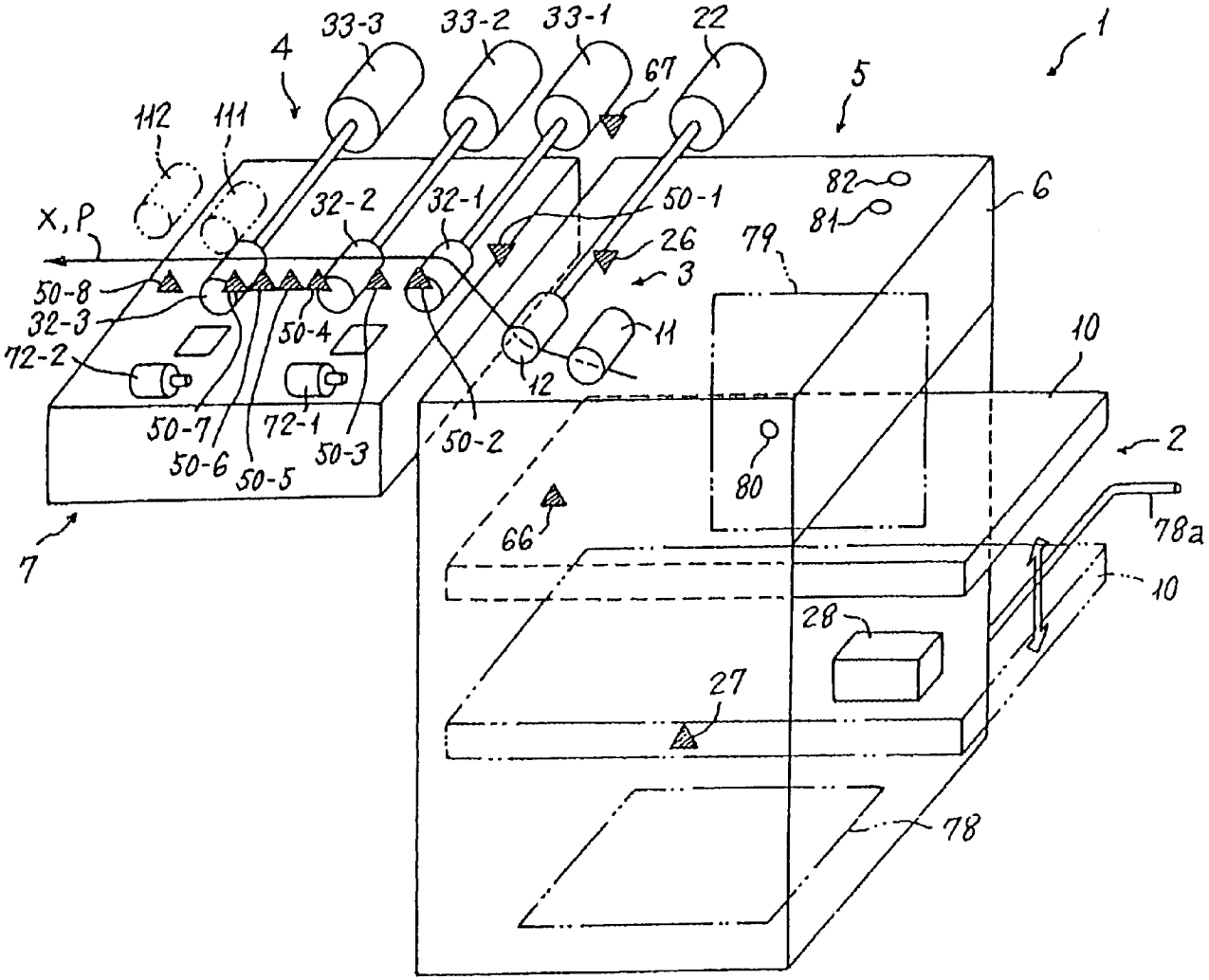
FIG. 12 is a perspective view showing in outline the disposal state of the main constitutional control elements on the bulk feed/conveyance unit side.
Figure 13:
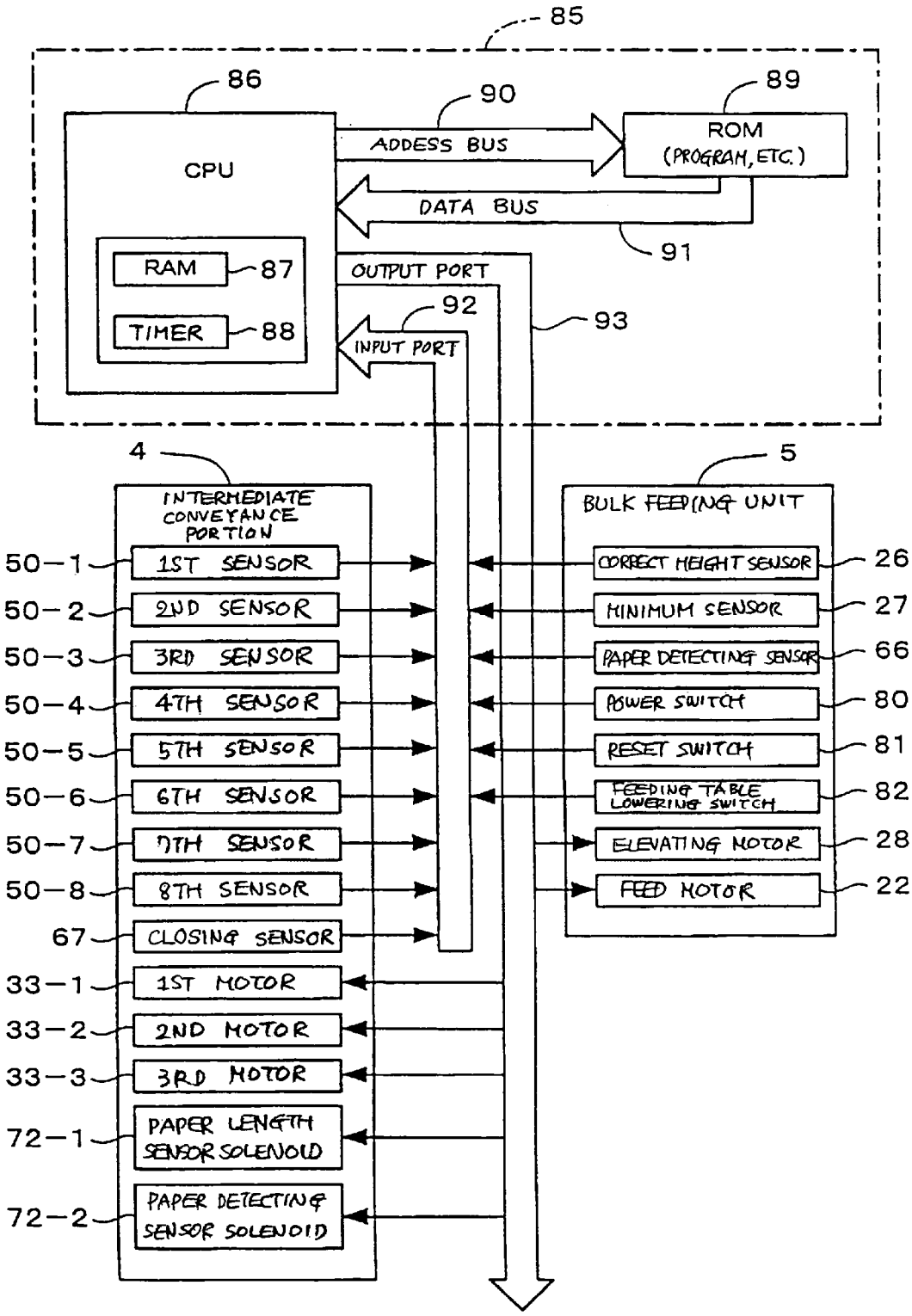
FIG. 13 is a block diagram showing the main electric control constitution of the bulk feed/conveyance unit in an offline mode.

FIG. 13 depicts the main control structure of the bulk feed/conveyance unit 1 in block format. In the figure, a control apparatus 85 comprises in its interior a CPU 86 (central computational processing unit), RAM 87 (a readable/writable storage apparatus), a timer 88 serving as a timekeeping device, ROM 89 (a read-only storage apparatus), and so on, and is equipped with a microcomputer having a structure in which the CPU 86 and ROM 89 are connected by an address bus 90 and data bus 91, and the CPU 86, RAM 87, and timer 88 are each connected by a signal bus (not pictured). The control apparatus 85 is provided on a disposal portion of the control table 79 depicted in FIG. 12.

The CPU 86 is electrically connected to the correct height sensor 26 and minimum sensor 27 provided on the bulk feeding unit 5 side, the paper detecting sensor 66 disposed in the bulk feeding table 10 or a plurality of paper size sensors not pictured, the power switch 80, reset switch 81, and feeding table lowering switch 82, via sensor input circuits or switch input circuits (not pictured) and an input port 92, and to the opening and closing sensor 67 and the first through eighth sensors 50-1 to 50-8 provided on the intermediate conveyance portion 4 side via sensor input circuits (not pictured) and an input port 92, and receives various signals from these sensors and switches.

The CPU 86 is electrically connected to the elevating motor 28 and the feed motor 22 on the bulk feeding unit 5 side via a motor driving circuit (not pictured) and an output port 93, as well as to the first through third motors 33-1 to 33-3 provided on the intermediate conveyance portion 4 side, and to the paper length sensor solenoid 72-1 and the paper detecting sensor solenoid 72-2 via a motor drive circuit (not pictured), solenoid drive circuit, and the output port 93. The CPU transmits various command signals for controlling the operation of the above-mentioned motors, solenoids, and the like, and thus controls the overall operation of the bulk feed/conveyance unit 1, such as the starting and stopping of the various aforementioned control subject devices, timing, and so on based on various signals from the above-mentioned sensors and switches, and an operating programs retrieved from the ROM 89.

The ROM 89 stores programs depicted in the flowchart described hereinafter showing the flow of the overall operation of the bulk feed/conveyance unit 1 or a paper conveyance operation, and various relational data for allowing the CPU 86 to perform its control and calculation functions (to be referred to simply as "functions" hereafter). These operating programs and relational data are retrieved appropriately by the CPU 86. The RAM 87 has a function for temporarily storing the computational results of the CPU 86, and a function for periodically storing various set/inputted ON/OFF signals, data signals, and other various signals from the above-mentioned switches and sensors. The timer 88 functions as a timekeeping device for measuring the time taken for the trailing edge of the paper P to travel between the sensors 50-1 to 50-8 when conveyance of the paper P over the sensors 50-1 to 50-8 begins in response to the initiation of feeding by the main body feed roller 111 through operation of the feed motor 122 on the stencil printing apparatus main body 100 side.

The CPU 86 (also referred to hereafter as "control apparatus 85" for convenience in description) has a first function as a control device for determining the paper size (more accurately, the paper size relating to paper length) and performing control to modify the paper conveyance control system of the conveyance rollers 32-1 to 32-3 on the basis of signals from the sensors 50-1 to 50-8 at a reset time, which is the time when initialization is performed after conveyance of a single sheet of paper P over the sensors 50-1 to 50-8 is complete.

Figure 11:
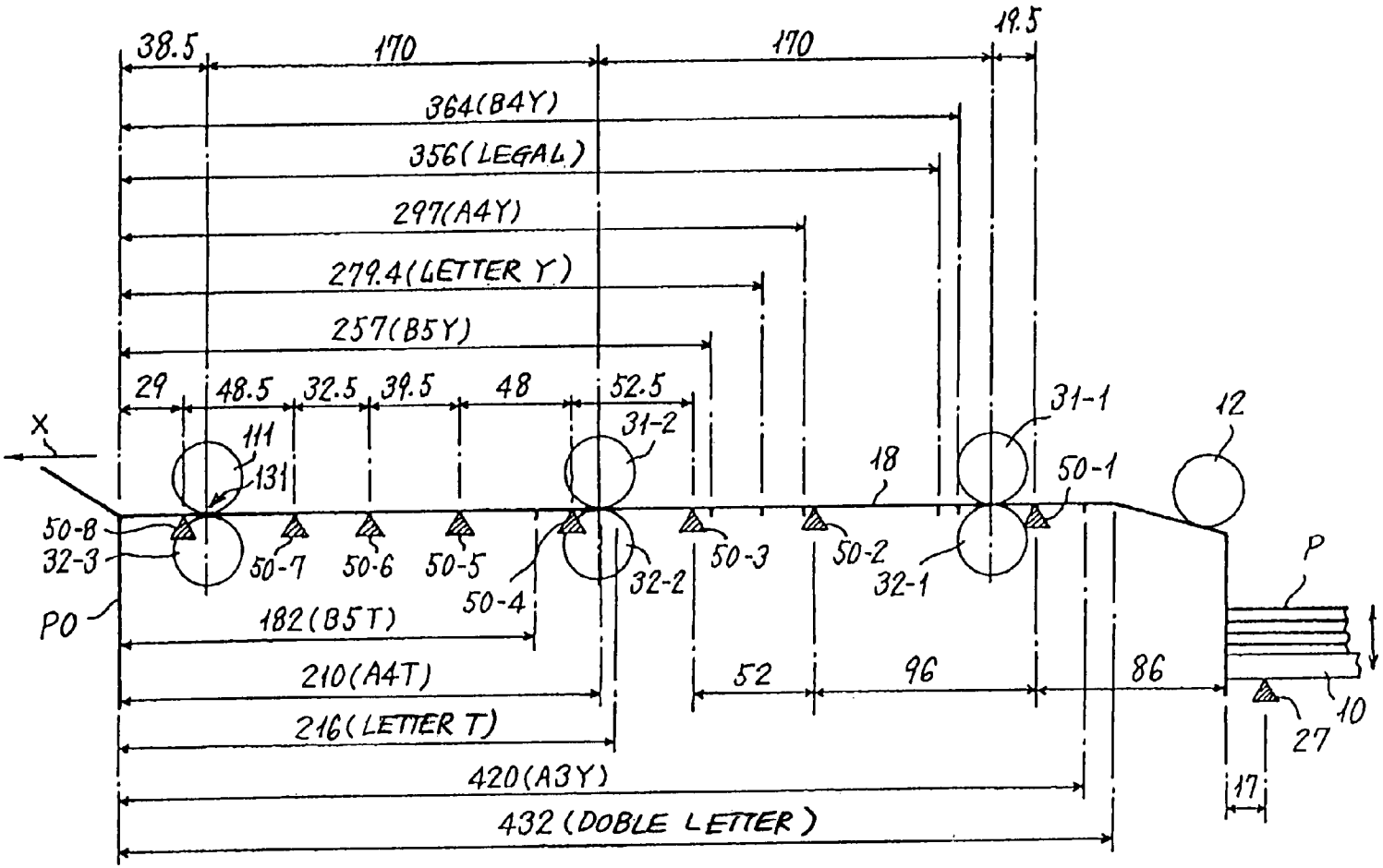
FIG. 11 is a view illustrating paper detecting devices (first through eighth sensors) in the intermediate conveyance portion, the disposal and dimensional states of paper conveyance devices, and various paper length sizes.

The reset state is preset such that at this time, the paper P is positioned in the third conveyance roller 32-3 disposed furthest toward the downstream side of the intermediate conveyance path 18, and such that the leading edge of the paper P can be fed by the main body feed roller 111 indicated by the double-dashed line in FIG. 12, or in other words, as described in the Summary of the Invention, such that the stopping position P0 of the leading edge of the paper P shown in FIG. 11, conveyed from the intermediate conveyance portion 4, substantially matches the leading edge of a sheet of paper set on the main body feeding table 110 of the stencil printing apparatus 100. Also, as shown in FIG. 11, the target stopping position P0 is set to a position about 38.5 mm down the paper conveyance direction X from the center of a nip portion 131 formed by pressing together the main body feed roller 111 and third conveyance roller 32-3. The state in which the leading edge of the paper P is halted temporarily in the stopping position P0 will be referred to hereafter as "occupying the reset position" or "in the reset position".

The first function of the control apparatus 85 (CPU 86) can be described in other words as consisting of determining the paper size (more accurately, the paper size pertaining to paper length) and controlling the motors 33-1 to 33-3 so as to switch the paper conveyance control system of the conveyance rollers 32-1 to 32-3 on the basis of signals from the sensors 50-1 to 50-8 during initialization when conveyance of a single sheet of paper P over the sensors 50-1 to 50-8 is complete.

The control apparatus 85 (CPU 86) comprises a second function, in addition to the first function and exhibited during the first function, as a control device for performing control to alter the paper conveyance speed based additionally on a signal relating to a measured time obtained by measuring the time between any of the sensors 50-1 to 50-8 as preset by the timer 88.

Since the first through third motors 33-1 to 33-3 made up of shared stepping motors are used in this unpublished embodiment, the paper conveyance speed (peripheral speed or rotation speed) of the first through third conveyance rollers 32-1 to 32-3 can be varied easily and reliably by varying the frequency of pulses (pps: pulse per second) supplied to the first through third motors 33-1 to 33-3 by the control apparatus 85 (CPU 86), or in other words by varying the pulse interval (narrowing the pulse interval produces higher speed, a constant interval produces constant speed, and widening the pulse interval produces lower speed).

Before describing the details of a control operation specific to the bulk feed/conveyance unit 1 in an offline state, the theoretical control content of a paper conveyance operation in the intermediate conveyance portion 4 will be described on the basis of FIG. 14. In the figure, to simplify description, a simple description will first be given of the paper conveyance control system in relation to the positions of the leading edges and trailing edges of a preceding sheet P1 and a following sheet P2 using the first through third sensors 50-1 to 50-3 disposed at predetermined intervals in the paper conveyance direction X. Hereafter, the preceding sheet P1 denotes a sheet of paper placed on the intermediate conveyance path 18 of the intermediate conveyance portion 4 that is taken in by the main body feeding portion 104, and the following sheet P2 denotes a sheet of paper that is fed and conveyed from the bulk feeding table 10 and paper feeding mechanism 3 to the intermediate conveyance path 18 subsequent to the preceding sheet P1. Note that in general, "preceding sheet P1" may be rewritten "Pn," and "following sheet P2" may be rewritten "Pn+1," where "n" is a positive integer.

Figure 14:
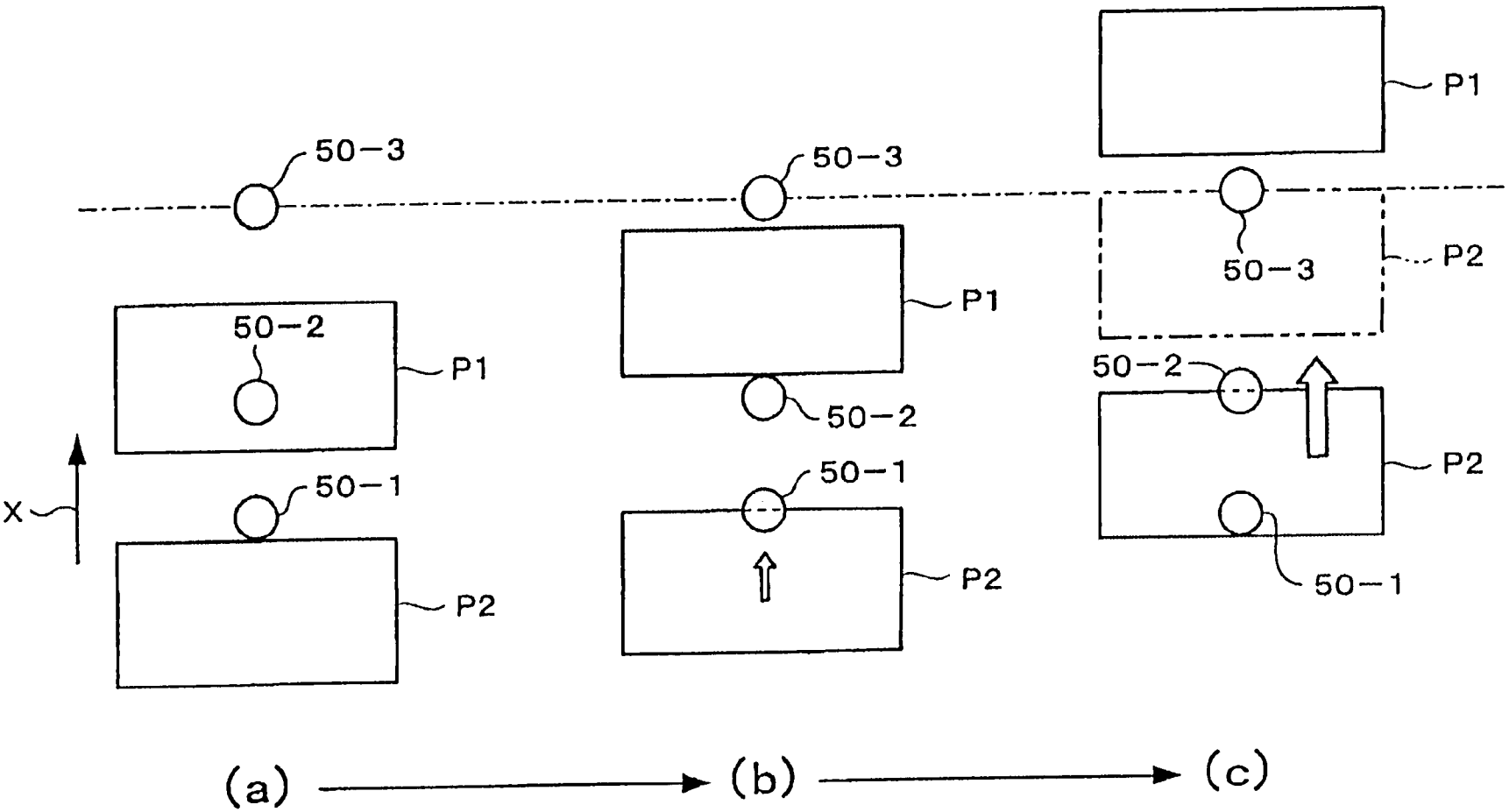
FIG. 14 is a plan view showing the principals of paper conveyance control in the above unpublished embodiment.

First, as shown in "(a)" in FIG. 14, the trailing edge of the preceding sheet P1 has not passed the second sensor 50-2, so the leading edge of the following sheet P2 is stopped in a position short of where it would be detected by the first sensor 50-1 disposed furthest upstream in the paper conveyance direction X. In this case, even after the leading edge of the following sheet P2 is detected by the first sensor 50-1, the following sheet P2 advances by the slowdown distance required due to the inertia of the corresponding conveyance roller (this can be assumed as the inertia of the conveyance roller since the conveyance roller houses the one-way clutch 61 described above) and stops.

As shown in "(b)" in FIG. 14, conveyance of the following sheet P2 begins as soon as the trailing edge of the preceding sheet P1 passes the second sensor 50-2 (blocking/reflecting of the reflection sensor changes to transmitting). The following sheet P2 is conveyed onward until the leading edge of the following sheet P2 is detected by the second sensor 50-2. Whether the following sheet P2 continues to be conveyed downstream in the paper conveyance direction X or is stopped depends on the positional relationship between the trailing edge of the preceding sheet P1 and the third sensor 50-3, and the paper length along the paper conveyance direction X (also referred to hereafter simply as the "paper size").

As shown in "(c)" in FIG. 14, when the trailing edge of the preceding sheet P1 has passed the third sensor 50-3, the following sheet P2 passes the second sensor 50-2 without losing speed (paper conveyance speed), as indicated by the double-dashed line in the figure, such that the leading edge thereof is able to reach the third sensor 50-3. However, if the trailing edge of the preceding sheet P1 has not passed the third sensor 50-3, the following sheet P2 is stopped at the position of the second sensor 50-2 indicated by the solid line in the figure.

Thus in this unpublished embodiment, a special type of control is performed whereby the paper conveyance control system is switched such that sequential conveyance can be performed without allowing the trailing edge of the preceding sheet P1 to come into contact with the leading edge of the following sheet P2, while continually detecting the position of the leading edges and trailing edges of the preceding sheet P1 and following sheet P2 using the sensors 50-1 to 50-8, or in other words, whereby a preset paper conveyance control pattern is selected from the ROM 89, and the paper conveyance speed of the conveyance rollers 32-1 to 32-3 is varied. By means of this unpublished embodiment, the ten types of paper sizes shown in FIGS. 11 and 15 can be detected by a minimum of eight sensors 50-1 to 50-8, and hence the structure for detecting paper size can be made simple and inexpensive.

Accordingly, the present invention is not limited to the eight sensors 50-1 to 50-8 disposed in the intermediate conveyance path 18 such as in this unpublished embodiment, for example, and also allows varying the starting/stopping or paper conveyance speed of the conveyance rollers 32-1 to 32-3, for example, so as to enable sequential conveyance without allowing the trailing edge of the preceding sheet P1 (Pn) to come into contact with the leading edge of the following sheet P2 (Pn+1) even in cases such as those in which the sensors consist of first through Nth sensors 50-1 to 50-N, where N is generally substituted with positive integers and a plurality of sensors are disposed therein (more than eight, for example), and in which the intermediate conveyance path 18 is elongated past the length described above. Needless to say, such control is also made possible in cases in which three or more sheets of paper P are placed on the first through Nth sensors 50-1 to 50-N by increasing the number of conveyance rollers in accordance with the paper size of the conveyed paper.

As described above, the present invention is not limited to this unpublished embodiment, and may be configured such that the intermediate conveyance portion has a plurality of paper conveyance devices, disposed at intervals from the upstream to downstream side of the intermediate conveyance path for conveying paper fed from the feeding mechanism, and first through Nth sensors 50-1 to 50-N serving as paper detecting devices, disposed at intervals from the upstream to downstream side of the intermediate conveyance path for detecting the paper size by detecting at least one of either the leading edge or trailing edge of the conveyed paper.

The paper conveyance operation particularly characteristic of the intermediate conveyance portion 4 of the bulk feed/conveyance unit 1, performed by the control apparatus 85, will now be described with reference to FIGS. 11 and 15 through 18A and 18B. As depicted specifically in FIG. 11, the paper size is detected in this embodiment by the control apparatus 85 based on signals from the sensors 50-1 to 50-8 once a sheet of paper P is stopped after having been conveyed over the sensors 50-1 to 50-8 through an operation shown in FIGS. 32A and 32B carried out during resetting, to be described in detail hereinafter, or in other words, in the stopping position P0 in which the sheet of paper P in FIG. 11, more specifically the leading edge of the preceding sheet P1, is held by the nip between the main body feed roller 111 and the third conveyance roller 32-3.

During resetting, when the paper P is of the longest DLY size and A3Y sizes in the paper conveyance direction X, the paper P is positioned on the sensors (strictly speaking, under the sensors) from the eighth sensor 50-8 to the first sensor 50-1, and hence the eighth sensor 50-8 through first sensor 50-1 are ON, indicating that the paper is of the maximum length. When the paper P is of the shortest B5T size (and the B6Y size, not shown in FIGS. 11 and 15), the paper P is positioned on the sensors from the eighth sensor 50-8 to the fifth sensor 50-5, as shown in FIG. 11, and hence the eighth sensor 50-8 through fifth sensor 50-5 are ON. The fact that the eighth through fifth sensors 50-8 to 50-5 are on should indicate that the paper is of the shortest length, but for the following reason, paper is determined as being of the shortest length according to the ON/OFF state of the sixth sensor 50-6 instead.

The reason is that when an attempt is made to establish a low printing speed in the table in FIG. 15, particularly 16 rpm or 30 rpm (the rotation speed (sometimes the paper conveyance speed corresponding to the peripheral velocity) of the printing drum 115 during plate making or test printing for affixing an engraved thermal stencil master to the outer peripheral surface of the printing drum 115 depicted in FIG. 1 by ink adhesion) while paper conveyance is stopped during resetting of the B5T size, including the aforementioned B6Y size, which is the shortest paper P size in this unpublished embodiment, the paper P is short, and hence a state occurs in which two of the paper conveyance devices 30 (pressure roller 31 and conveyance roller 32) from among the first through third paper conveyance devices 30-1 to 30-3 do not hold/convey the paper. As a result, inertia, particularly of the third conveyance roller 32-3 furthest downstream among the first through third conveyance rollers 32-1 to 32-3, causes the paper to overrun the fifth sensor 50-5 regardless of the braking force applied by the plate spring 62 depicted in FIGS. 9A and 9B. Hence, to allow a margin of error, the paper is detected reliably by the ON/OFF state of the sixth sensor 50-6.

In the table in FIG. 15, "other speeds" are the printing speeds during normal printing, and may be 60 to 120 rpm, for example. The section "initial position of paper trailing edge: between sensors ( . . . 0 to 5)" refers to a sensor number corresponding to the first through eighth sensors 50-1 to 50-8 for detecting the trailing edge of a sheet of paper P during resetting. In this example, the sensor number "0" indicates the position of the separating roller 12. The "second-sheet intake sensor" indicates the sensor number of the sensor which detects the trailing edge position of the preceding sheet when the preceding sheet is taken up and conveyed to the stencil printing apparatus main body 100 side, this sensor switching OFF to allow uptake of the following sheet from the paper feeding mechanism 3 while preventing the leading edge of the following sheet from contacting the trailing edge of the preceding sheet in a reset state. The sensor number of the second-sheet intake sensor is shown in parentheses in the table and corresponds to a number from among the conveyance types 1 through 5 to be described hereafter.

From the above description, the paper conveyance control patterns pertaining to the paper conveyance control system when a sheet of paper P is separated and fed from the bulk feeding unit 5 can be classified into the five conveyance types listed below. In other words, these types refer to control for determining when conveyance of the following sheet P2 is begun when the leading edge of the preceding sheet P1 in the intermediate conveyance portion 4 is carried away upon rotation of the main body feed roller 111 on the stencil printing apparatus main body 100 side. Because the intermediate conveyance path 18 is comparatively short in this unpublished embodiment, only one sheet of paper P is conveyed consecutively, but it goes without saying that conveyance control may be performed for any number of sheets of paper P on the intermediate conveyance path depending on the paper lengths that the length of the intermediate conveyance path of the intermediate conveyance portion can accommodate.

Conveyance type 1: eighth sensor 50-8 through first sensor 50-1 are ON

Conveyance type 2: eighth sensor 50-8 through second sensor 50-2 are ON

Conveyance type 3: eighth sensor 50-8 through third sensor 50-3 are ON

Conveyance type 4: eighth sensor 50-8 through fourth sensor 50-4 are ON

Conveyance type 5: eighth sensor 50-8 through fifth sensor 50-5 (or eighth sensor 50-8 through sixth sensor 50-6) are ON.

Figure 16:
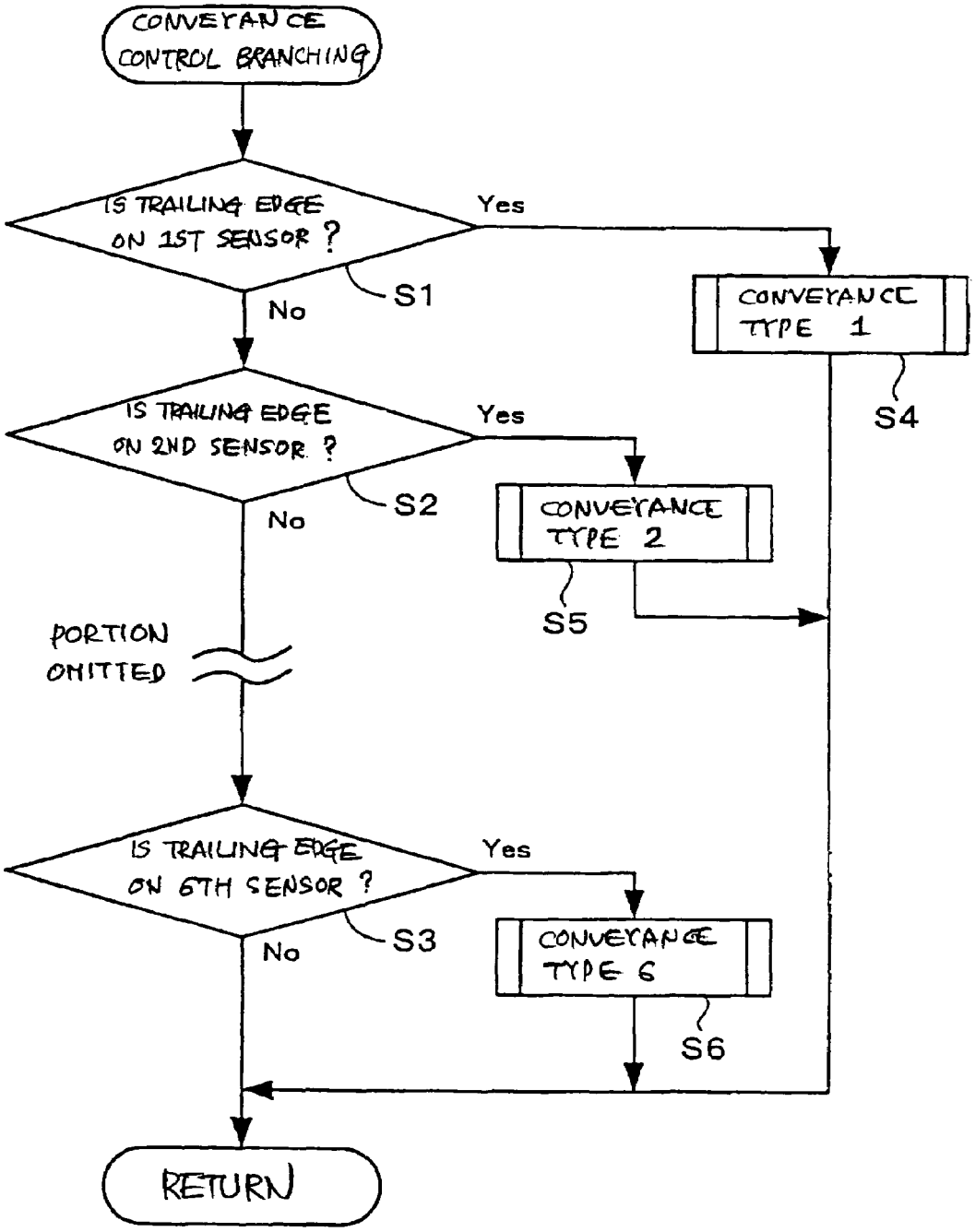
FIG. 16 is a flowchart pertaining to conveyance control branching processing performed upon completion of a reset operation in the above unpublished embodiment.

The flowchart in FIG. 16 shows the content of conveyance control branching processing pertaining to conveyance types 1 through 5, called up from the ROM 89 after completion of a reset operation by the control apparatus 85 (CPU 86). It is first determined in a step S1 in the figure whether or not the trailing edge of a sheet of paper P is positioned on the first sensor 50-1 during resetting. If the trailing edge of the paper P is positioned on the first sensor 50-1 (first sensor 50-1/ON), the process proceeds to a step S4, where a paper conveyance control subroutine program pertaining to the conveyance type 1 is executed. If the trailing edge of the paper P is not positioned on the first sensor 50-1 (first sensor 50-1/OFF), the process proceeds to a step S2, where a determination is made as to whether or not the trailing edge of the paper P is positioned on the second sensor 50-2. If the trailing edge of the paper P is positioned on the second sensor 50-2, the process proceeds to a step S5, where a paper conveyance control subroutine program pertaining to the conveyance type 2 is executed. If the trailing edge of the paper P is not positioned on the second sensor 50-2, a determination is made as to whether or not the trailing edge of the paper P is positioned on the third sensor 50-3. Since the details of the intervening conveyance types 3 through 5 are the same as described above, description thereof has been omitted.

An example of paper conveyance control at other speeds and short sizes (A4Y, B5Y, and letter Y sizes shown in FIG. 15) in accordance with the conveyance type 3 executed under the control of the control apparatus 85 will be described with reference to FIGS. 15 through 18A and 18B. As an intermediate conveyance condition, each motor is set in advance to a standard speed, whereupon the feed motor 22 and first through third motors 33-1 to 33-3 are controlled to produce a constant paper conveyance speed through the feed roller 11, separating roller 12, and first through third conveyance rollers 32-1 to 32-3. The paper conveyance speed at this time is set to substantially correspond to the maximum printing speed 120 rpm of the printing drum 115 (equivalent to a converted paper conveyance speed of 1,130 mm/sec, although in this embodiment, the speed is set to a slightly higher speed of 1,370 mm/sec than the 1,130 mm/sec equivalent). The feed motor 122 on the stencil printing apparatus main body 100 side is controlled by a control apparatus (not pictured) so that the paper conveyance speed produced by the main body feed roller 111 and main separating roller 112 on the stencil printing apparatus main body 100 side is similar to the above (in this embodiment, 1,272 mm/sec).

Naturally, the paper conveyance speed of the main body feed roller 111 on the stencil printing apparatus main body 100 side for taking up a sheet of paper varies according to the manner in which paper conveyance on the stencil printing apparatus main body 100 side is controlled. For example, paper conveyance on the stencil printing apparatus main body 100 side may be subjected to fine control corresponding to each printing speed of the printing drum 115 between 16 and 120 rpm, or paper conveyance on the stencil printing apparatus main body 100 side may be subjected to control corresponding to a predetermined range of the printing speeds of 16 to 120 rpm, for example. Japanese Unexamined Patent Application Publication 2000-141856, proposed by the present applicant, may be cited as an example of similar technology.

Figure 17:
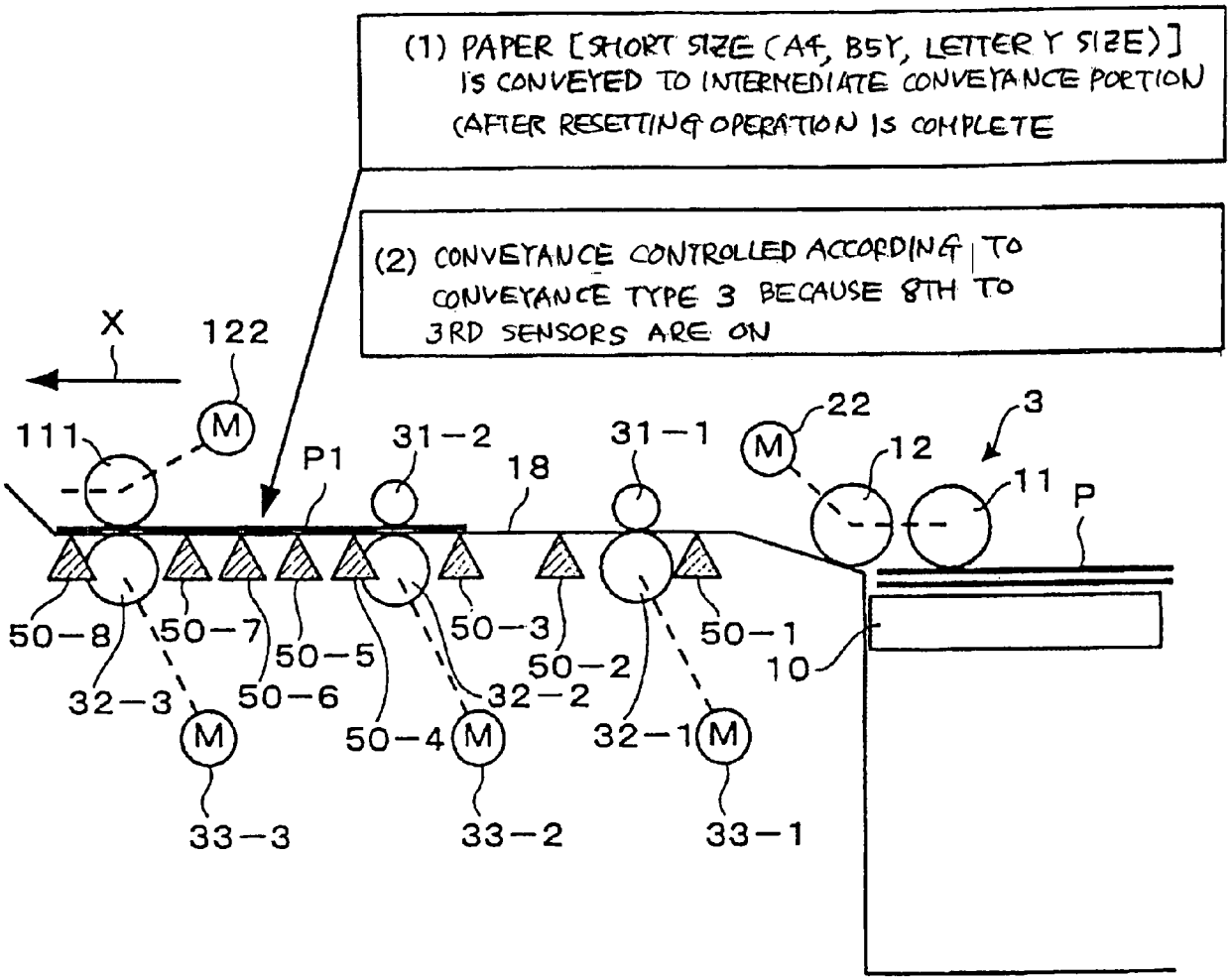
FIG. 17 is a front view showing short paper on an intermediate conveyance path following completion of a reset operation in the above unpublished embodiment.

As depicted in FIG. 15, the initial position of the trailing edge of the paper in the short size conveyance type 3 is between the third sensor 50-3 and the second sensor 50-2, and the second-sheet intake sensor is the third sensor 50-3 (when the third sensor 50-3 switches OFF). FIG. 17 depicts the preceding sheet P1 following completion of a reset operation once the uppermost sheet of paper P on the bulk feeding table 10 has been separated, taken up, and fed/conveyed through the intermediate conveyance path 18. As the reset stopping state of the preceding sheet P1 denotes the conveyance type 3 in which the eighth sensor 50-8 through third sensor 50-3 are ON, conveyance control is performed in accordance with the conveyance type 3.

Figure 18A:
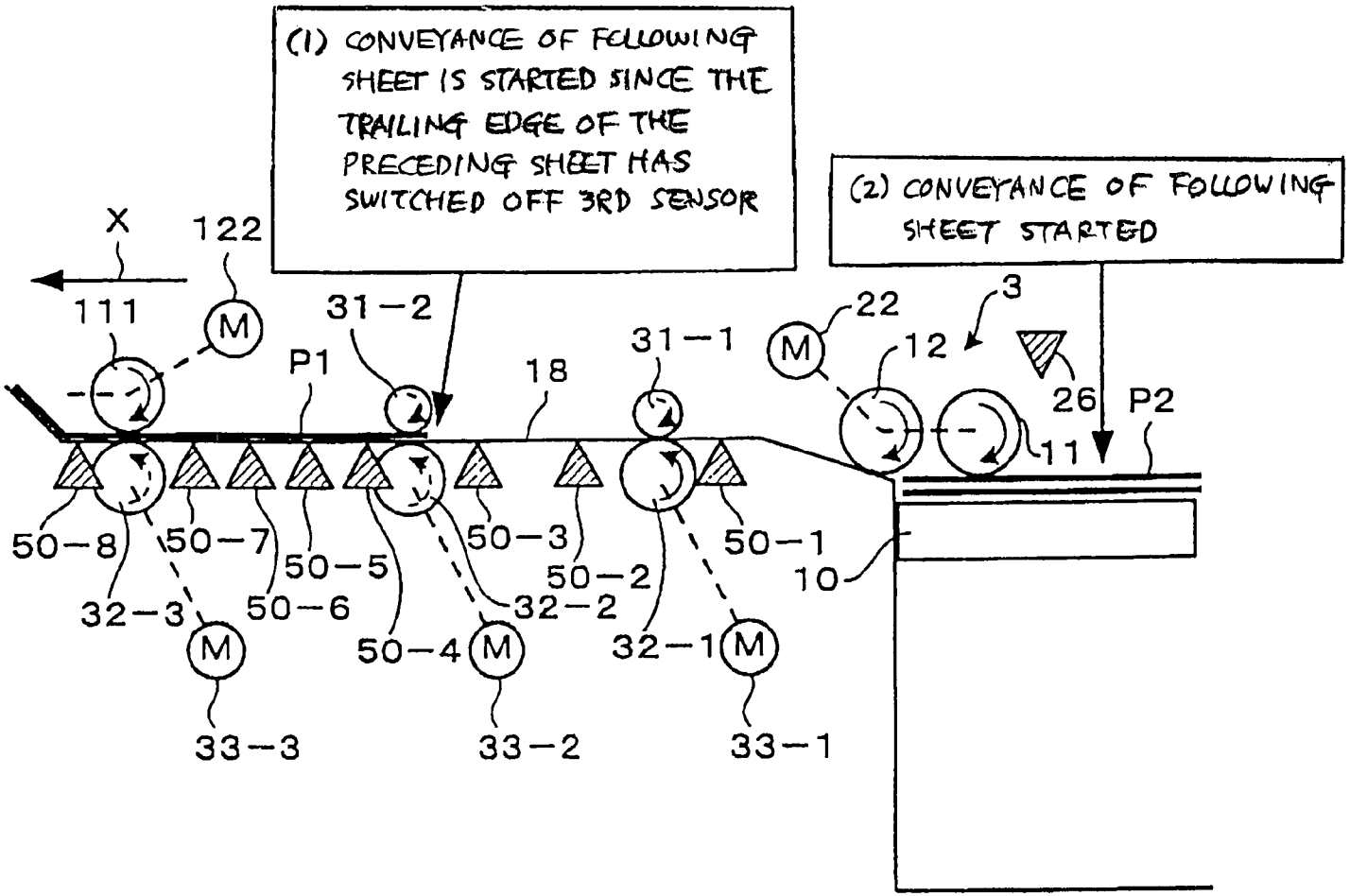
FIGS. 18A and 18B are front views describing the state of paper conveyance transition, and control thereof, between a following sheet and a preceding sheet, continuing from FIG. 17.

Next, the preceding sheet P1 proceeds from a state of occupying the reset position shown in FIG. 17 to the state shown in FIG. 18A. More specifically, the feed motor 122 on the stencil printing apparatus main body 100 side is activated/started up, causing the main body feed roller 111 to begin to rotate clockwise at a fixed rotation speed (the peripheral speed of the main body feed roller 111 corresponding to the maximum printing speed 120 rpm (peripheral speed) of the printing drum 115, as described above). As a result, the preceding sheet P1 held between the main body feed roller 111 and third conveyance roller 32-3 is taken into the main body feeding portion 104 and conveyed. At this time, the third conveyance roller 32-3 receives an appropriate amount of feed pressure from the main body feed roller 111, producing friction between the preceding sheet P1 and the highly frictional surface (rubber surface) on the outer periphery of the third conveyance roller 32-3, and hence the third conveyance roller 32-3 begins to be rotated counterclockwise, as shown by the broken line in FIG. 18A, in alignment with the movement of the preceding sheet P1. The load on the third motor 33-3 at this time is small enough to be almost negligible due to the action of the one-way clutch 61 installed in the shaft portion of the third conveyance roller 32-3.

Rotation of the main body feed roller 111, each conveyance roller 33-1 to 33-3, the separating roller 12, the feed roller 11, and soon is shown in the drawings by a solid line to indicate self-generated rotation, and by a broken line to indicate that the component is being rotated.

Thus the preceding sheet P1 advances to the stencil printing apparatus main body 100 side such that its trailing edge passes the third sensor 50-3. As a result, the third sensor 50-3 through first sensor 50-1 are OFF. At this time, the feed motor 22 and first motor 33-1 are activated (driven to rotate) simultaneously, whereby the feed roller 11 and separating roller 12 begin to rotate clockwise. As a result, a single following sheet P2 is separated and conveyed toward the intermediate conveyance path 18. At this time, the leading edge of the following sheet P2 is detected by the first sensor 50-1. Furthermore, when the first motor 33-1 is activated, the first conveyance roller 32-1 begins to rotate counterclockwise such that the following sheet P2 is conveyed while being held between the rotating first conveyance roller 32-1 and first pressure roller 31-1. Thus the following sheet P2 is conveyed downstream in the paper conveyance direction X.

Figure 18B:
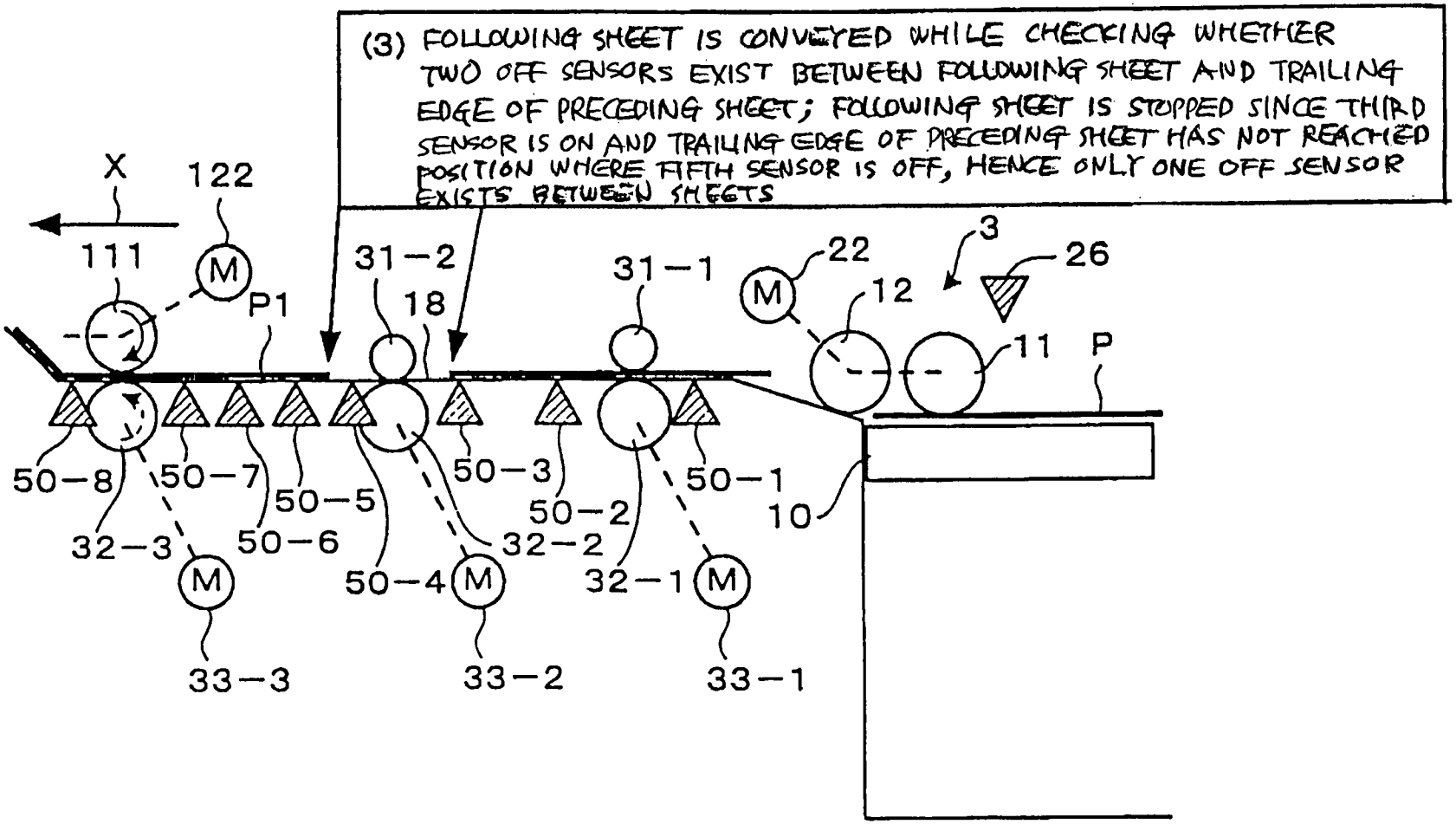

Next, as shown in FIG. 18B, the following sheet P2 is conveyed while checking the trailing edge position of the preceding sheet P1 using the fourth sensor 50-4 and fifth sensor 50-5. In this case, the third sensor 50-3 is ON due to the leading edge of the following sheet P2 reaching the third sensor 50-3, and the fifth sensor 50-5 is ON rather than OFF due to the trailing edge of the preceding sheet P1 remaining on the fifth sensor 50-5. Hence conveyance control is performed to stop the following sheet P2 in the position shown in FIG. 18B until the two sensors between the trailing edge of the preceding sheet P1 and the leading edge of the following sheet P2, i.e. the fourth sensor 50-4 and fifth sensor 50-5, are both switched OFF having been cleared.

Thus, following the beginning of conveyance of a sheet of the paper P from the bulk feeding table 10, (1) the clearance of a number of the directly preceding sensors 50 (which changes according to the paper length) is checked in order to check the trailing edge of the preceding sheet P1. (2) When the trailing edge of the preceding sheet P1 is not on a predetermined sensor 50 number (in other words, the preceding sheet P1 has advanced), the following sheet P2 may proceed to the next sensor 50. When the preceding sheet P1 has not advanced, the following sheet stops until the preceding sheet P1 advances. (3) The process returns to (1) when the leading edge of the following sheet P2 reaches the next sensor 50. Such paper conveyance control is performed repeatedly until a conveyance home position (a position in which the trailing edge of the paper P has passed the eighth sensor 50-8) is attained.

Next, referring to the table in FIG. 15, the paper conveyance transfer states shown in FIGS. 19A, 19B, and 20, the flowcharts shown in FIGS. 21 through 24, and the timing chart shown in FIG. 25, an example of the paper conveyance control that is executed under the control of the control apparatus 85 in the conveyance type 3, when the paper conveyance speed, which is also the printing speed, is 16 or 30 rpm, and short paper (the A4Y, B5Y, and letter Y sizes shown in FIG. 15) is used, will be described in detail.

Figure 24:
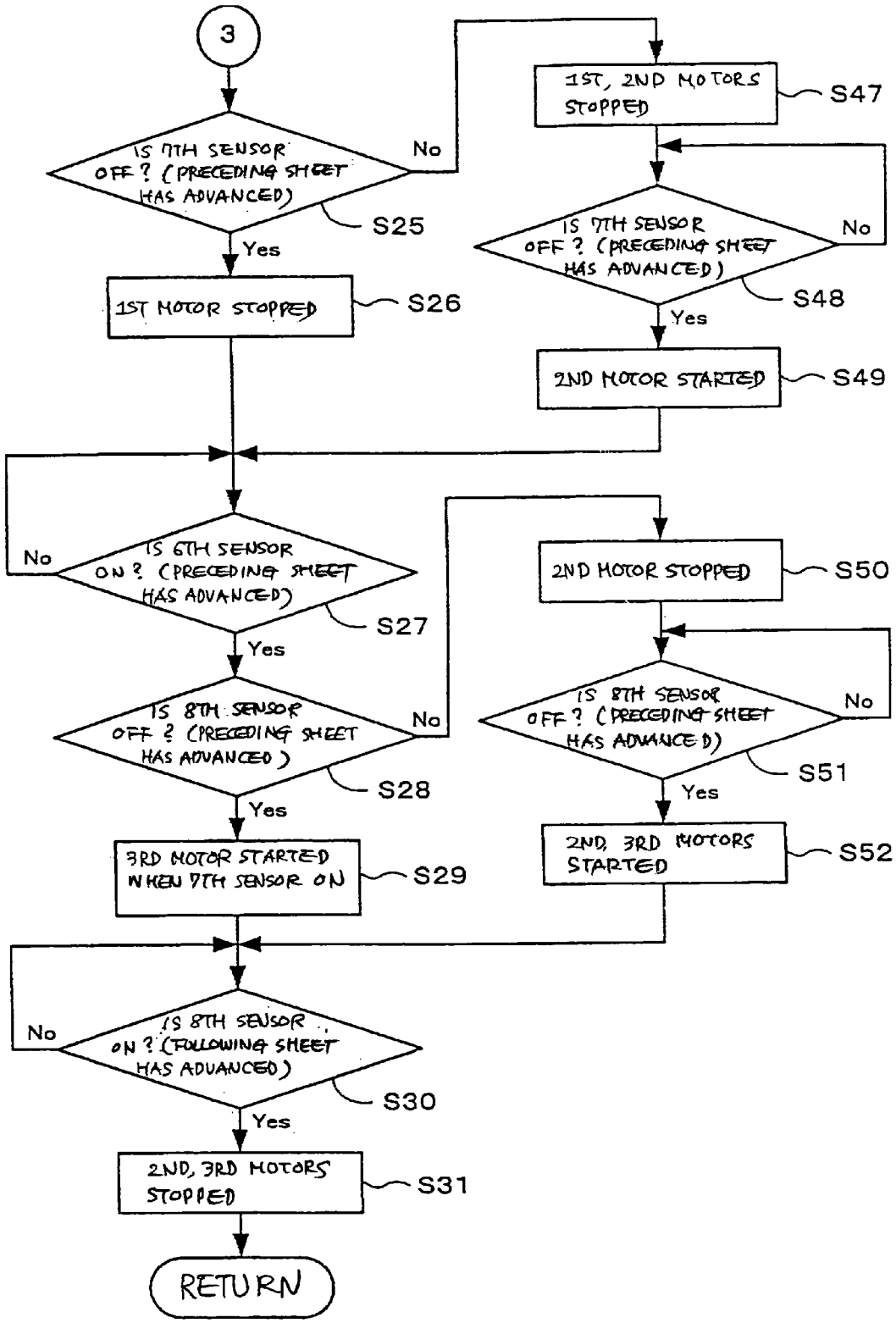
FIG. 24 is a continuation of the flowchart beginning in FIG. 23.
Figure 25:
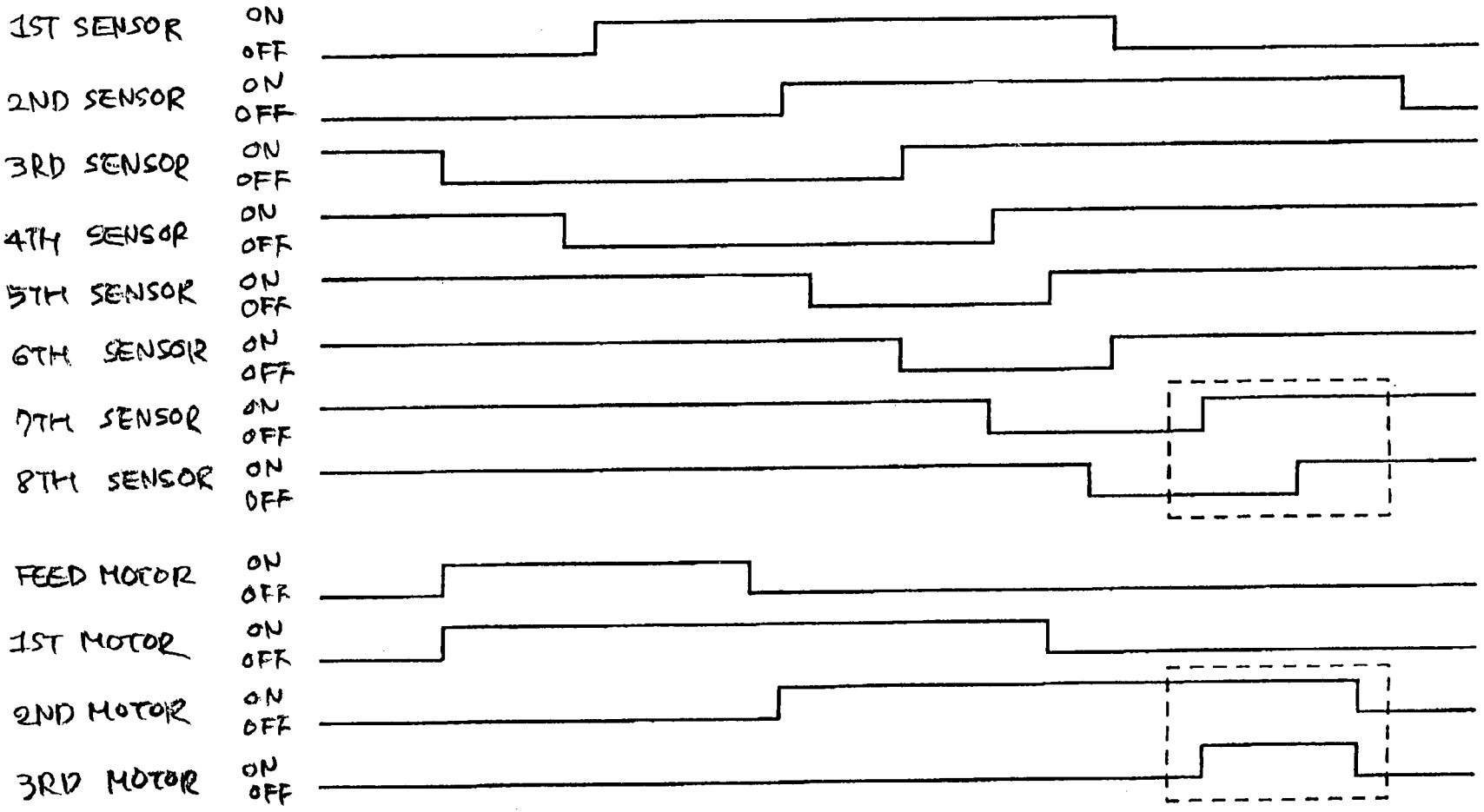
FIG. 25 is a basic timing chart of the paper conveyance control pertaining to the conveyance type 3 of the above unpublished embodiment.

FIG. 25 shows an example of a timing chart pertaining to the ON/OFF state of the first through eighth sensors 50-1 to 50-8, and the ON (activated)/OFF (stopped) state of the feed motor 22 and the first through third motors 33-1 to 33-3 when the leading edge of the following sheet P2 has not caught the leading edge of the preceding sheet P1 during the paper conveyance control operation shown in FIGS. 18A and 18B through 23. The flowcharts in FIGS. 21 through 24 begin from a step S10. In the step S10, each motor is preset to a standard speed, as described above. The stopping state of the preceding sheet P1 upon completion of a reset operation is the same in this example as that shown in FIG. 17 (conveyance type 3, in which the eighth sensor 50-8 through the third sensor 50-3 are ON).

Figure 19A:
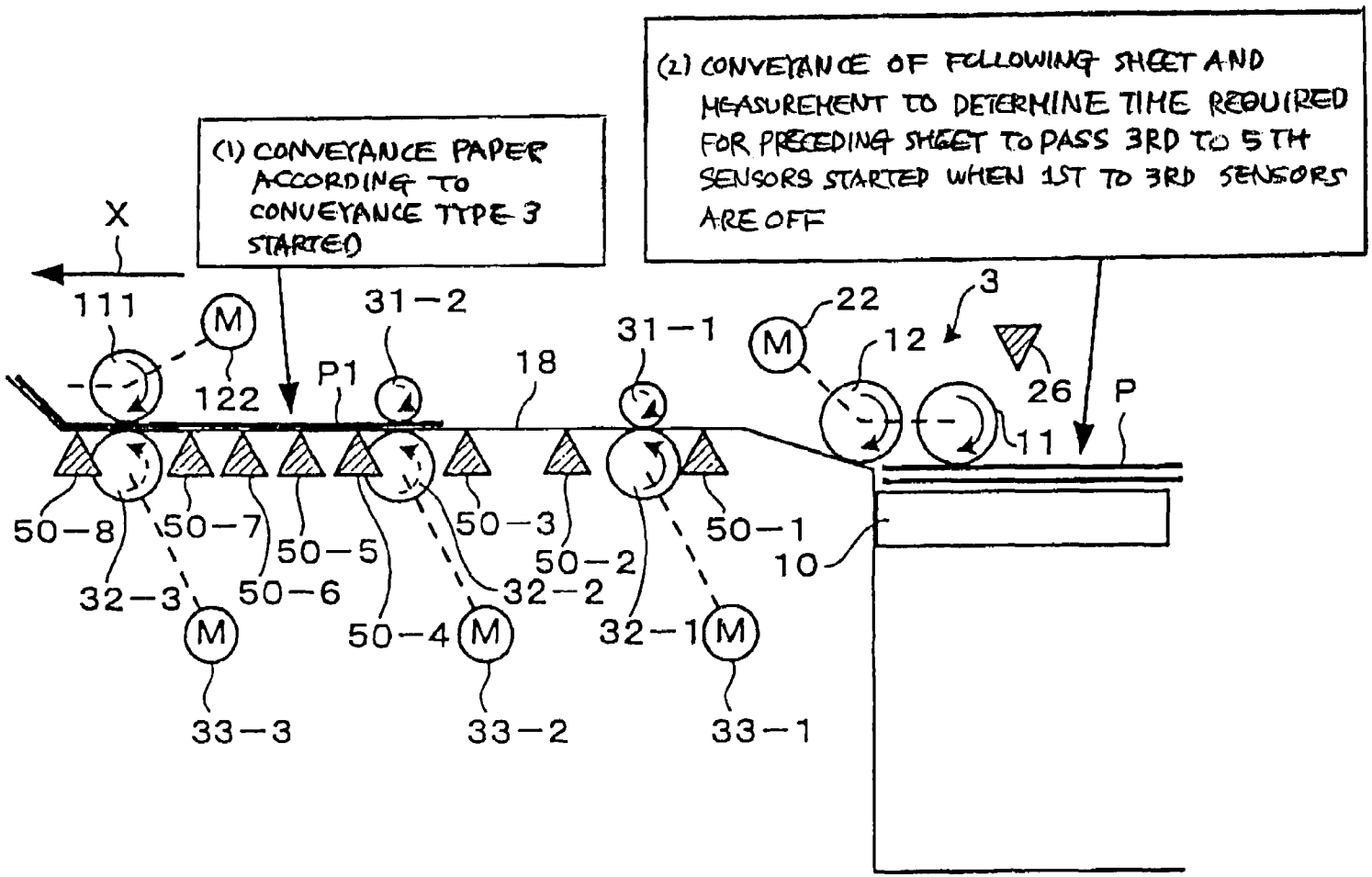
FIGS. 19A and 19B are front views describing the state of paper conveyance transition, and control thereof, between a following sheet and a preceding sheet in another example of the above unpublished embodiment.
Figure 20:
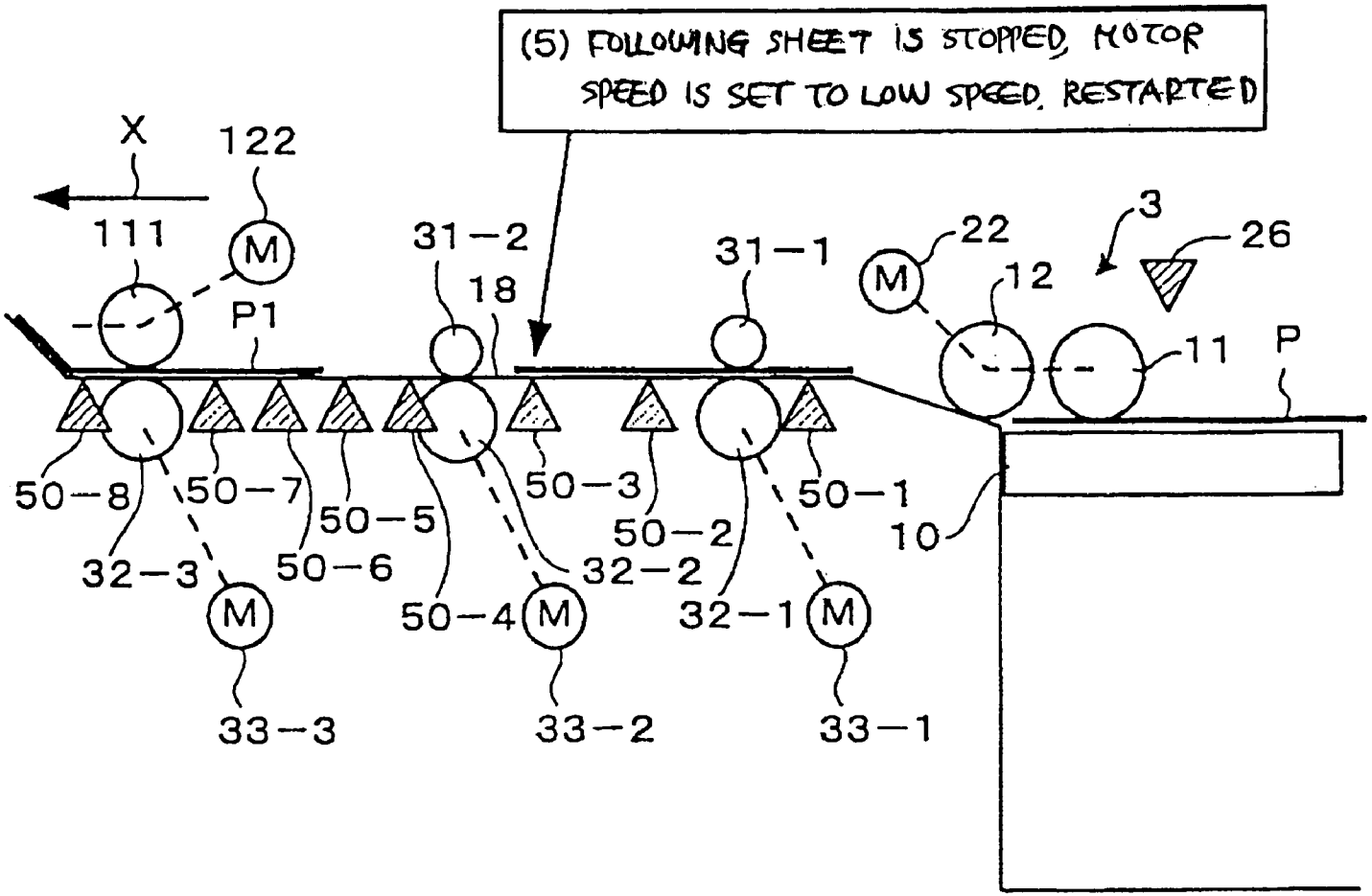
FIG. 20 is a front view in continuation from FIGS. 19A and 19B.
Figure 21:
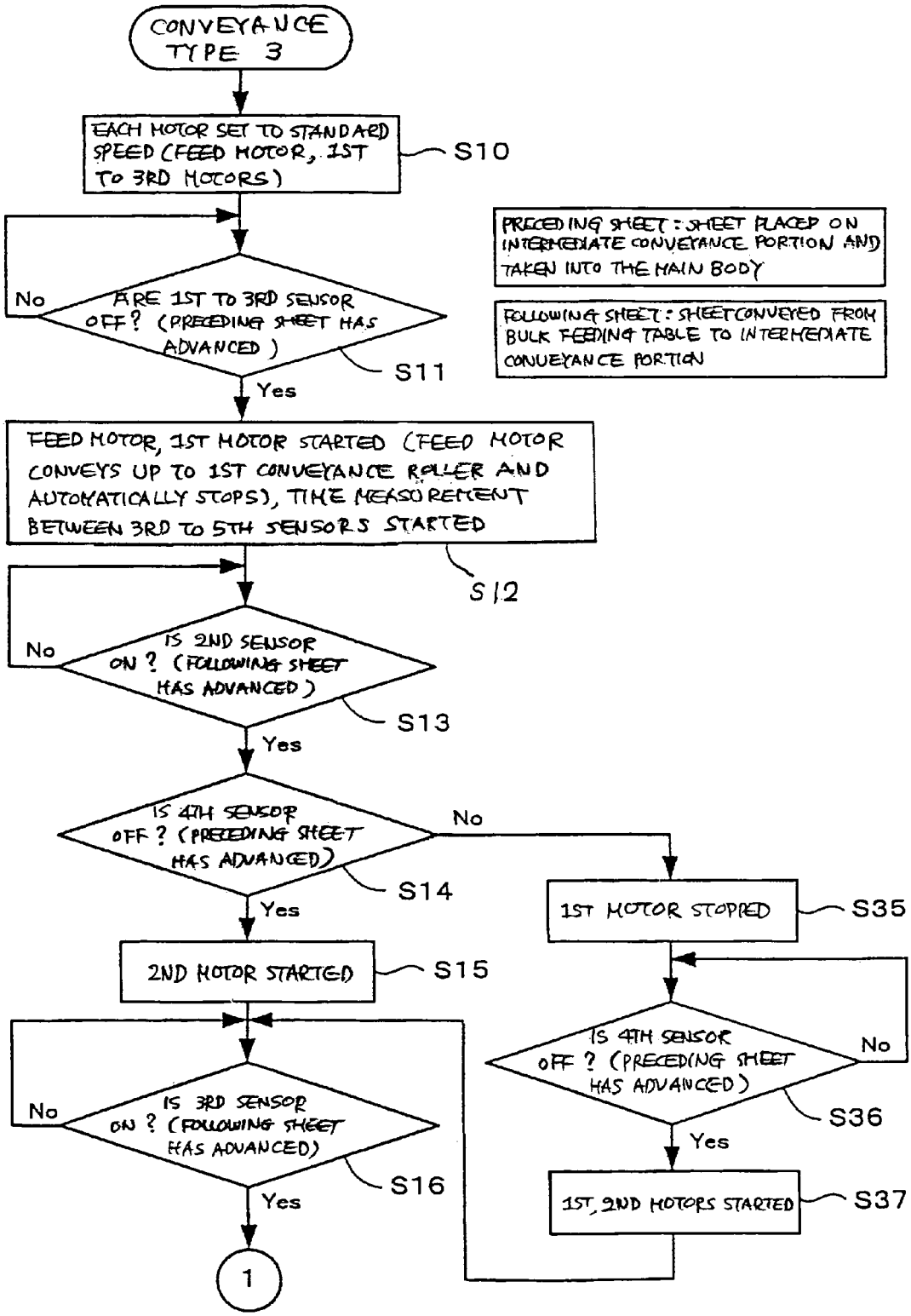
FIG. 21 is a flowchart of paper conveyance control pertaining to a conveyance type 3 of the above unpublished embodiment.
Figure 22:
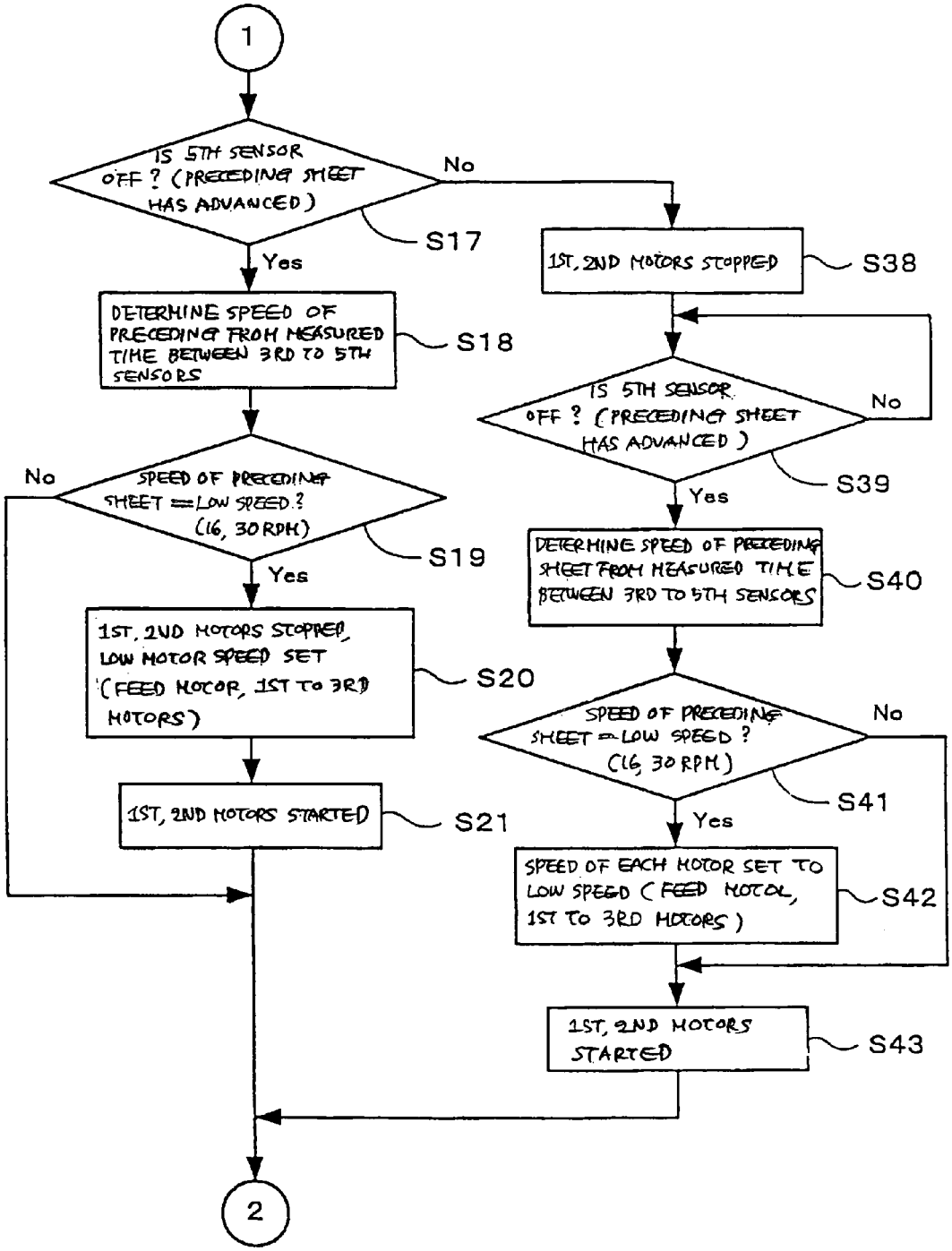
FIG. 22 is a continuation of the flowchart beginning in FIG. 21.

Next, the preceding sheet P1 advances from the reset position shown in FIG. 17 to the stencil printing apparatus main body 100 side by means of the aforementioned operation on the stencil printing apparatus main body 100 side, as shown in FIG. 19A. As a result, the trailing edge of the preceding sheet P1 passes the third sensor 50-3, whereupon a determination is made as to whether or not the third sensor 50-3 through first sensor 50-1 are OFF (step S1). In other words, the second sheet intake sensor is checked as shown in FIG. 15. Since the third sensor 50-3, which is the second sheet intake sensor, is OFF, the feed motor 22 and first motor 33-1 are activated (driven to rotate) simultaneously, whereby the feed roller 11 and separating roller 12 begin to rotate clockwise such that a single following sheet P2 is separated and conveyed toward the intermediate conveyance path 18. At this time, the leading edge of the following sheet P2 is detected by the first sensor 50-1. Furthermore, when the first motor 33-1 is activated, the first conveyance roller 32-1 begins to rotate counterclockwise such that the following sheet P2 is conveyed while being held between the rotating first conveyance roller 32-1 and first pressure roller 31-1. Thus the following sheet P2 is conveyed downstream in the paper conveyance direction X. The feed motor 22 is driven until the leading edge of the following sheet P2 is conveyed to the first conveyance roller 32-1 via the feed roller 11 and separating roller 12, and then stops automatically (step S12).

Note that when the third sensor 50-3 remains OFF in the step S11, the same determination processing operation is repeated. Also, in the step S12, time measurement by the timer 88 of the control apparatus 85 is initiated, and the elapsed time is measured as the trailing edge of the preceding sheet P1 moves/passes from the third sensor 50-3 to the fifth sensor 50-5 (see FIG. 15).

Next, in a step S13, a determination is made as to whether or not the second sensor 50-2 has been turned ON as a result of the following sheet P2 being conveyed such that the leading edge thereof reaches the position of the second sensor 50-2. When the leading edge of the following sheet P2 has not reached the second sensor 50-2 such that the second sensor 50-2 is OFF, the same determination processing operation is repeated (subsequent description thereof is omitted because this process flow is made clear by the flowchart). If the second sensor 50-2 is ON, the process proceeds to a step S14.

In the step S14, a determination is made as to whether or not the fourth sensor 50-4 has been switched OFF due to conveyance of the preceding sheet P1. When the fourth sensor 50-4 is OFF, the process proceeds to a step S15, where the second motor 33-2 is activated. If, on the other hand, the fourth sensor 50-4 remains ON in the step S14, or in other words if the trailing edge of the preceding sheet P1 is positioned on the fourth sensor 50-4 such that the fourth sensor 50-4 remains ON, the rotation of the first motor 33-1 is stopped temporarily to prevent the leading edge of the following sheet P2 from advancing to the third sensor 50-3 (step S35). At this time, the third sensor 50-3 is OFF and the trailing edge of the preceding sheet P1 has passed the third sensor 50-3, whereas the fourth sensor 50-4 remains ON since the trailing edge of the preceding sheet P1 is positioned on the fourth sensor 50-4, and hence the leading edge of the following sheet P2 cannot be conveyed to the third sensor 50-3. In other words, conveyance control is executed to stop the following sheet P2 on the intermediate conveyance path 18 between the second sensor 50-2 and third sensor 50-3 until two sensors between the conveyed sheets (the trailing edge of the preceding sheet P1 and the leading edge of the following sheet P2), i.e. the third sensor 50-3 and fourth sensor 50-4, are switched OFF having been cleared.

Next, a determination is made as to whether or not the fourth sensor 50-4 has been switched OFF by the advance of the preceding sheet P1 (step S36). If the fourth sensor 50-4 is OFF, the process advances to a step S37, where both the first and second motors 33-1, 33-2 are activated. The steps S13 to S15 and S35 to S37 described above serve as a basic pattern for checking the conveyance position of the trailing edge of the preceding sheet P1 and the leading edge of the following sheet P2. In the following operation, this basic pattern is substantially repeated.

Figure 19B:
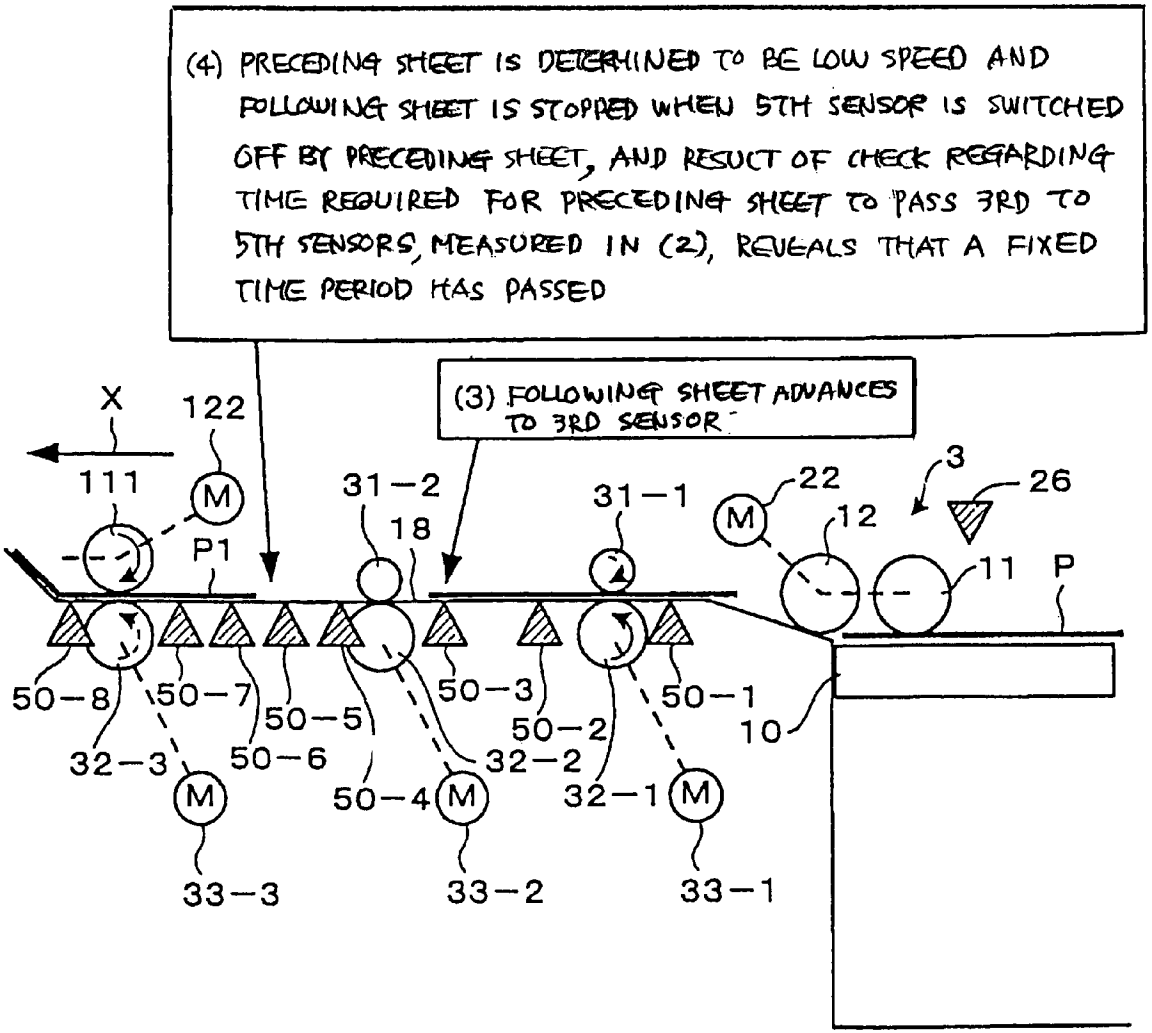

Next, in FIG. 19B and a step S16, a determination is made as to whether or not the third sensor 50-3 has been switched ON by conveyance of the following sheet P2. When the following sheet P2 has been conveyed such that the third sensor 50-3 has turned ON as a result of being reached by the leading edge of the paper, the process proceeds to a step S17 shown in FIG. 22, where a determination is made as to whether or not the fifth sensor 50-5 has been switched OFF by conveyance of the preceding sheet P1. When the preceding sheet P1 has been conveyed such that its trailing edge passes the fifth sensor 50-5 and the fifth sensor 50-5 switches OFF in the step S17, the process advances to a step S18. When the preceding sheet P1 advances such that its trailing edge passes the fifth sensor 50-5 in the step S18, the CPU 86 assumes, on the basis of a signal relating to the time measured by the timer 88 of the control apparatus 85, that if the measured time exceeds a preset fixed time, the speed of the preceding sheet P1 is low, or in other words that the paper conveyance speed of the preceding sheet P1 (sometimes referred to hereafter as "preceding sheet conveyance speed") is low (for example, 15 or 30 rpm, which is below 60 rpm), and temporarily stops both the first and second motors 33-1 and 33-2 so that the following sheet P2 does not advance, in order to prevent the leading edge of the following sheet P2 from overtaking and colliding with the trailing edge of the preceding sheet P1. The rotation speed of the feed motor 22 and the first through third motors 33-1 to 33-3 constituted by stepping motors respectively is also controlled so that the paper conveyance speed of the feed roller 11, separating roller 12, and first through third conveyance rollers 32-1 to 32-3 is lowered (for example, to a speed that corresponds to 15 or 30 rpm, which is below 60 rpm) (steps S18 through S20).

The first and second motors 33-1 and 33-2 are then activated to rotate the first and second conveyance rollers 32-1 and 32-2 at the low paper conveyance speed switched to in the step S20 (step S21). On the other hand, if the preceding sheet P1 has not been conveyed and the fifth sensor 50-5 has not been turned ON by the trailing edge of the paper being positioned on the fifth sensor 50-5 in the step S17, the first and second motors 33-1 and 33-2 are temporarily stopped so that the following sheet P2 does not advance (step S38).

The process then proceeds to a step S39, whereupon the same sequence of control processing operations as in the steps S17 through S19 is performed from this point until a step S41. The process then proceeds to a step S42, where the rotation speed of the feed motor 22 and the first through third motors 33-1 to 33-3 constituted by stepping motors respectively is controlled so that the paper conveyance speed of the feed roller 11, separating roller 12, and first through third conveyance rollers 32-1 to 32-3 is lowered (for example, to a speed that corresponds to 15 or 30 rpm, which is below 60 rpm).

The following sheet P2 is then conveyed as a result of the first and second motors 33-1 and 33-2 being activated to rotate the first and second conveyance rollers 32-1 and 32-2 at the low paper conveyance speed switched to in the step S42 (step S43).

The sequence of control processing operations in the steps S18 through S21 described above represents a case in which the leading edge of the following sheet P2 has not caught up with the trailing edge of the preceding sheet P1, and indicates that the "speed measuring zone" in FIG. 15 changes according to the conveyance type (or conveyance pattern). Further, the sequence of control processing operations in the steps S38 through S43 described above represents a case in which the leading edge of the following sheet P2 has caught up with the trailing edge of the preceding sheet P1, and indicates that the "speed measuring zone" in FIG. 15 changes according to the conveyance type (or conveyance pattern).

Figure 23:
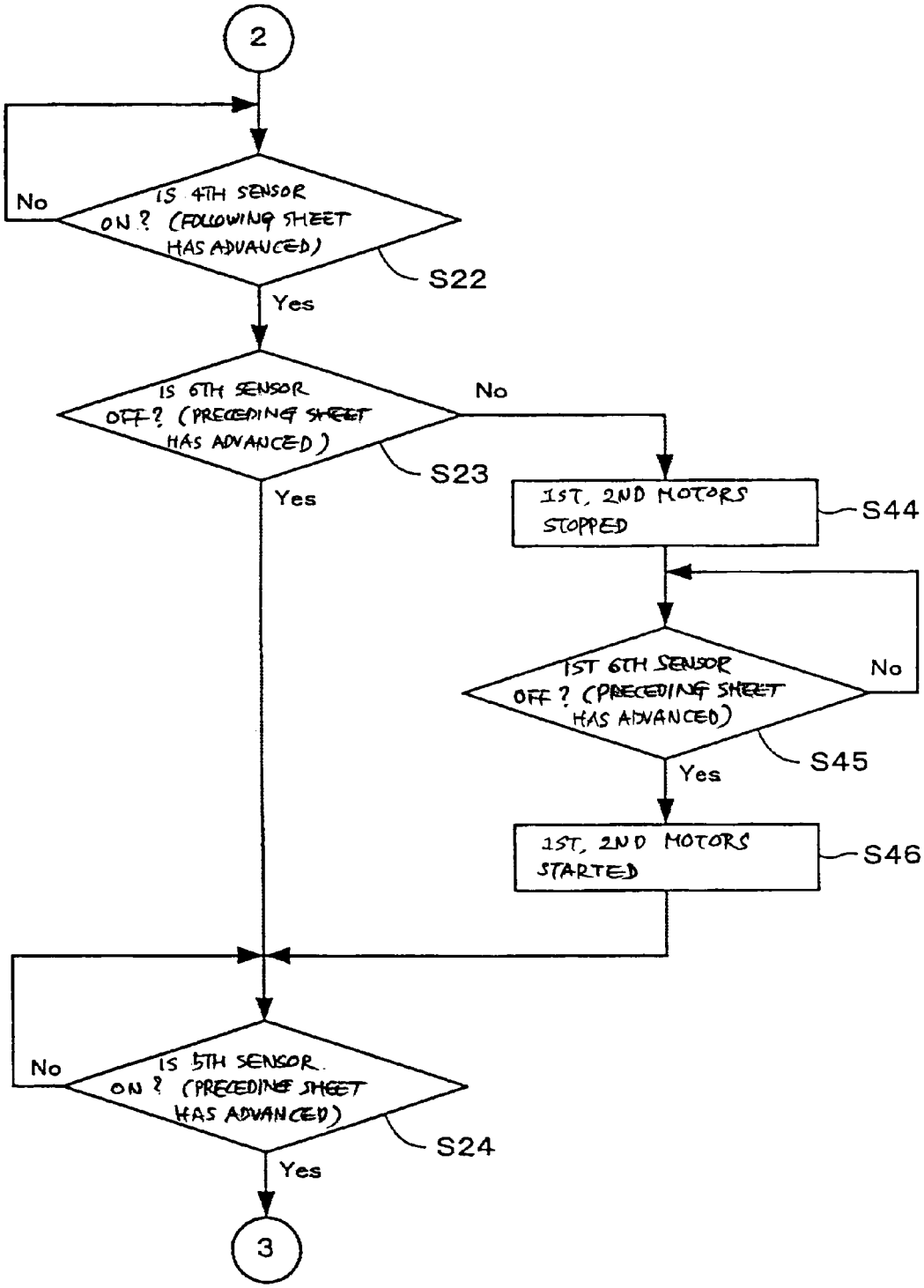
FIG. 23 is a continuation of the flowchart beginning in FIG. 22.

The process then proceeds to a step S22 in FIG. 23, where a determination is made as to whether or not the fourth sensor 50-4 has been switched ON by conveyance of the following sheet P2. When the following sheet P2 has been conveyed and the fourth sensor 50-4 has turned ON through being reached by the leading edge of the paper, the process proceeds to a step S23, where a determination is made as to whether or not the sixth sensor 50-6 has been switched OFF due to the preceding sheet P1 being conveyed such that its trailing edge passes the sixth sensor 50-6. When the preceding sheet P1 has been conveyed such that its trailing edge passes the sixth sensor 50-6, the process proceeds to a step S24, where a determination is made as to whether or not the fifth sensor 50-5 has been switched ON due to the following sheet P2 being conveyed such that its leading edge reaches the fifth sensor 50-5.

On the other hand, when the preceding sheet P1 has not been conveyed and its trailing edge is on the sixth sensor 50-6 in the step S23, or specifically, when the sixth sensor 50-6 remains ON, the first and second motors 33-1 and 33-2 are temporarily stopped so that the following sheet P2 does not advance (step S44). The process then proceeds to a step S45, where the first and second motors 33-1 and 33-2 are activated to rotate the first and second conveyance rollers 32-1 and 32-2 when it is determined that the preceding sheet P1 has been conveyed such that its trailing edge has passed the sixth sensor 50-6 (step S46).

The process then proceeds to a step S25 in FIG. 24, where a determination is made as to whether or not the seventh sensor 50-7 has been switched OFF due to the preceding sheet P1 being conveyed such that its trailing edge passes the seventh sensor 50-7. When the preceding sheet P1 has been conveyed such that its trailing edge passes the seventh sensor 50-7, the process proceeds to a step S26, where the first motor 33-1 is temporarily stopped. The first motor 33-1 is stopped because the leading edge of the following sheet P2 has already reached the second conveyance roller 32-2 and is passing over the roller 32-2.

On the other hand, when the preceding sheet P1 has not been conveyed and its trailing edge is on the seventh sensor 50-7 in the step S25, or specifically, when the seventh sensor 50-7 remains ON, the first and second motors 33-1 and 33-2 are temporarily stopped so that the following sheet P2 does not advance (step S47). The process then proceeds to a step S48, where the second motor 33-2 is activated to rotate only the second conveyance roller 32-2 when it is determined that the preceding sheet P1 has been conveyed such that its trailing edge has passed the seventh sensor 50-7 (step S49).

The process then proceeds to a step S27, where a determination is made as to whether or not the sixth sensor 50-6 has been switched ON by conveyance of the following sheet P2. When the following sheet P2 has been conveyed and the sixth sensor 50-6 has been switched ON by being reached by the leading edge of the paper, the process proceeds to step S28, where a determination is made as to whether or not the eighth sensor 50-8 has been switched OFF due to the preceding sheet P1 being conveyed such that its trailing edge passes the eighth sensor 50-8. When the preceding sheet P1 has been conveyed and its trailing edge has passed the eighth sensor 50-8, the process proceeds to a step S29, where the third motor 33-3 is activated to rotate the third conveyance roller 32-3 when the seventh sensor 50-7 is ON (step S29).

On the other hand, when the preceding sheet P1 has not been conveyed and its trailing edge is on the eighth sensor 50-8 in the step S28, or specifically, when the eighth sensor 50-8 remains ON, the second motor 33-2 is temporarily stopped so that the following sheet P2 does not advance (step S50). The process then proceeds to a step S51, where the second and third motors 33-2 and 33-3 are activated to rotate the second and third conveyance rollers 32-2 and 32-3 when it is determined that the preceding sheet P1 has been conveyed such that its trailing edge has passed the eighth sensor 50-8 (step S52).

The process then proceeds to a step S30, where a determination is made as to whether or not the eighth sensor 50-8 has been switched ON by conveyance of the following sheet P2. When the following sheet P2 has been conveyed and the eighth sensor 50-8 has been switched ON by being reached by the leading edge of the paper, the process proceeds to a step S31, where the second and third motors 33-2, 33-3 are stopped together.

When the preceding sheet P1 is conveyed into the printing portion 102 of the stencil printing apparatus main body 100 and exits the intermediate conveyance portion 4 completely, the following sheet P2, instead of the preceding sheet P1, is then stopped in the reset position as shown in FIG. 17 until being conveyed to the printing portion 102 of the stencil printing apparatus main body 100 by rotation of the main body feed roller 111.

The sequence of control processing operations in the steps S11 through S31 described above represents a case in which the leading edge of the following sheet P2 has not caught up with the trailing edge of the preceding sheet P1. Further, the sequence of control processing operations in the steps S35 through S37, S38 through S43, S44 through S46, S47 through S49, and S50 through S52 described above represents a case in which the leading edge of the following sheet P2 has caught up with the trailing edge of the preceding sheet P1.

Figure 26:
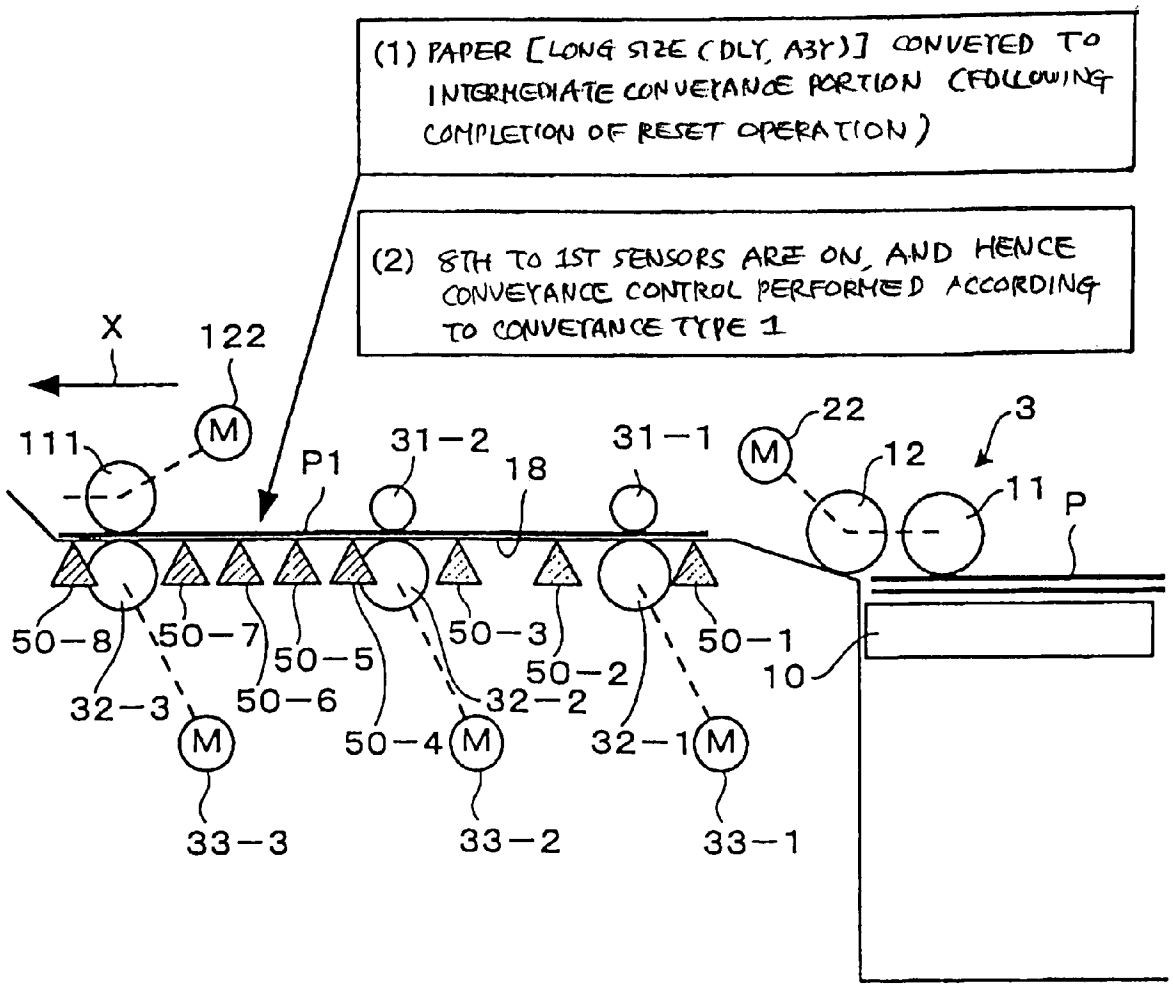
FIG. 26 is a front view showing a long sheet of paper on the intermediate conveyance path following completion of the reset operation in the above unpublished embodiment.
Figure 27A:
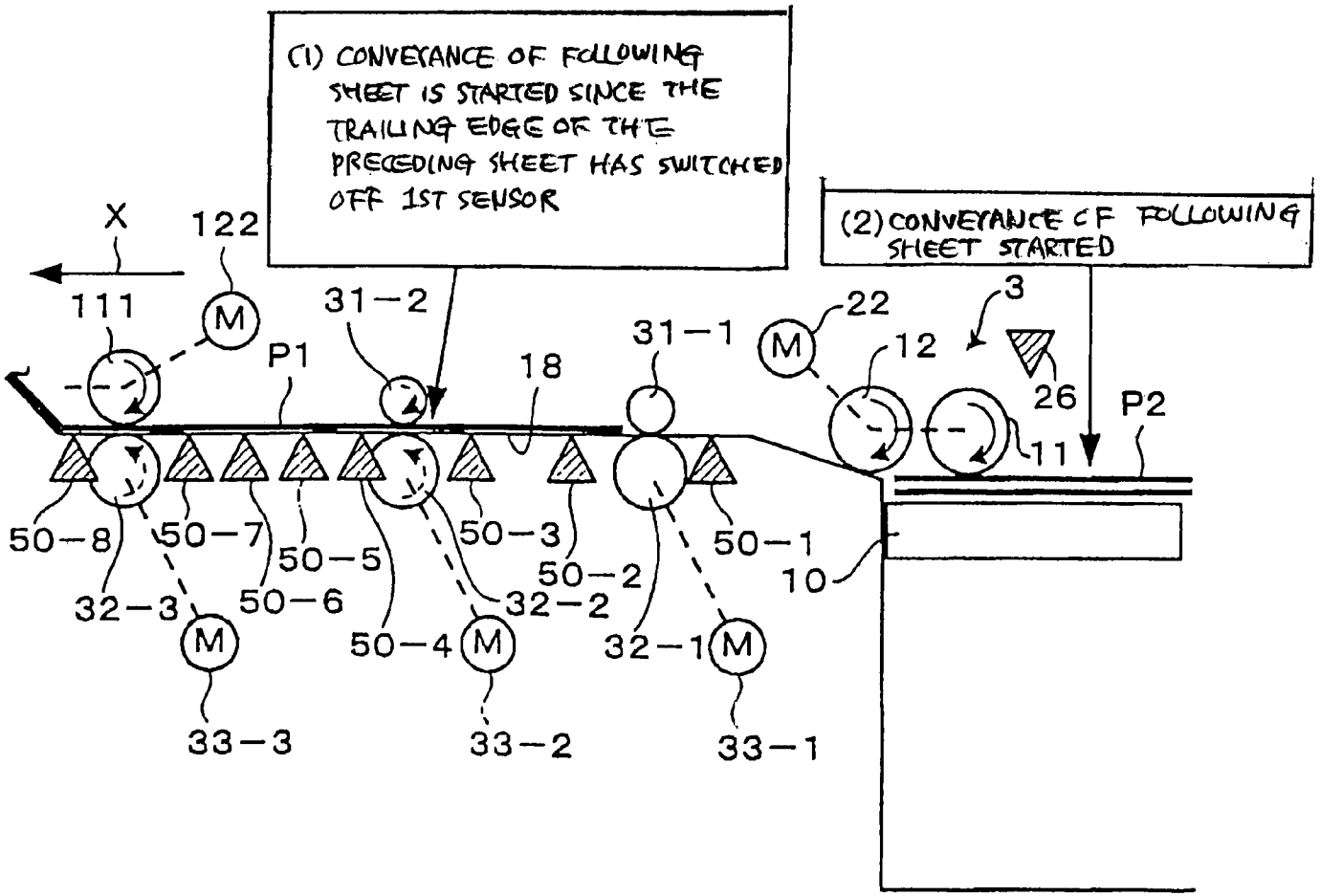
FIGS. 27A and 27B are front views describing the state of paper conveyance transition, and control thereof, between a following sheet and a preceding sheet, continuing from FIG. 26.
Figure 27B:
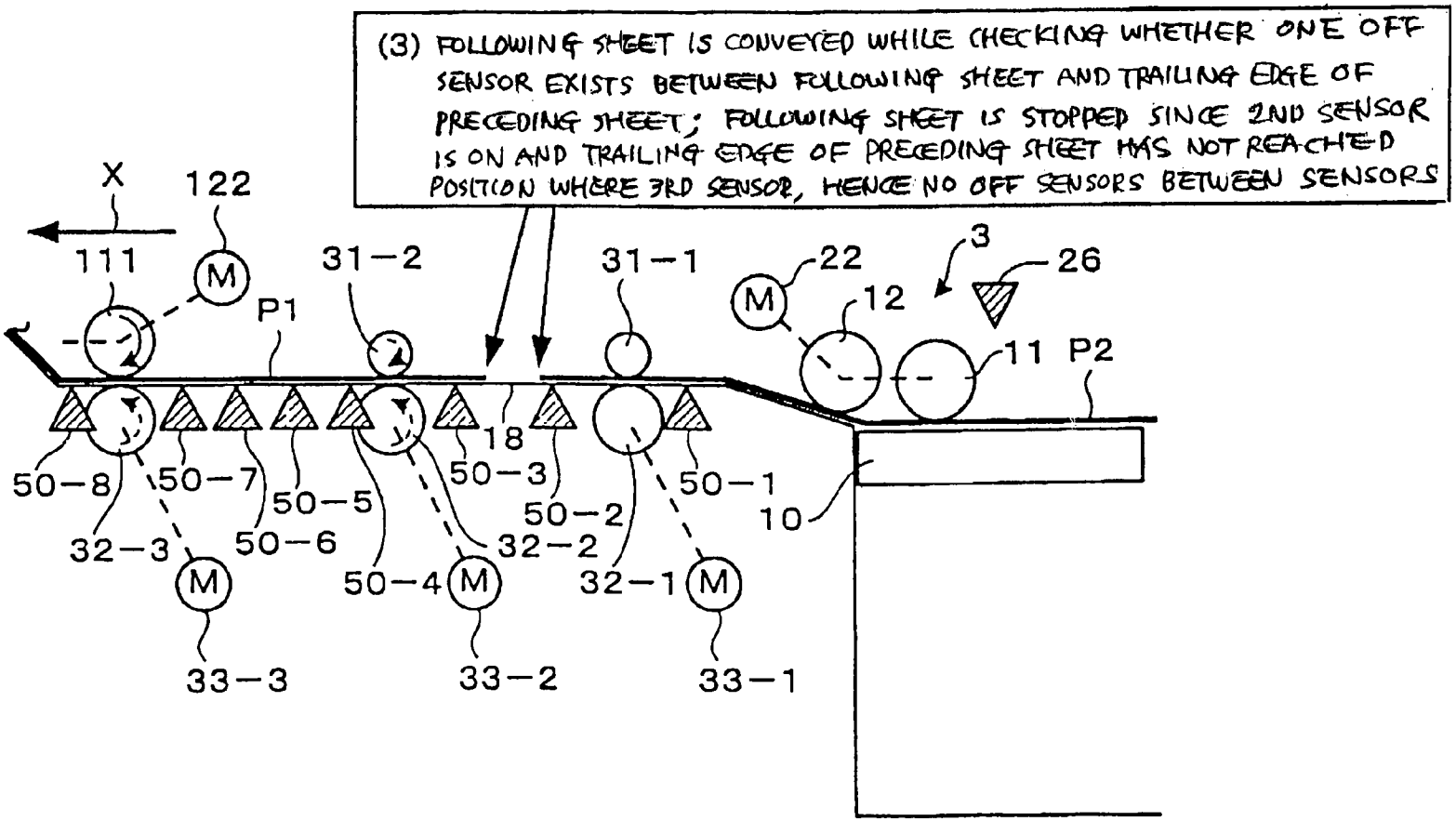
Figure 28:
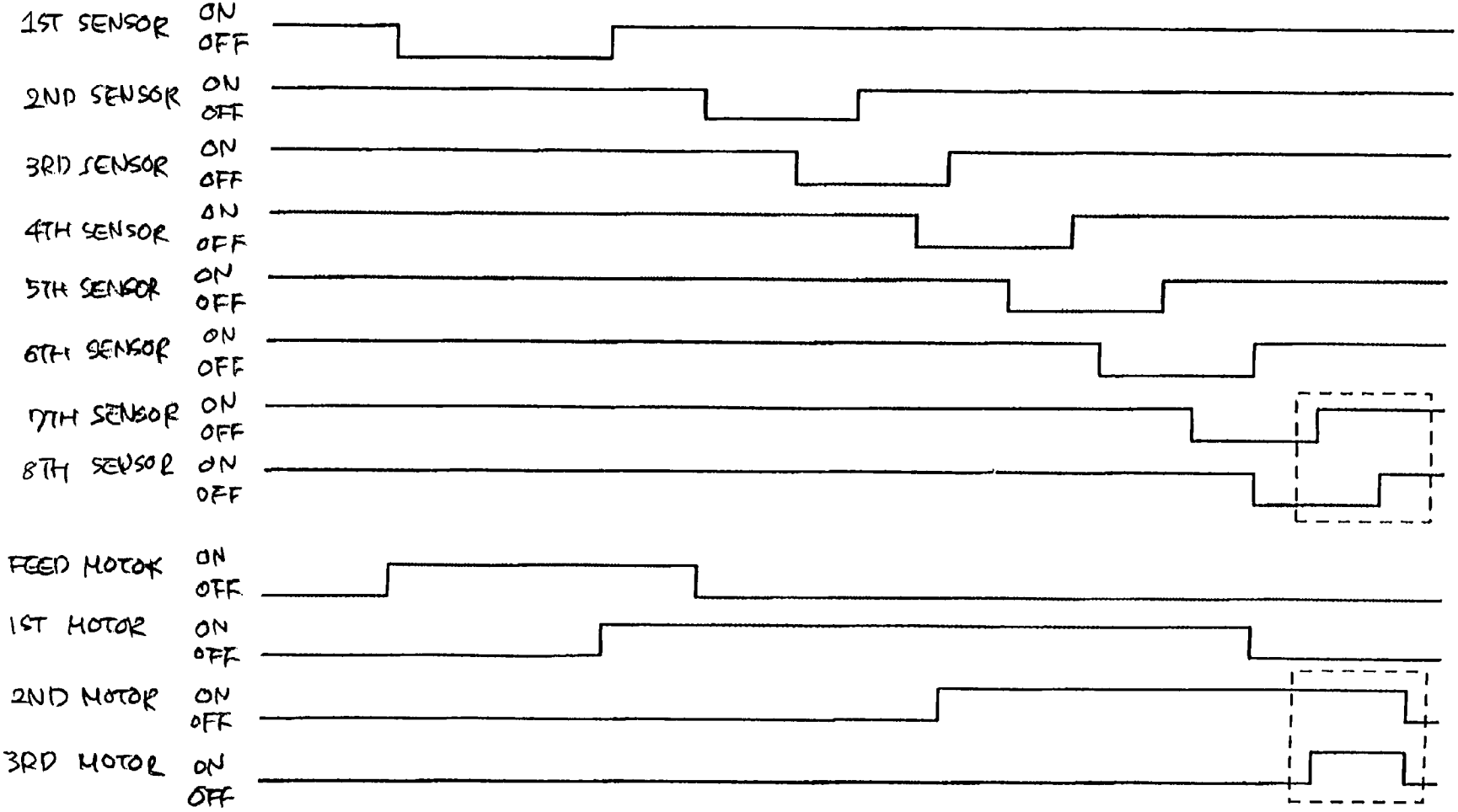
FIG. 28 is a basic timing chart of the paper conveyance control pertaining to a conveyance type 1 of the above unpublished embodiment.

Next, referring to the table in FIG. 15, the paper conveyance transfer state in FIGS. 26, 27A, and 27B, and the timing chart in FIG. 28, a simple description of an example of paper conveyance control executed under the control of the control apparatus 85 will be provided for a case in which the paper conveyance speed corresponds to the maximum printing speed in the conveyance type 1, for example, where control to switch the paper conveyance speed is not necessary, and long sized paper (DLY, A3Y shown in FIG. 15) is used. In so doing, the description can be simplified.

FIG. 28 shows an example of a timing chart pertaining to the ON/OFF state of the first through eighth sensors 50-1 to 50-8, and the ON (activated)/OFF (stopped) state of the feed motor 22 and the first through third motors 33-1 to 33-3 for a case in which the leading edge of the following sheet P2 has not caught up with the trailing edge of the preceding sheet P1 in the paper conveyance control operation to be described below.

Similarly to the conveyance type 3, during paper conveyance control in the conveyance type 1, each motor is set to a preset standard speed, and the feed motor 22 and motors 33-1 to 33-3 are controlled respectively by commands from the control apparatus 85. As a result of control of the feed motor 22, the feed roller 11 and separating roller 12 pick up, separate, and convey the uppermost sheet of paper on the bulk feeding table 10, and as a result of control of the motors 33-1 to 33-3, the conveyance rollers 32-1 to 32-3 convey the paper P fed from the paper feeding mechanism 3. These operations are performed at a paper conveyance speed corresponding to the maximum printing speed on the stencil printing apparatus main body 100 side (in this unpublished embodiment, 120 sheets/min: 120 rpm), regardless of the printing speed on the stencil printing apparatus main body 100 side.

As shown in FIG. 15, the initial paper trailing edge position in the conveyance type 1 using long paper is between the separating roller 12 and first sensor 50-1, and the second sheet intake sensor is the first sensor 50-1 (when the first sensor 50-1 switches OFF). FIG. 26 shows the preceding sheet P1 following completion of a reset operation, in which the uppermost sheet of paper P on the bulk feeding table 10 is separated, taken in, and fed/conveyed to the intermediate conveyance path 18. The reset stopping state of the preceding sheet P1 indicates the conveyance type 1, in which the eighth sensor 50-8 through first sensor 50-1 are ON, and hence conveyance control is performed in accordance with the conveyance type 1.

First, the preceding sheet P1 advances to the state shown in FIG. 27A from the reset position shown in FIG. 26. More specifically, the feed motor 122 on the stencil printing apparatus main body 100 side is activated such that the main body feed roller 111 begins to rotate clockwise at a fixed rotation speed (the peripheral speed, or in other words the paper conveyance speed, of the main body feed roller 111, corresponding to the maximum printing speed 120 rpm (peripheral speed) of the printing drum 115, as described above). As a result, the preceding sheet P1 held between the main body feed roller 111 and third conveyance roller 32-3 is taken into the main body feeding portion 104 and conveyed.

Thus the preceding sheet P1 advances to the stencil printing apparatus main body 100 side such that its trailing edge passes the first sensor 50-1, causing the first sensor 50-1 to switch OFF. Since the first sensor 50-1 serving as the second sheet intake sensor has switched OFF, the feed motor 22 is activated, whereby the feed roller 11 and separating roller 12 begin to rotate clockwise. As a result, a single following sheet P2 is separated and conveyed toward the intermediate conveyance path 18. By means of the rotation and conveyance of the feed roller 11 and separating roller 12, the following sheet P2 begins to be conveyed to the downstream side of the intermediate conveyance path 18 such that its leading edge is detected by the first sensor 50-1.

The first motor 33-1 is then activated at a timing shown in FIG. 28, whereby the following sheet P2 is conveyed, while its leading edge is held between the rotating first conveyance roller 32-1 and first pressure roller 31-1, until the second sensor 50-2 switches ON. Note that the feed motor 22 is driven until the leading edge of the following sheet P2 has been conveyed to the first conveyance roller 32-1 via the feed roller 11 and separating roller 12, and then stops automatically.

As the preceding sheet P1 is conveyed further toward the downstream side of the paper conveyance direction X, the second sensor 50-2 switches OFF when the trailing edge of the preceding sheet P1 passes the second sensor 50-2, as shown in FIG. 27B. However, when the trailing edge of the preceding sheet P1 is positioned on the third sensor 50-3 such that the third sensor 50-3 remains ON, or in other words when the leading edge of the following sheet P2 is about to catch up with the trailing edge of the preceding sheet P1, the leading edge of the following sheet P2 cannot be conveyed to the third sensor 50-3. If the leading edge of the following sheet P2 is conveyed to the third sensor 50-3 mistakenly, the trailing edge of the preceding sheet P1 and the leading edge of the following sheet P2 may come into contact such that it becomes impossible to recognize the boundary between the trailing edge of the preceding sheet P1 and the leading edge of the following sheet P2, and hence impossible to distinguish between the sheets P1, P2. Accordingly, control is performed to convey the following sheet P2 leaving a gap of one sensor between the conveyed sheets. More specifically, as shown in the drawing, conveyance is performed while ensuring that a single OFF sensor exists between the leading edge of the following sheet P2 and the trailing edge of the preceding sheet P1. Here, the leading edge of the following sheet P2 is positioned such that the second sensor 50-2 is ON, and the trailing edge of the preceding sheet P1 is positioned such that the third sensor 50-3 is ON, and hence there are no OFF sensors between the conveyed sheets. Therefore, the following sheet P2 is stopped in the position shown in FIG. 27B by switching off the first motor 33-1.

As the preceding sheet P1 is conveyed further toward the downstream side of the paper conveyance direction X thereafter such that its trailing edge passes the third sensor 50-3, causing the third sensor 50-3 to switch OFF, a gap of one OFF sensor appears between the conveyed sheets, and hence at this time, the leading edge of the following sheet P2 is conveyed to the point at which the third sensor 50-3 switches ON by reactivating the first motor 33-1.

At this time, a determination is made as to whether the fourth sensor 50-4 has switched OFF following conveyance of the preceding sheet P1. When the trailing edge of the preceding sheet P1 is on the fourth sensor 50-4 such that the fourth sensor 50-4 remains ON, or in other words when the leading edge of the following sheet P2 is about to catch up with the trailing edge of the preceding sheet P1, the leading edge of the following sheet P2 cannot be conveyed to the fourth sensor 50-4 for reasons similar to those described above. Accordingly, control is performed to convey the following sheet P2 leaving a gap of one sensor between the conveyed sheets. More specifically, conveyance is performed while ensuring that a single OFF sensor exists between the leading edge of the following sheet P2 and the trailing edge of the preceding sheet P1. Here, the leading edge of the following sheet P2 is positioned such that the third sensor 50-3 is ON, and the trailing edge of the preceding sheet P1 is positioned such that the fourth sensor 50-4 is ON, and hence there are no OFF sensors between the conveyed sheets. Therefore, the following sheet P2 is stopped in the position at which the third sensor 50-3 is ON by switching off the first motor 33-1.

When the trailing edge of the preceding sheet P1 passes the fourth sensor 50-4 such that the fourth sensor 50-4 switches OFF, the second motor 33-2 is activated at a predetermined timing, and since one OFF sensor exists between the conveyed sheets, the first motor 33-1 is reactivated at this time. As a result, the following sheet P2, stopped with its leading edge positioned on the third sensor 50-3, is conveyed while being held between the rotating first conveyance roller 32-1 and first pressure roller 31-1, and the leading edge of the following sheet P2 is conveyed while being held between the rotating second conveyance roller 32-2 and second press roller 31-2, to the point at which the fourth sensor 50-4 is switched ON.

By repeating this operation in succession, the preceding sheet P1 is conveyed further toward the downstream side in the paper conveyance direction X until the trailing edge of the preceding sheet P1 passes the eighth sensor 50-8 such that the eighth sensor 50-8 switches OFF. At this time, the second motor 33-2 is reactivated at a predetermined timing, whereupon a determination is made as to whether or not the seventh sensor 50-7 has been switched ON due to the arrival thereon of the leading edge of the following sheet P2, conveyed from a stopping point at which the sixth sensor 50-6 is switched ON. If the seventh sensor 50-7 is determined to have been switched ON, conveyance control is performed until the eighth sensor 50-8 switches ON by activating the third motor 33-3.

When the preceding sheet P1 is conveyed into the printing portion 102 of the stencil printing apparatus main body 100 and exits the intermediate conveyance portion 4 completely, the following sheet P2, instead of the preceding sheet P1, is then stopped in the reset position until being conveyed to the printing portion 102 of the stencil printing apparatus main body 100 by rotation of the main body feed roller 111, similarly to the operation shown in FIG. 26.

Figure 29:
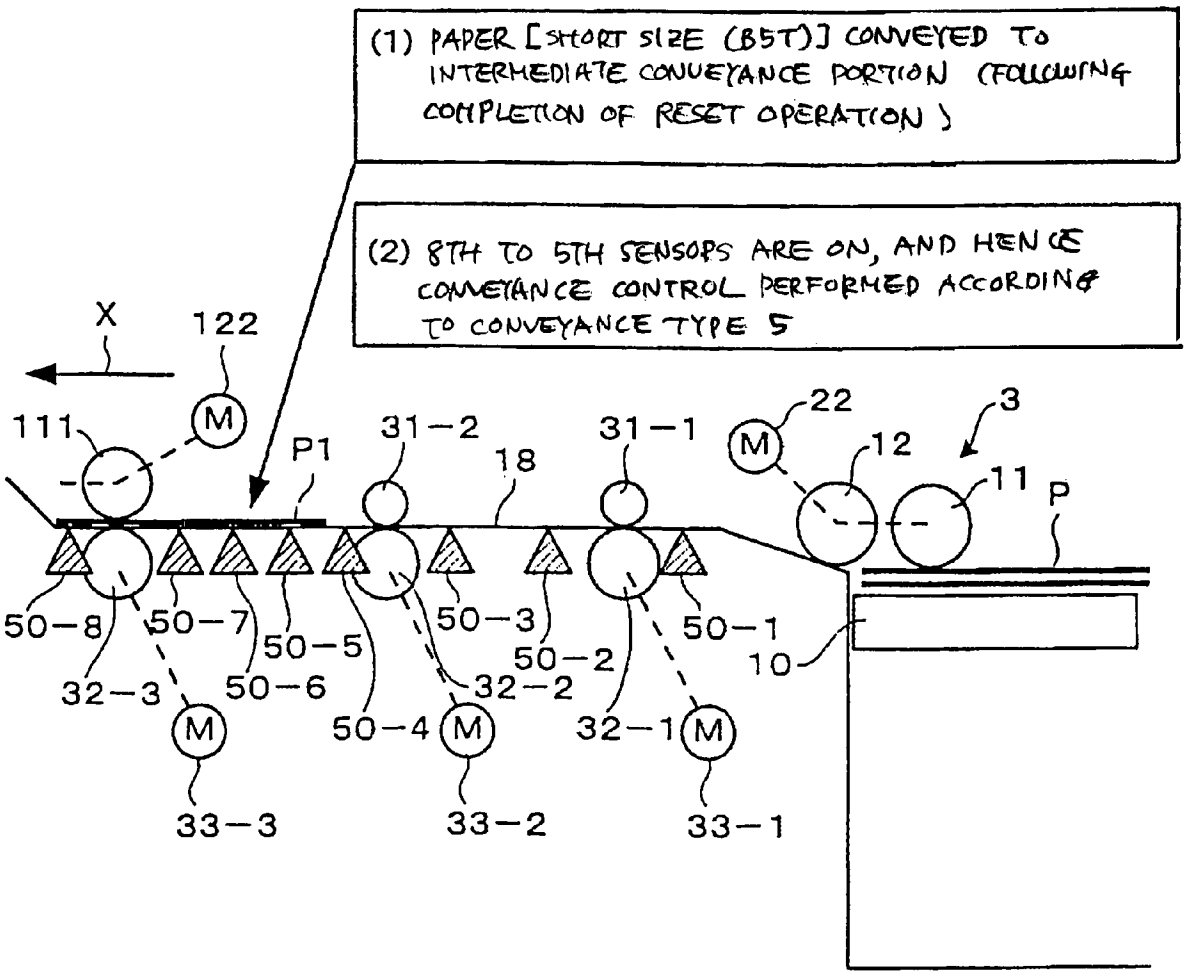
FIG. 29 is a front view showing paper of the shortest size on the intermediate conveyance path following completion of the reset operation in the above unpublished embodiment.
Figure 30A:
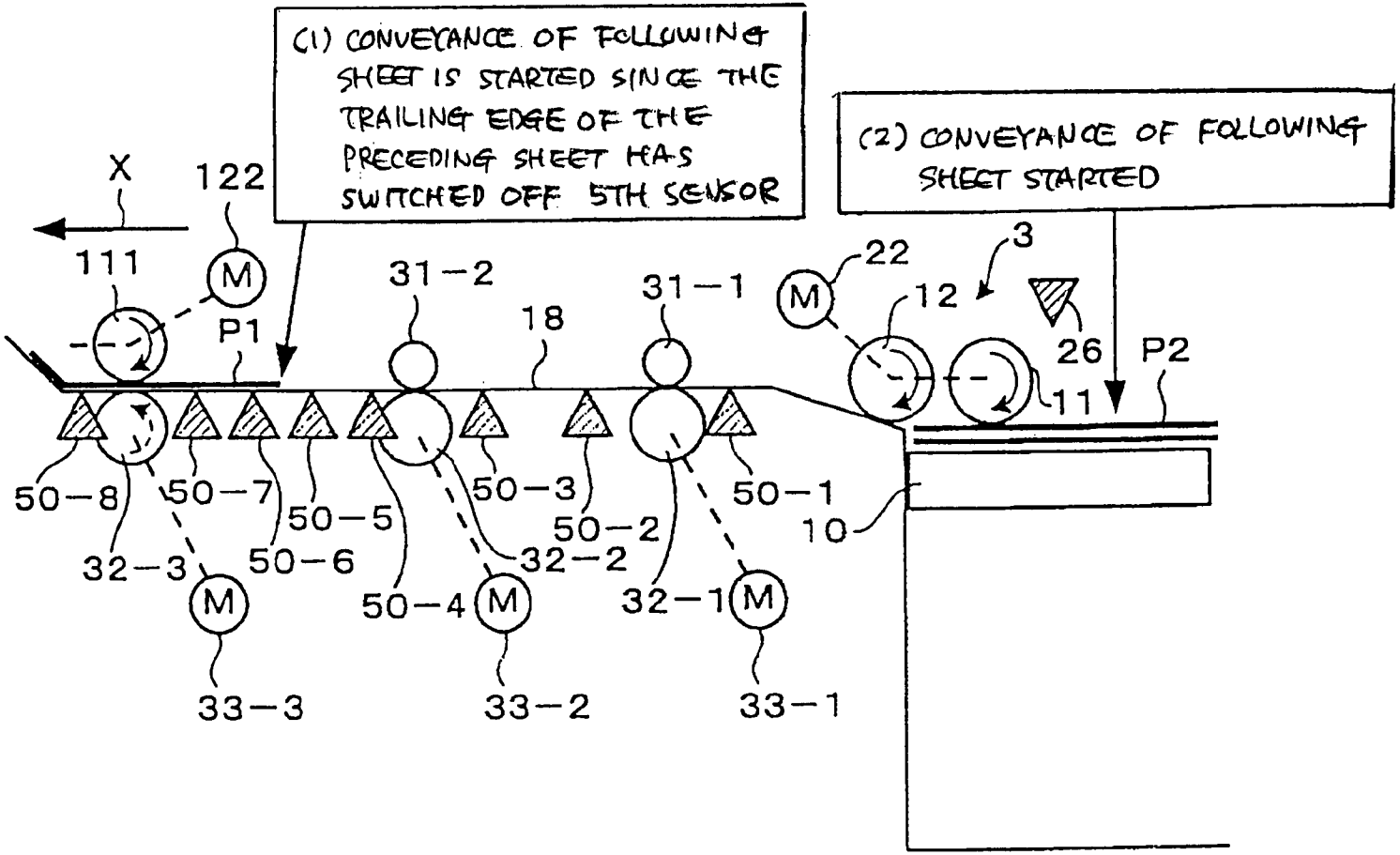
FIGS. 30A and 30B are front views describing the state of paper conveyance transition, and control thereof, between a following sheet and a preceding sheet, continuing from FIG. 29.
Figure 30B:
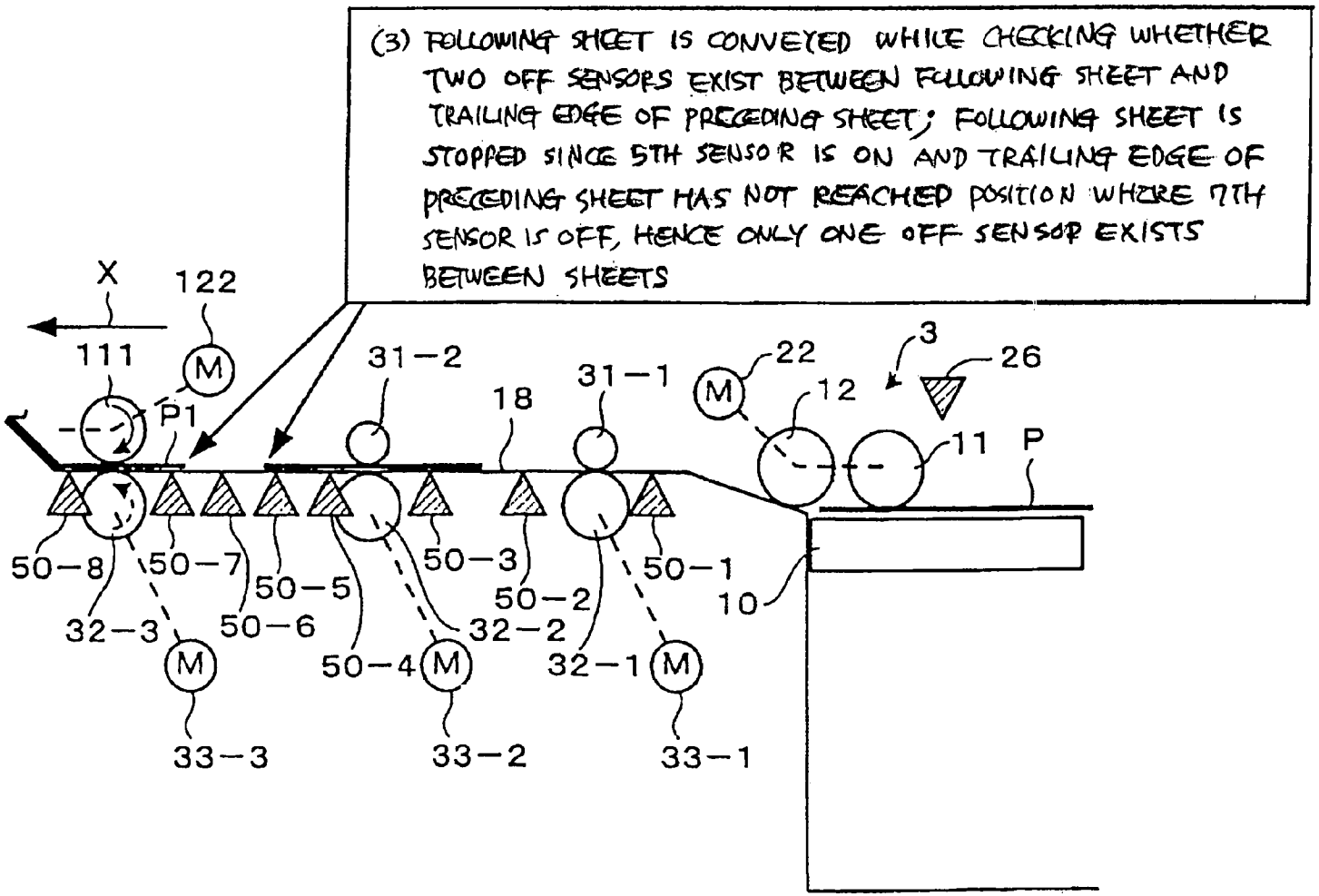
Figure 31:
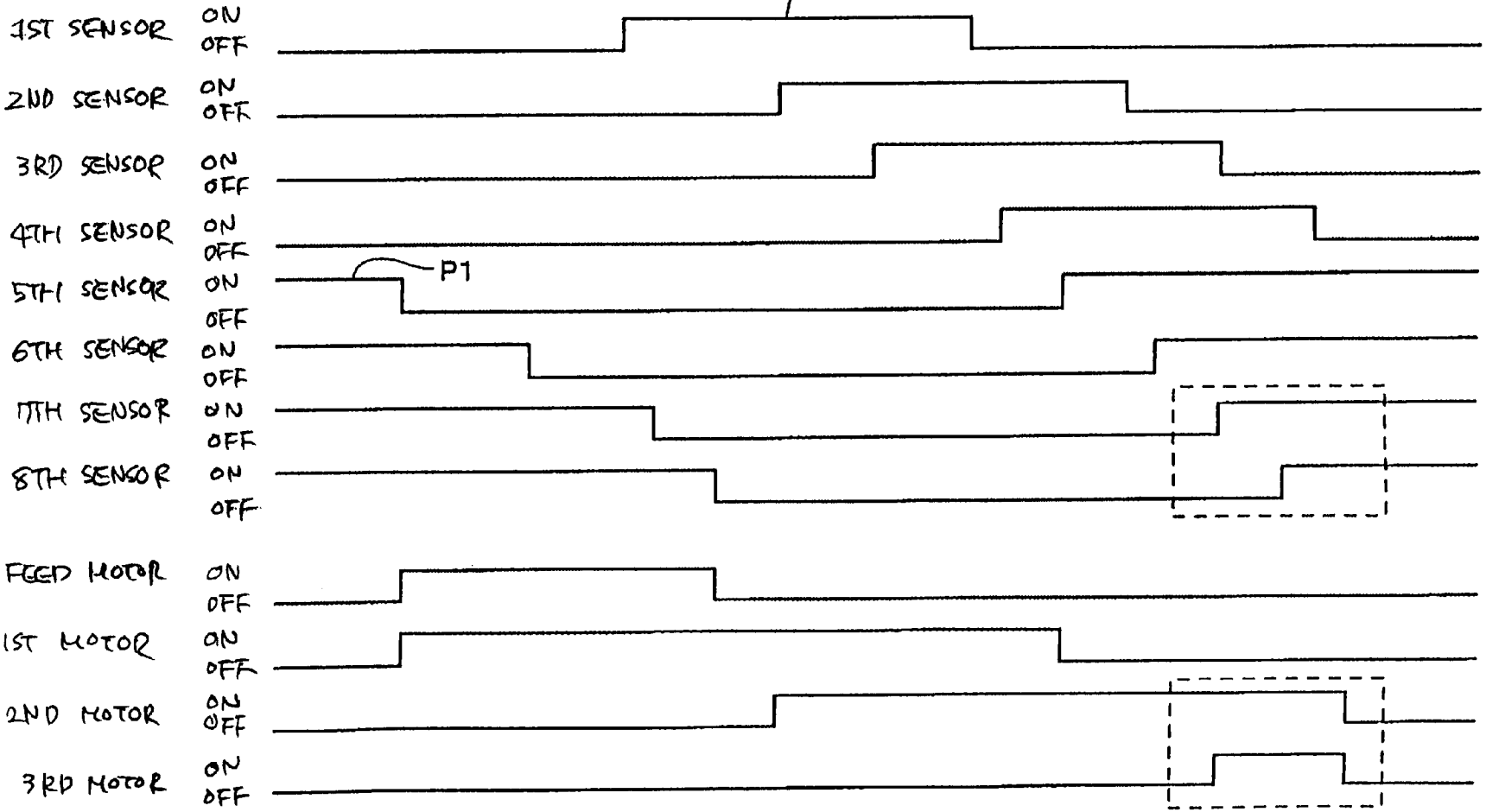
FIG. 31 is a basic timing chart of the paper conveyance control pertaining to a conveyance type 5 of the above unpublished embodiment.

Next, referring to the table in FIG. 15, the paper conveyance transfer state in FIGS. 29, 30A, and 30B, and the timing chart in FIG. 31, a simple description of an example of paper conveyance control executed under the control of the control apparatus 85 will be provided for a case in which the paper conveyance speed corresponds to the maximum printing speed in the conveyance type 5, for example, where control to switch the paper conveyance speed is not necessary, and short sized paper (B5T shown in FIG. 15) is used. In so doing, the description can be simplified.

FIG. 31 shows an example of a timing chart pertaining to the ON/OFF state of the first through eighth sensors 50-1 to 50-8, and the ON (activated)/OFF (stopped) state of the feed motor 22 and the first through third motors 33-1 to 33-3 for a case in which the leading edge of the following sheet P2 has not caught up with the trailing edge of the preceding sheet P1 in the paper conveyance control operation to be described below.

Similarly to the conveyance types 3 and 1, during paper conveyance control in the conveyance type 5, each motor is set to a preset standard speed, and the feed motor 22 and motors 33-1 to 33-3 are controlled respectively by commands from the control apparatus 85. As a result of control of the feed motor 22, the feed roller 11 and separating roller 12 pickup, separate, and convey the uppermost sheet of paper on the bulk feeding table 10, and as a result of control of the motors 33-1 to 33-3, the conveyance rollers 32-1 to 32-3 convey the paper P fed from the paper feeding mechanism 3. These operations are performed at a paper conveyance speed corresponding to the maximum printing speed on the stencil printing apparatus main body 100 side (in this unpublished embodiment, 120 sheets/min: 120 rpm), regardless of the printing speed on the stencil printing apparatus main body 100 side.

As shown in FIG. 15, the initial paper trailing edge position in the conveyance type 5 using short paper is between the fourth sensor 50-4 and fifth sensor 50-5, and the second sheet intake sensor is the fifth sensor 50-5 (when the fifth sensor 50-5 switches OFF). FIG. 29 shows the preceding sheet P1 following completion of a reset operation, in which the uppermost sheet of paper P on the bulk feeding table 10 is separated, taken in, and fed/conveyed to the intermediate conveyance path 18. The reset stopping state of the preceding sheet P1 indicates the conveyance type 5, in which the eighth sensor 50-8 through fifth sensor 50-5 are ON, and hence conveyance control for the conveyance type 5 is performed.

First, the preceding sheet P1 advances to the state shown in FIG. 30A from the reset position shown in FIG. 29. More specifically, the feed motor 122 on the stencil printing apparatus main body 100 side is activated such that the main body feed roller 111 begins to rotate clockwise at a fixed rotation speed (the peripheral speed, or in other words the paper conveyance speed, of the main body feed roller 111, corresponding to the maximum printing speed 120 rpm (peripheral speed) of the printing drum 115, as described above). As a result, the preceding sheet P1 held between the main body feed roller 111 and third conveyance roller 32-3 is taken into the main body feeding portion 104 and conveyed.

Thus the preceding sheet P1 advances to the stencil printing apparatus main body 100 side such that its trailing edge passes the fifth sensor 50-5, causing the fifth sensor 50-5 to switch OFF. Since the fifth sensor 50-5 serving as the second sheet intake sensor has switched OFF, the feed motor 22 is activated (driven to rotate), whereby the feed roller 11 and separating roller 12 begin to rotate clockwise. As a result, a single following sheet P2 is separated and conveyed toward the intermediate conveyance path 18. Next, the first and second motors 33-1, 33-2 are activated in succession, whereby the leading edge of the following sheet P2 is conveyed, while being held in succession between the rotating first conveyance roller 32-1 and first pressure roller 31-1 and the rotating second conveyance roller 32-2 and second pressure roller 31-2, until the fifth sensor 50-5 switches ON. Note that the feed motor 22 is driven until the leading edge of the following sheet P2 has been conveyed to the first conveyance roller 32-1 via the feed roller 11 and separating roller 12, and then stops automatically.

When the trailing edge of the preceding sheet P1 passes the sixth sensor 50-6, the sixth sensor 50-6 switches OFF, as shown in FIG. 30B. However, the trailing edge of the preceding sheet P1 is positioned on the seventh sensor 50-7 such that the seventh sensor 50-7 remains ON, and hence the leading edge of the following sheet P2 cannot be conveyed to the sixth sensor 50-6. In other words, conveyance is performed while checking whether two OFF sensors exist between the leading edge of the following sheet P2 and the trailing edge of the preceding sheet P1, as shown in the drawing. Here, the leading edge of the following sheet P2 is positioned such that the fifth sensor 50-5 is ON, and the trailing edge of the preceding sheet P1 is positioned such that the seventh sensor 50-7 is ON, and hence only one OFF sensor exists between the conveyed sheets. Therefore, the following sheet P2 is stopped in the position shown in FIG. 30B by switching off the second motor 33-2 until two sensors, i.e. the sixth sensor 50-6 and seventh sensor 50-7, switch OFF, having been cleared.

When the preceding sheet P1 is conveyed further toward the downstream side of the paper conveyance direction X thereafter such that its trailing edge passes the seventh sensor 50-7, causing the seventh sensor 50-7 to switch OFF, the leading edge of the following sheet P2 is stopped in the position shown in FIG. 30B, and hence the sixth sensor 50-6 and seventh sensor 50-7 are both OFF. Thus at this time, the second motor 33-2 is reactivated such that the following sheet P2 is conveyed while being held between the rotating second conveyance roller 32-2 and second pressure roller 31-2, until the leading edge thereof reaches the point at which the sixth sensor 50-6 switches ON.

At this time, a determination is made as to whether the eighth sensor 50-8 has switched OFF following conveyance of the preceding sheet P1. When the trailing edge of the preceding sheet P1 is on the eighth sensor 50-8 such that the eighth sensor 50-8 remains ON, the leading edge of the following sheet P2 cannot be conveyed to the seventh sensor 50-7 for reasons similar to those described above. Accordingly, control is performed to convey the following sheet P2 leaving a gap of two sensors between the conveyed sheets. More specifically, conveyance is performed while checking whether two OFF sensors exist between the leading edge of the following sheet P2 and the trailing edge of the preceding sheet P1. Here, the leading edge of the following sheet P2 is positioned such that the sixth sensor 50-6 is ON, and the trailing edge of the preceding sheet P1 is positioned such that the eighth sensor 50-8 is ON, and hence only one OFF sensor exists between the conveyed sheets. Therefore, the leading edge of the following sheet P2 is stopped in the position at which the sixth sensor 50-6 is ON by switching off the second motor 33-2 until two sensors, i.e. the eighth sensor 50-8 and seventh sensor 50-7, are both switched OFF having been cleared.

When the trailing edge of the preceding sheet P1 passes the eighth sensor 50-8 such that the eighth sensor 50-8 switches OFF, the second motor 33-2 is reactivated at a predetermined timing to clear two sensors, i.e. the eighth sensor 50-8 and seventh sensor 50-7, such that these sensors switch OFF. A determination is then made as to whether or not the seventh sensor 50-7 has been switched ON by the arrival of the leading edge of the conveyed following sheet P2, and if so, control is performed to convey the following sheet P2, whose leading edge was stopped on the sixth sensor 50-6, until the eighth sensor 50-8 switches ON, by activating the third motor 33-3.

When the preceding sheet P1 is conveyed into the printing portion 102 of the stencil printing apparatus main body 100 and exits the intermediate conveyance portion 4 completely, the following sheet P2, instead of the preceding sheet P1, is then stopped in the reset position until being conveyed to the printing portion 102 of the stencil printing apparatus main body 100 by rotation of the main body feed roller 111, similarly to the operation shown in FIG. 29.

By means of the unique paper conveyance control described above, when the printing speed (rotation speed of the printing drum 115) on the stencil printing apparatus main body 100 side is extremely slow (less than 60 rpm, as described above), for example, the paper conveyance speed in the intermediate conveyance portion 4 can be slowed by modifying the rotation speed of the first and second motors 33-1, 33-2 to approximately half (1,600 pps) of the normal rotation speed (approximately 3,800 pps), thereby eliminating problems occurring when the leading edge of the following sheet catches up with the trailing edge of the preceding sheet, and enabling stable and precise paper conveyance.

According to this unpublished embodiment, during initialization, when a single sheet of paper P has completed conveyance over each of the sensors 50-1 to 50-8 by means of the functions of the control apparatus 85 (CPU 86) in an offline connection, the length of the paper is determined on the basis of signals from the sensors 50-1 to 50-8, and the motors 33-1 to 33-3 are controlled to switch the conveyance type (paper conveyance pattern), which is the paper conveyance control system of the conveyance rollers 32-1 to 32-3. Hence, the following sheet P2 can be conveyed simply by determining the position of the trailing edge of the preceding sheet P1 on the first through eighth sensors 50-1 to 50-8 (the plurality of paper detecting devices). As a result, conveyance can be performed regardless of whether the paper length is regular or irregular, and thus stable paper conveyance suited to the paper length can be performed.

Further, the reset state (initialization state) is set such that a single sheet of paper is positioned on the eighth sensor 50-8, which is disposed furthest toward the downstream side of the intermediate conveyance path 18, and such that the leading edge of the paper is positioned to be fed by the main body feed roller 111 (main body feeding device). As a result, paper can be taken into the stencil printing apparatus main body (image forming apparatus main body) 100 side reliably.

Figure 32A:
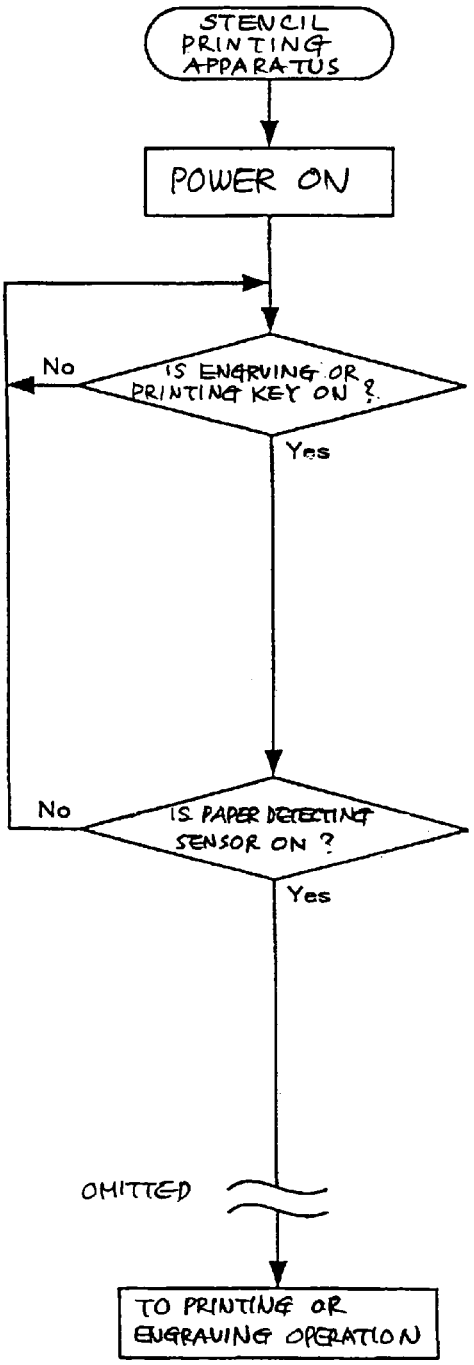
FIGS. 32A and 32B are flowcharts showing the main operating procedures when the stencil printing apparatus main body and bulk feed/conveyance unit are in the offline mode.
Figure 32B:
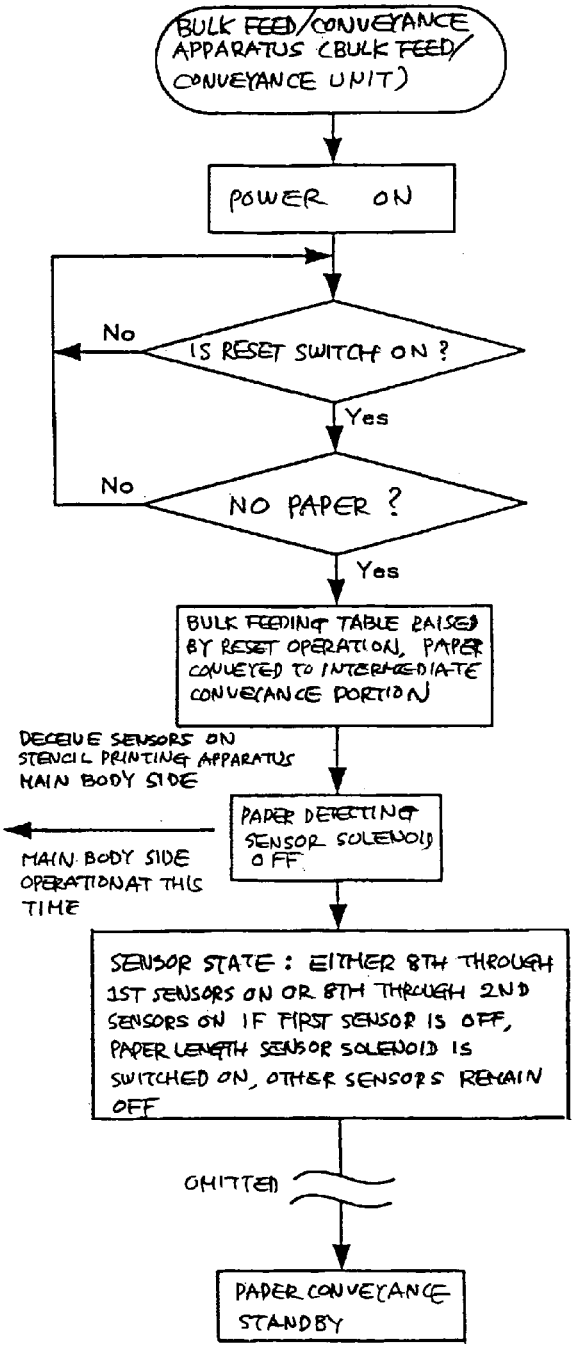

Next, ref erring to FIGS. 32A and 32B together, an operation of the entire apparatus in an offline mode, with the bulk feed/conveyance unit 1 occupying the connected position shown in FIG. 1, will be described. First, power is supplied independently from the respective power sources to the bulk feed/conveyance unit 1 side by switching on the power switch 80, as shown in FIG. 32B, and to the stencil printing apparatus main body 100 side by switching on the power switch 136, as shown in FIG. 32A. The order in which power is supplied to each device makes no difference.

Next, although the order of operations on the bulk feed/conveyance unit 1 side and stencil printing apparatus main body 100 side makes no difference, the reset switch 81 is depressed on the bulk feed/conveyance unit 1 side to drive the elevating motor 28 of the feeding table hoisting mechanism 25, shown in FIG. 1, whereby the bulk feeding table 10 rises to the maximum position (the feed position for the uppermost sheet of paper P on the bulk feeding table 10), detected by the correct height sensor 26. Next, the reset operation described above is executed (see FIGS. 17, 26, 29, for example). In other words, in FIGS. 17, 26, and 29, the feed motor 22 of the paper feeding mechanism 3 is switched ON such that the feed roller 11 is rotated clockwise, whereby the uppermost sheet of paper P on the bulk feeding table 10 is conveyed in the paper conveyance direction X. As a result of the collaborative action of the clockwise-rotating separating roller 12 and the separating pad 13, a single sheet of the paper P is separated and taken in from the bulk feeding unit 5. Next, the first through third motors 33-1 to 33-3 are switched ON such that the first through third conveyance rollers 32-1 to 32-3 rotate clockwise, causing the first and second pressure rollers 31-1, 31-2 to be rotated counter-clockwise, whereby the fed initial setting sheet P is conveyed toward the reset position on the downstream side of the paper conveyance direction X.

At this time, the size of the initial setting sheet is unknown, and hence conveyance is performed according to the paper conveyance control system of the conveyance type 1 (A3, DL, i.e. maximum paper size) shown in FIG. 15. However, since the preceding sheet is not in the intermediate conveyance portion 4, the following sheet advances without stopping, and all of the conveyance types operate identically. In other words, since there is no preceding sheet in the intermediate conveyance portion 4, a situation in which the following sheet catches up with the preceding sheet and has to be stopped does not arise, regardless of the conveyance type, and hence the following sheet is conveyed to the reset position by an identical operation.

When the leading edge of the initial setting sheet P is detected to have occupied the reset position by means of a signal indicating the presence of paper from the eighth sensor 50-8, the first through third motors 33-1 to 33-3 are switched OFF. As a result, the leading edge of the initial setting sheet P is stopped in a position substantially in front of the front surface of the main body feeding portion 104, thereby occupying the reset position. The reset operation then ends.

When the leading edge of the paper P passes the eighth sensor 50-8, the paper detecting sensor solenoid 72-2 switches OFF (returns) to indicate the presence of paper. Accordingly, when no paper P is present on the intermediate conveyance path 18, the paper detecting sensor solenoid 72-2 switches ON. Thereafter, in any order, the paper detecting sensor solenoid 72-2 shown in FIG. 9 and so on remains OFF, the paper length sensor solenoid 72-1 remains OFF (note, however, that when paper P is present on the intermediate conveyance path 18 and the paper is long, it is a condition that the shutter 71-1 be closed when the paper length is A4 or greater, and open when the paper length is less than A4), and hence the paper detecting sensor 127 and paper length sensor 128 of the main body feeding table 110 on the stencil printing apparatus main body 100 side remain blocked by the shutters 71-2, 71-1. As a result, the paper detecting sensor 127 and paper length sensor 128 of the main body feeding table 110 are deceived into thinking that paper is stacked thereon, thus enabling an initial operation on the stencil printing apparatus main body 100 side (printing, engraving, and so on) at the ON timing of the paper detecting sensor 127.

Further, although the processing flow is omitted from FIGS. 32A and 32B, when the bulk feed/conveyance unit 1 is moved to the downstream side of the paper conveyance direction X in order to occupy the connected position shown in FIG. 1, the main body feed roller 111 is pivoted upward together with the feed arm, not shown, by the tilted member 51 shown in FIGS. 9A and 9B in order to occupy the paper feeding position smoothly. As a result, the feeding filler, not shown, switches the correct height sensor 126 shown in FIG. 2 ON, thereby deceiving the correct height sensor 126 into thinking that the main body feeding device is capable of feeding paper. On the stencil printing apparatus main body 100 side, due to the offline connection, the paper length and paper width of the paper on the main body feeding table 110 of the stencil printing apparatus main body 100 are each set manually.

On the stencil printing apparatus main body 100 side, a well-known operation, in other words plate-making or plate-making and printing, comprising a plate discharging operation, an original image reading operation, and engraving and plate feeding operation, and a test printing performed simultaneously with the completion of the engraving and plate feeding operation, is performed normally for one plate with the start signal generated by pressing the engraving start key disposed on an operating panel, not shown, as a trigger. At this time, a sheet of paper P is conveyed from the intermediate conveyance portion 4 in the bulk feed/conveyance unit 1 by means of the paper conveyance control described in detail above. The leading edge of the paper P is then fed to the registration roller pair 114 at a paper conveyance speed corresponding to the maximum printing speed, 120 rpm, of the main body feed roller 111 and main body separating roller 112 in the main body feeding portion 104, and then stopped temporarily at the nip portion formed between the registration roller pair 114 in order to improve the registration precision, where a predetermined flexure is formed on the leading edge of the paper P.

Meanwhile, the printing drum 115 begins to rotate gently at an extremely low rotation speed (printing speed), for example a rotation speed of less than 60 rpm such as 16 to 30 rpm, in a clockwise direction as shown by the arrow in FIG. 1. Then, at a predetermined timing, the registration roller pair 114 is driven to rotate by activating the registration motor, not shown, constituted by a stepping motor, whereby the paper P is conveyed between the press roller 116, which is raised simultaneously as shown by the double-dashed line in FIG. 1, and the printing drum 115, such that the paper P is pressed against the engraved thermal stencil master on the printing drum 115 at the image position on the leading edge of the engraved thermal stencil master which is wrapped around the outer peripheral surface of the printing drum 115. As a result, plate making and printing are performed when the engraved thermal stencil master is adhered to the outer peripheral surface of the printing drum 115 by the adhesive force of the ink that is supplied from the interior of the printing drum 115 and the ink is transferred to the paper P.

After plate making and printing are complete, the paper P is discharged and stacked on a bulk discharge table 129 of the discharge table 106 in a methodical fashion by means of a well-known discharge operation. Next, when the printing start key, not shown, which is provided on the aforementioned operating panel, is pressed, feeding, printing, and discharging operations similar to the plate making and printing operation described above are performed repeatedly for the number of set sheets to be printed, whereupon the stencil printing operation ends. The plate making and printing operation differs from the normal printing operation only in that the printing speed is extremely low, as described above, and in that the operation is not counted as a normal printed sheet.

When the bulk feed/conveyance unit 1 does not occupy the connected position shown in FIG. 1, but instead occupies the non-connected position, a well-known plate discharging operation, original image reading operation, engraving/plate feeding operation, and feeding/printing/discharging operation are performed on the stencil printing apparatus main body 100 side with the paper stacked on the main body feeding table 110.

According to this unpublished embodiment, the following advantages are obtained.

(1) Paper can be conveyed from the intermediate conveyance portion 4 of the bulk feed/conveyance unit 1, regardless of the paper size or the printing speed on the stencil printing apparatus main body 100 side, and hence paper can be supplied even when the bulk feed/conveyance unit 1 is not connected communicably (online connected) to the stencil printing apparatus main body 100 and there is no electrical connection, for example. As described above, or as will be summarized hereafter, the reason why the paper conveyance control system differs when the paper size is comparatively long and comparatively short is as follows. When the paper size is short, the time required for conveyance by a single conveyance roller is longer than when the paper size is long, and moreover, little pressure is applied to the paper during stopping. As a result, the paper tends to move forward during conveyance. It would be logical to increase the number of paper conveyance devices and paper detecting devices beyond the number in this unpublished embodiment, or to raise the maximum conveyance speed in order to create a time surplus such that paper conveyance control can be executed similarly for both long paper and short paper. In this unpublished embodiment, however, cost balance has been taken into consideration, and hence the number of paper conveyance devices and paper detecting devices, set in accordance with the paper size of the paper that is to be conveyed from the bulk feed/conveyance unit 1 to the stencil printing apparatus main body 100, has been suppressed to the required minimum. Thus in this unpublished embodiment, control is performed with a simple constitution and while suppressing cost increases.

When paper is long

Conveyance control is begun for the following sheet when the trailing edge of the preceding sheet has reached the position where the second sheet intake sensor switches OFF. When the leading edge of the following sheet reaches the Nth sensor (as the sensor number increases, the sensor is positioned further toward the stencil printing apparatus main body 100 side), a check is made as to whether the N+1th sensor has been switched OFF by the advancement of the trailing edge of the preceding sheet, and if the N+1th sensor is OFF, it is determined that the following sheet may advance to the N+1th sensor. If the N+1th sensor is ON, control is executed to stop the following sheet until the N+1th sensor switches OFF. By means of this basic control, paper conveyance can be performed while securing the distance between sheets at all times, irrespective of the printing speed on the stencil printing apparatus main body 100 side. Accordingly, once the following sheet, which is supplied within a fixed time period, reaches the third conveyance roller 32-3 disposed in a substantially opposing position to the main body feed roller 111 of the main body feeding table 110, which is attached to the main body of the copier, printer, or other image forming apparatus, then the following sheet can be conveyed under identical conditions to a sheet fed from the main body feeding table 110.

When paper is short

Conveyance control is begun for the following sheet when the trailing edge of the preceding sheet has reached the position where the second sheet intake sensor switches OFF. When the leading edge of the following sheet reaches the Nth sensor, a check is made as to whether the N+2th sensor has been switched OFF by the advancement of the trailing edge of the preceding sheet, and if the N+2th sensor is OFF, it is determined that the following sheet may advance to the N+2th sensor. If the N+2th sensor is ON, control is executed to stop the following sheet until the N+2th sensor switches OFF. By means of this basic control, paper conveyance can be performed while securing the distance between sheets at all times, irrespective of the printing speed on the stencil printing apparatus main body 100 side. Accordingly, once the following sheet, which is supplied within a fixed time period, reaches the third conveyance roller 32-3 disposed in a substantially opposing position to the main body feed roller 111 of the main body feeding table 110, which is attached to the main body of the copier, printer, or other image forming apparatus, then the following sheet can be conveyed under identical conditions to a sheet fed from the main body feeding table 110.

When the paper is short, the paper on the intermediate conveyance portion 4 is depleted more quickly, and hence a large time surplus can be obtained for the paper to reach the main body feed roller 111 in comparison with a case in which the paper is long. Accordingly, two sensors are used as the OFF sensors for determining the interval between sheets. Conversely, when the paper is long there is no time surplus, and hence one sensor is used as the OFF sensor for determining the interval between sheets.

(2) As a result of this control, there is no need to read the printing speed of the stencil printing apparatus main body 100, and hence the present invention can be applied to machines that are currently on the market. It is therefore unnecessary to purchase a new machine, and a current machine can be transformed easily into a printing apparatus including a stencil printing apparatus which is capable of bulk printing.

(3) By disposing the third conveyance roller 32-3 below the main body feed roller 111, the main body feed roller 111 can be rotated by driving the third conveyance roller 32-3, thereby preventing damage caused when the leading edge of the paper becomes caught on the protruding portions of the main body feed roller 111. Moreover, problems occurring with a fixed rubber pad (friction separating member), also referred to as a separating pad, such as non-conveyance of the paper, are eliminated with a roller. As a result, an accurate amount of conveyance can be secured for determining the stopping position of the leading edge of the paper.

(4) The pitch $+\alpha$ of the conveyance rollers is set to the minimum conveyed paper length, and hence by providing a plurality of conveyance rollers, shorter paper can be handled.

(5) Eight sensors are disposed as the sensors 50 (paper detecting devices) in accordance with the paper sizes used in the stencil printing apparatus main body 100, eight being the minimum required number for determining the ten paper length types that can be conveyed by the intermediate conveyance portion 4. Hence the constitution for detecting the paper length can be simplified and reduced in cost. If these advantages are not particularly desirable, more sensors (paper detecting devices) may be provided. Needless to say, as the number of sensors increases, the sensors between which the trailing edge of a sheet of paper is stopped can be detected more accurately, thus enabling a gap between the sheets to be secured at all times, and enabling this gap to be secured more reliably.

(6) To secure the paper conveyance amount, stepping motors, which can convey the sheets by an accurate paper movement distance, are used as the first through third motors 33-1 to 33-3, thereby simplifying control. Further, by determining the extent to which the paper has slipped by comparing the number of pulses supplied to the stepping motors with the time required for the paper to pass between sensors, paper conveyance can be performed even more accurately.

(7) The one-way clutch 61 is installed into each shaft portion of the first through third conveyance rollers 32-1 to 32-3, and hence the resistance of the first through third conveyance rollers 32-1 to 32-3 to the suction force of the main body feed roller 111 can be reduced.

(8) Conversely, the stopping precision of the paper may be affected adversely by the inertia of the first through third conveyance rollers 32-1 to 32-3. To eliminate this problem, the first through third conveyance rollers 32-1 to 32-3 can be prevented from rotating idly by a fixed brake mechanism which operates when the motors are stopped. As a result, stable paper stopping precision can be secured. When paper is supplied from the stencil printing apparatus main body 100 side, the aforementioned one-way clutch 61 is inserted into the shaft portion of the third conveyance roller 32-3 such that as little load as possible is applied to the paper. As a result, the first through third conveyance rollers 32-1 to 32-3 are rotated and interrupted repeatedly according to the paper length used in the main body of the copier, printer, or other image forming apparatus, occasionally entering a stopped state regardless of whether the stepping motors are speeding up or slowing down. Due to this difference in inertia, the stopping position may vary among the rollers. Differences in the frictional coefficient due to differences in the surface condition of the paper, or even differences in weight, also cause variation in the advancement distance of the paper or the stopping position precision due to the resultant inertia. As a result, in the intermediate conveyance portion 4, at a high paper conveyance speed corresponding to the maximum printing speed, as in this embodiment, in which the distance between sheets of long paper is short, and during paper conveyance in which the leading edge of the following sheet may advance to the Nth sensor when the trailing edge of the preceding sheet passes the Nth sensor, the leading edge of the following sheet is stopped at the Nth sensor when the trailing edge of the preceding sheet has not passed the N+1th sensor. However, since the one-way clutches 61 are used, the paper cannot be stopped at the intended position using the inertia of the main body feed roller 111 (or its shaft in certain cases) even when stopping is performed through speed-up control or forceful stopping. Hence in the worst case, the leading edge of the following sheet catches up and collides with the trailing edge of the preceding sheet, causing damage to the paper and causing the paper to deform such that jams occur during conveyance. In this embodiment, however, a braking force is applied to the third conveyance roller 32-3 by the plate spring, thereby suppressing the effect of inertia so that a stable stopping position can be obtained and an improvement in the quality of paper conveyance can be achieved.

The paper conveyance apparatus to which the invention pertaining to this unpublished embodiment, exhibiting the advantages and effects described above, is applied may also be applied to a bulk feeding apparatus having an intermediate conveyance portion which uses limited paper sizes, such as that disclosed in U.S. Pat. No. 5,441,247, for example.

FIRST SPECIFIC EXAMPLE

A bulk feed/conveyance unit 1A serving as a paper conveyance apparatus pertaining to a first specific example of the present invention is shown in FIGS. 1 to 4 and 33. The bulk feed/conveyance unit 1A differs mainly from the bulk feed/conveyance unit 1 of the unpublished embodiment shown in FIGS. 1 through 32A and 32B in that the control apparatus 85 (CPU 86) is allocated a third function for performing the paper conveyance control to be described below.

The control apparatus 85 (CPU 86) comprises a third function as a control device for reducing the paper conveyance speed of the second paper conveyance device 30-2 and third paper conveyance device 30-3, disposed to the front and rear of the seventh sensor 50-7, when the leading edge of the paper P is detected by the seventh sensor 50-7, which is disposed one sensor further toward the upstream side of the intermediate conveyance path 18 than the eighth sensor 50-8, which is the furthest-downstream paper detecting device. In other words, this third function of the control apparatus 85 (CPU 86) is for controlling the second motor 33-2 and third motor 33-3 to reduce the paper conveyance speed of the second conveyance roller 32-2 of the second paper conveyance device 30-2 and the third conveyance roller 32-3 of the third paper conveyance device 30-3 on the basis of an OFF signal from the seventh sensor 50-7 generated when the leading edge of the paper P is detected by the seventh sensor 50-7, or more specifically when the output signal of the seventh sensor 50-7 switches from ON to OFF upon detection of the leading edge of the paper P.

Figure 33:
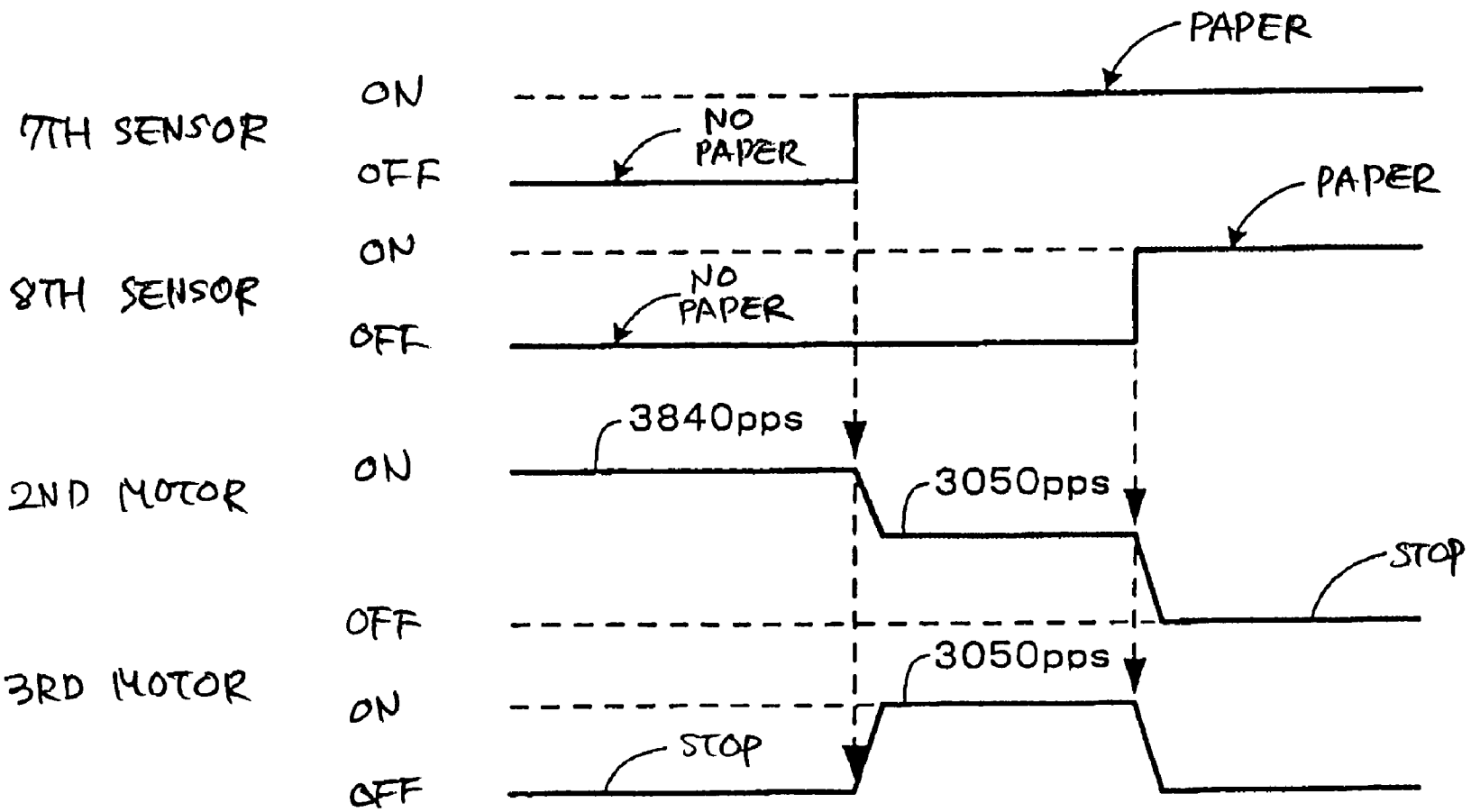
FIG. 33 is a timing chart showing an example of paper conveyance speed control in a first specific example.
Figure 34:
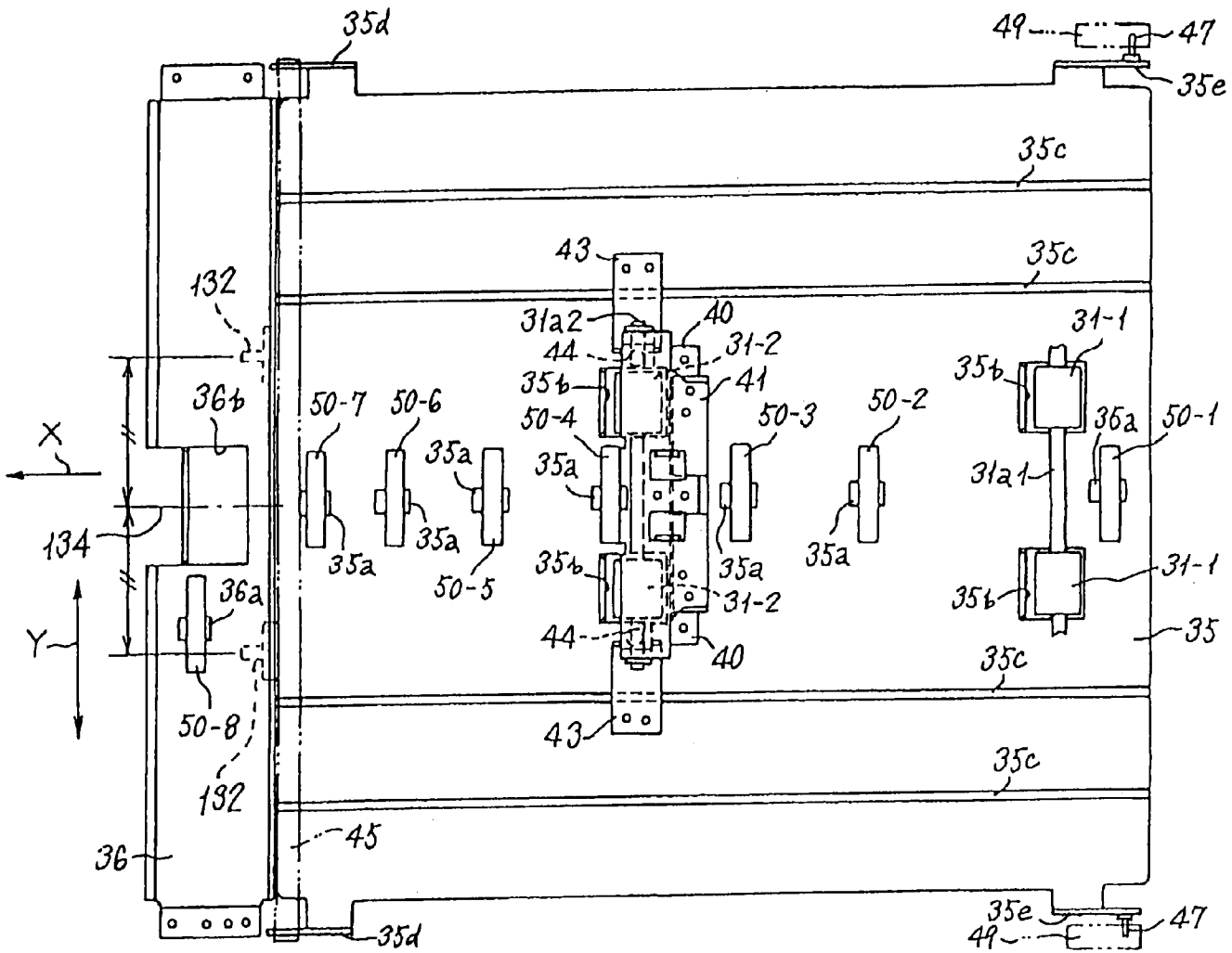
FIG. 34 is a plan view of the periphery of the upper guide plate, showing the attachment site and position of plate springs, in a second specific example.

As shown in FIG. 1, in an offline state when the bulk feed/conveyance unit 1A is connected mechanically to the stencil printing apparatus 100 to be capable of feeding paper thereto, or in other words when the bulk feed/conveyance unit 1A and stencil printing apparatus 100 are in the offline mode, the output signal from the seventh sensor 50-7 switches from ON to OFF when the leading edge of the paper P passes over the seventh sensor 50-7, regardless of the size of the paper P, as shown in FIG. 33, and hence the operational state switches from "no paper" to "paper". Here, the control apparatus 85 controls the second motor 33-2 and third motor 33-3 to reduce the paper conveyance speed of the second conveyance roller 32-2 and third conveyance roller 32-3 on the basis of the OFF signal from the seventh sensor 50-7.

In this example, by changing the part of the timing charts shown in FIGS. 25, 28, and 31, pertaining to the conventional unpublished embodiment, that are surrounded by a broken line, the rotation speed of the second motor 33-2 is reduced from 3,840 pps to 3,050 pps, and the third motor 33-3 is activated and started up (from 0 pps to 3,050 pps), as shown in FIG. 33. Furthermore, as the paper P advances downstream in the paper conveyance direction X and passes over the eighth sensor 50-8, the control apparatus 85 stops both the second motor 33-2 and third motor 33-3. As a result, the paper P is stopped (at this point, the first conveyance roller 32-1 has already stopped). By reducing the conveyance speed of the paper P at the short distance between the seventh sensor 50-7 and eighth sensor 50-8, the paper conveyance time is substantially not affected.

The reason for this is that when the speed reduction time is lengthened (the distance between the seventh sensor 50-7 and eighth sensor 50-8, or the distance between the sixth sensor 50-6 and eighth sensor 50-8), the overall paper conveyance time lengthens, leading to a delay in the intake timing of the leading edge of the following sheet P2 by the main body feed roller 111. As a result, the following sheet P2 is too late to be taken into the stencil printing apparatus 100 main body side, resulting in a jam. Hence, by keeping the speed reduction time as short as possible, the possibility of a jam can be reduced.

As long as there is substantially no effect on the paper conveyance time as described above, an output signal from the sixth sensor 50-6, disposed two sensors further toward the upstream side of the intermediate conveyance path 18 than the eighth sensor 50-8, may be used as the paper conveyance device for reducing the paper conveyance speed when the leading edge of the paper P is detected. More specifically, the control apparatus 85 (CPU 86) may comprise a third function as a control device for reducing the paper conveyance speed of the second paper conveyance device 30-2 and third paper conveyance device 30-3, disposed to the front and rear of the sixth sensor 50-6, when the leading edge of the paper P is detected by the sixth sensor 50-6, which is disposed two sensors further toward the upstream side of the intermediate conveyance path 18 than the eighth sensor 50-8.

Note that the normal rotation speed of the first through third motors 33-1 to 33-3 is approximately 3,800 pps, but in this example, the rotation speed is increased from approximately 3,800 pps to 3,840 pps (+40 pps) to compensate for the fact that the paper conveyance time lengthens slightly when the speed is reduced from 3,840 pps to 3,050 pps (−790 pps).

By means of this unique paper conveyance control, in which the paper conveyance speed is reduced as described above, variation in the stopping position P0 of the paper P, which was +20 to −5 mm in the conventional bulk feed/conveyance unit 1, can be reduced to within a range of approximately +15 to −5 mm by reducing the paper conveyance speed, and hence an improvement in the stopping position precision can be achieved.

However, variation in the stopping position P0 from paper P of size B6Y, which is the shortest and smallest paper size (B6Y is equal in length to B5T but half the size thereof), to paper P of size DLY, which is the longest and largest paper size, remains at ±20 mm due to the effect of inertia. With long paper P (DLY or A3Y), the first conveyance roller 32-1 stops before the second conveyance roller 32-2 and third conveyance roller 32-3, and hence the advancement amount of the paper P is reduced by the braking force and the load/pressure that are applied to the paper P. With short paper P (B5T or B6Y), however, little braking force is applied, and hence the paper P advances further due to inertia. As a result, the short paper P (B5T or B6Y) advances too far, and since the advancement amount of the long paper P (double letter or A3Y) is small, variation in the stopping position P0 increases. To solve this problem, the following second specific example was created.

SECOND SPECIFIC EXAMPLE

A bulk feed/conveyance unit 1B serving as a paper conveyance apparatus pertaining to a second specific example of the present invention is shown in FIGS. 1 to 4 and 33 to 37. The bulk feed/conveyance unit 1B differs mainly from the bulk feed/conveyance unit 1A shown in FIGS. 1 to 4 and 33 in that a pair of plate springs 132 constituted by elastic members and serving as a braking force applying device for applying a braking force to the conveyed paper P are annexed to the rear end portion of the auxiliary upper guide plate 36, disposed on the intermediate conveyance path 18 between the eighth sensor 50-8 and the seventh sensor 50-7, which is disposed one sensor further toward the upstream side of the intermediate conveyance path 18 than the eighth sensor 50-8, as shown in FIGS. 34 through 37 and as will be described below.

As shown in FIGS. 34 to 37, each plate spring 132 is adhered and fixed to the rear surface of an upward-facing inclined portion on the rear end portion of the auxiliary upper guide plate 36, taking a position of substantially linear symmetry to a center line 134 of the conveyed paper P in the paper width direction Y, via double-sided adhesive tape 133, for example, which is shown in the drawings by cross-shading. The plate springs 132 are formed from thin metallic plates having a substantial T-shape. The form of the plate springs 132 in the vicinity of the contact site with the paper P, or in other words the form on a leading edge 132*a* side, is bent from the boundary with the adhered portion, which is adhered by the double-sided adhesive tape 133, to form an acute angle with the horizontal plane in the paper conveyance direction X, or in other words so as to extend substantially linearly in the paper conveyance direction X.

In the second specific example, the left/right pair of plate springs 132 is added so that when the leading edge 132*a* contacts the paper P, particularly short paper P (B5T or B6Y), a braking force, and a load and pressure, are applied directly to the paper P rather than using a brake. As a result, the advancement amount of small paper P (B5T or B6Y) is suppressed, enabling a reduction in variation in the stopping position P0 according to the paper size (paper length).

Test plate springs 132 manufactured for evaluation purposes were formed integrally from thin plate-form stainless steel having a thickness of 0.1 mm, and a dimension W1 of the leading edge 132*a* in the paper width direction Y was formed at 10 mm. With these two plate springs 132 combined, a favorable braking force of 0.6 N (60 gf) and load were applied to the paper P. By adding the left/right pair of plate springs 132, disposed in substantially linear symmetry, variation in the stopping position P0 from the shortest and smallest paper P size B6Y to the longest and largest paper P size DLY could be suppressed to a range of approximately ±5 mm, thus enabling stable paper conveyance. The braking force of the left/right pair of plate springs 132 also acts on long paper P, and although its effects are smaller than on short paper P, the overall advancement distance can be reduced, enabling an improvement in the stopping position precision.

According to the second specific example, particularly when short paper is conveyed, a braking force and a load/pressure can be applied to a position of substantially linear symmetry to the center line 134 of the conveyed paper P in the paper width direction Y by the left/right pair of plate springs 132 even when the trailing edge of the paper P is not held by the second paper conveyance device (second pressure roller 31-2 and second conveyance roller 32-2) or the holding length of the second paper conveyance device is insufficient. As a result, skew can be prevented even in small paper P, and a stable feeding quality with less variation in the stopping position P0 of the paper P can be obtained. Note that the plate spring 132 could be disposed in one location in the center of the paper width direction Y of the conveyed paper P, but since the main body feed roller 111 is disposed in this position, this is impossible.

Figure 38A:
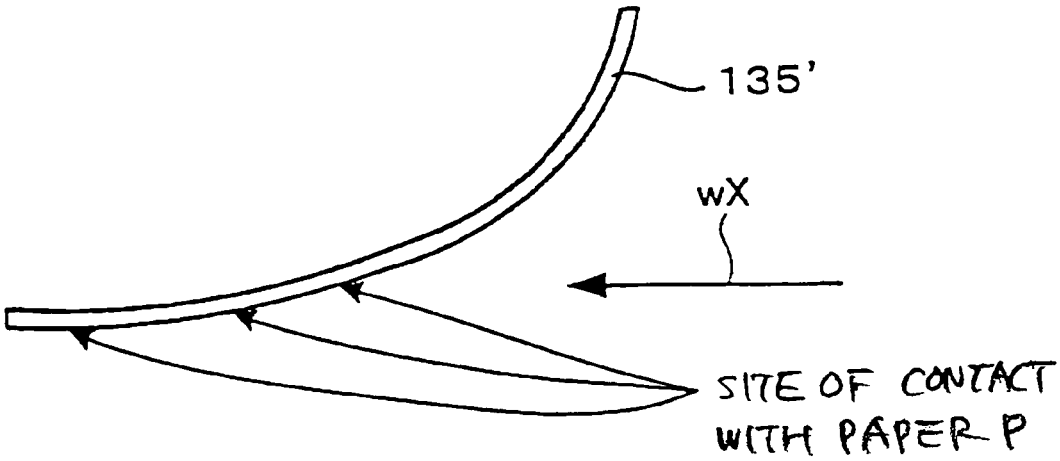
FIG. 38A is a view illustrating a contact range between a sheet of paper and the elastic member when the vicinity of the contact site between the sheet of paper and the elastic member has a downward crescent form.
Figure 38B:
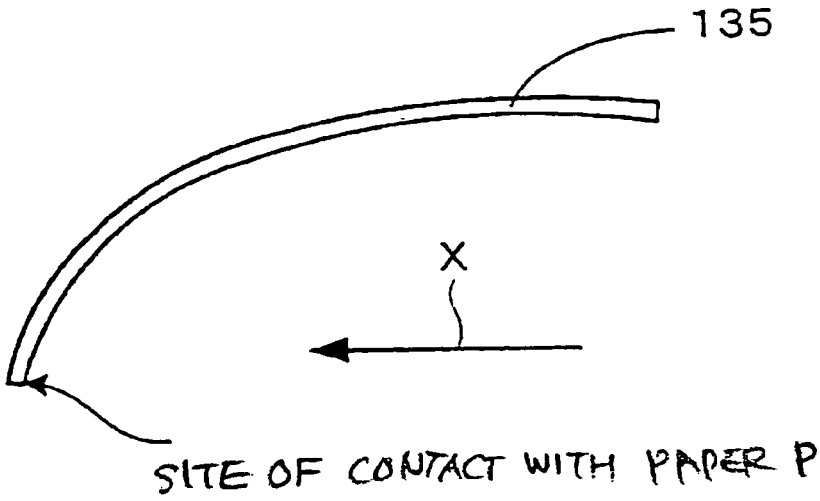
FIG. 38B is a view illustrating the contact range when the vicinity of the contact site has an upward crescent form.

Referring to FIGS. 38A and 38B, the form of the elastic member in the vicinity of the site of contact with the paper P will be evaluated through comparison. FIG. 38A shows an elastic member 135' serving as a comparative example, and FIG. 38B shows the elastic member 135 employed in the second embodiment. When the direction of the bow of the elastic member 135' in relation to the paper conveyance direction X takes a downward crescent form, as in the elastic member 135' shown in FIG. 38A, the pressure (braking force and load) that is applied to the paper P during contact with the paper P is unstable, differing according to the part or site of the arc of the downward crescent form. When pressure is applied with the elastic members 135' disposed in left and right symmetrical positions to the paper conveyance direction X of the paper P, and the arc positions in which pressure is applied to the paper P differ between the left and right elastic members 135', short paper P is only held between the main body feed roller 111 and third conveyance roller 32-3, and hence supported at only one point. As a result, the braking force differs between left and right, causing the paper P to skew.

Figure 35:
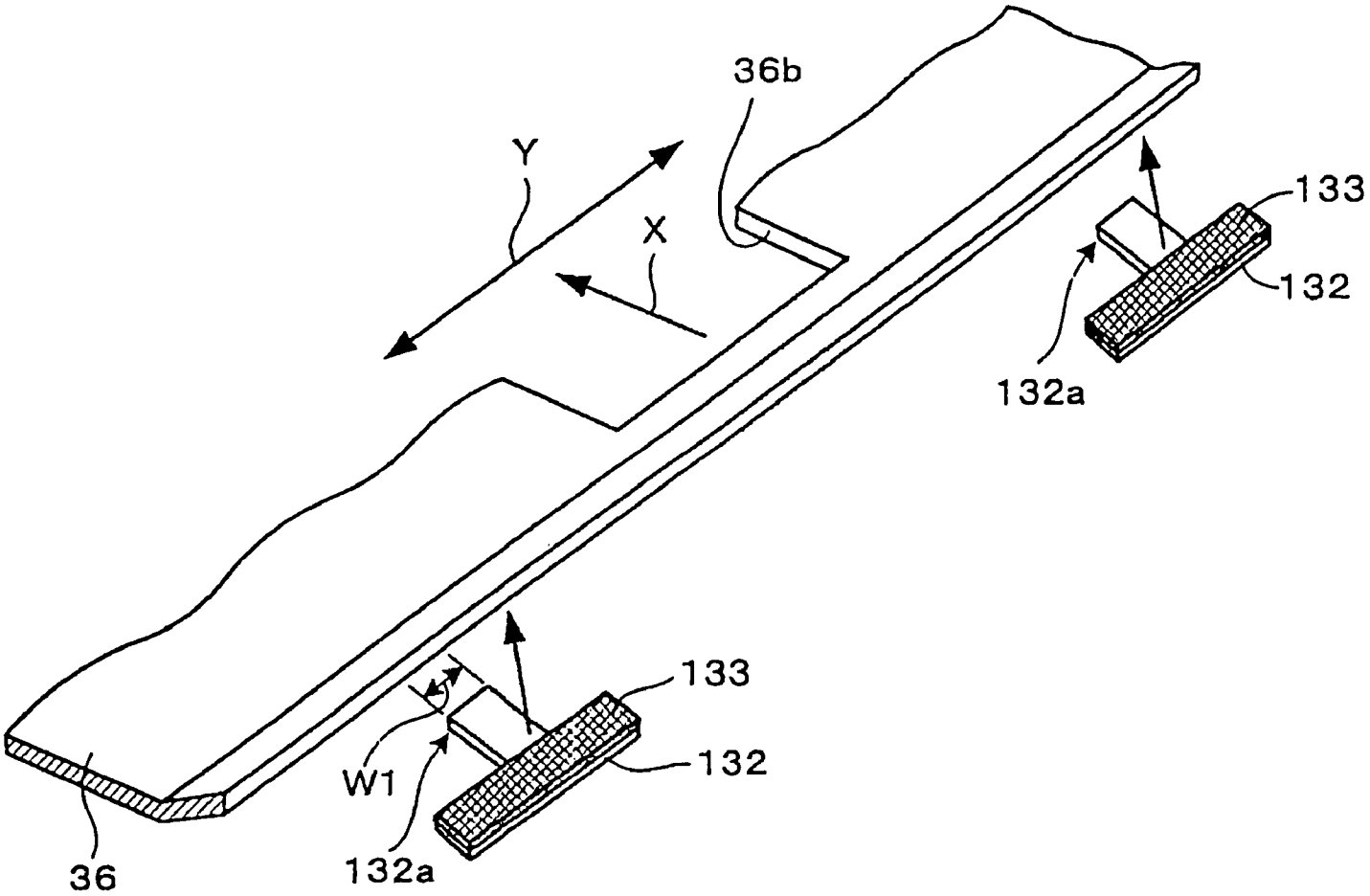
FIG. 35 is a plan view of the periphery of an auxiliary upper guide plate, showing the attachment site of the plate springs in the second specific example.
Figure 36A:
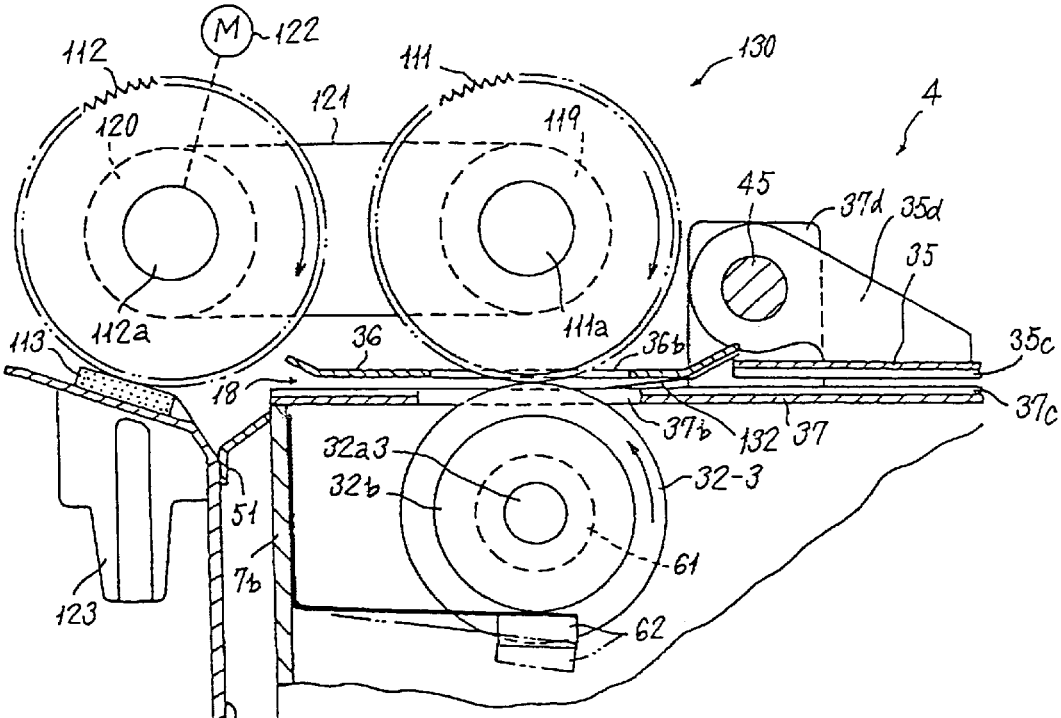
FIGS. 36A and 36B are sectional views of the periphery of the intermediate conveyance portion, showing the attachment site of the plate springs serving as elastic members in the second specific example.
Figure 36B:
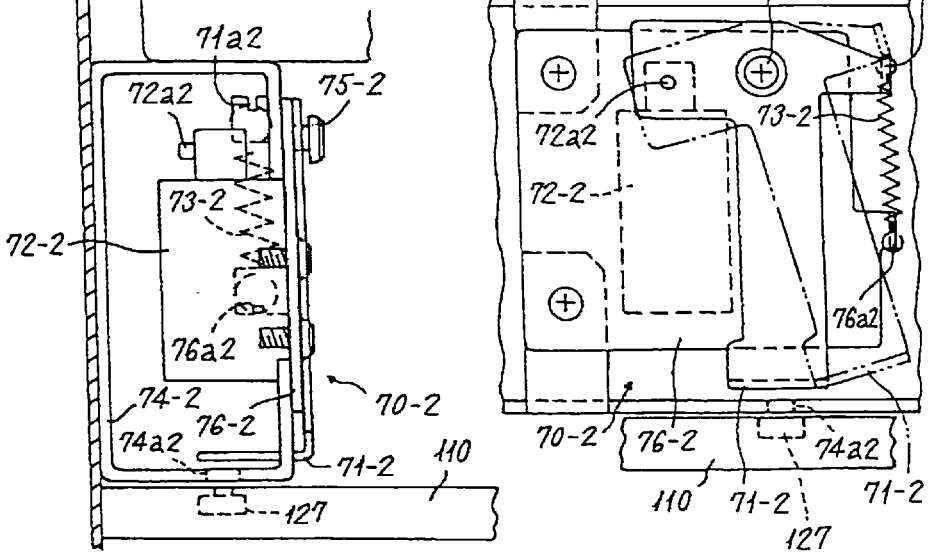
Figure 37:
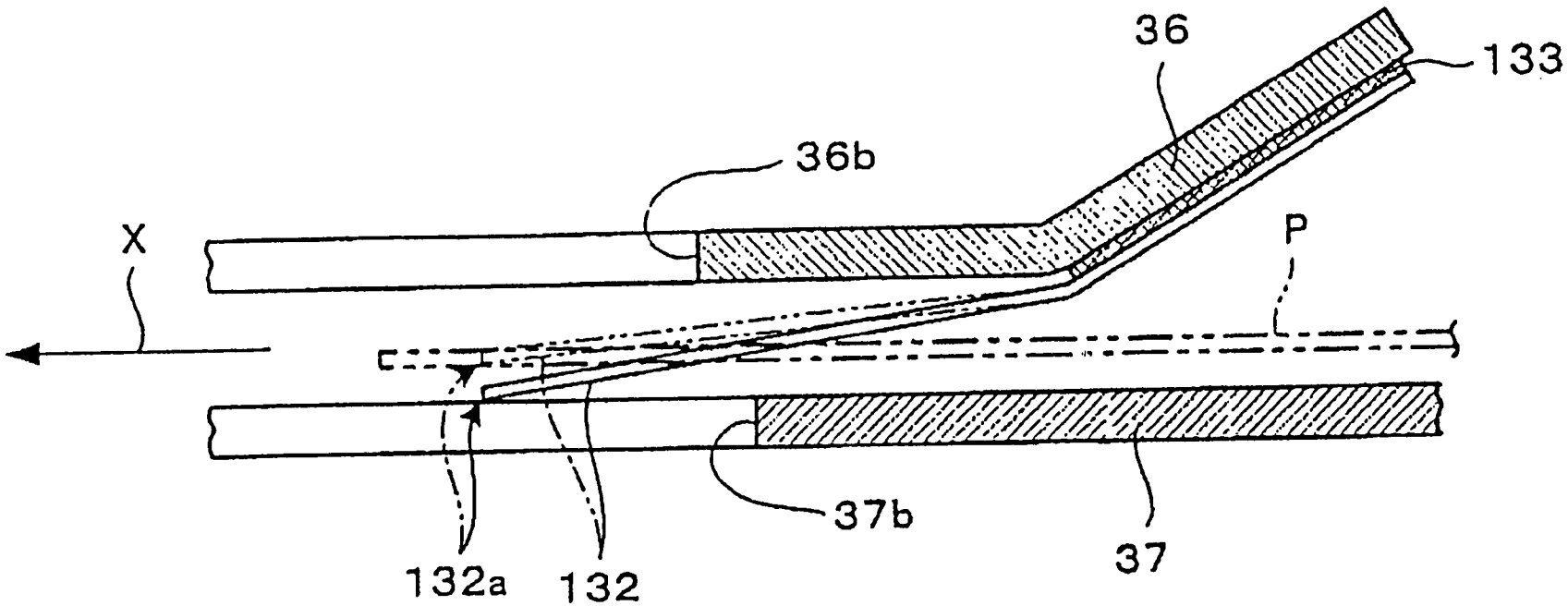
FIG. 37 is an enlarged sectional view of the main parts of FIGS. 36A and 36B.

With the elastic member 135 shown in FIG. 38B, on the other hand, the leading edge of the elastic member 135, which is curved in an upward crescent form, applies pressure to the paper P at all times, and hence the paper P becomes less likely to skew. The same applies when the leading edge 132*a* site of the spring plates 132 shown in FIGS. 35 to 37 is formed in an inclined, substantially linear form (substantially planar form).

Further, according to the second specific example, by forming the elastic members as a metallic thin plate, for example the stainless steel plate springs 132, wear caused by contact with the paper P can be reduced greatly, thereby improving the durability of the elastic members. Typically, ten million passes are guaranteed in a paper feeding apparatus used in the bulk feeding stencil printing apparatus 100, but it was learned from a durability test performed on the bulk feed/conveyance unit 1 in which the test plate springs 132 were disposed as described above, using A3Y size paper, that at least three million passes could be guaranteed.

FIG. 39 shows a modification of the elastic member.

As shown in FIG. 39, similar results can be obtained when the material of the elastic member is altered from a metal to a resin having elasticity, for example Mylar 136 (PET: polyethylene terephthalate). Note, however, that in order to obtain an equal pressure to that which is applied to the paper P when the plate springs 132 are used, the form of a leading edge 136*a* site which contacts the paper P must be modified such that a width dimension W2 of the leading edge 136*a* site is greater than the width dimension W1 of the leading edge 132*a* site of the plate springs 132, or in other words such that W2>W1.

The Mylar 136 is a resin, and hence has poorer wear resistance than metal. On the other hand, the Mylar 136 is less likely to suffer from plastic deformation than metal, and hence is easier to handle. If the Mylar 136 is used as a replaceable component and replaced periodically by a service person, then its poor wear resistance can be compensated.

As described above, according to the first and second specific examples etc., the effects described in the above paragraphs can be obtained in addition to the advantages and effects of the unpublished embodiment described above.

In each of these embodiments and so on, the unique paper conveyance control described above can be performed using eleven types of paper, including the smallest passable size "B6Y" in addition to the ten paper lengths shown in FIGS. 11 and 15 which are used normally in the stencil printing apparatus 100 and bulk feed/conveyance units 1, 1A, 1B. Further, to avoid complicated control and suppress costs, a minimum of three conveyance rollers, i.e. the first through third conveyance rollers 32-1 to 32-3, are used as paper conveyance devices. However, the present invention is not limited to this constitution, and a total of four conveyance rollers, for example, including the three conveyance rollers of the above unpublished embodiment, may be used so that the minimum passable paper size can be extended to "postcard size" (in this case, the distance between conveyance rollers is set at approximately 130 to 140 mm). Note that when only two conveyance rollers are used, A4 portrait (A4T: the narrow sides of A4 size when seen from the direction of the user) is not passable. Since this leads to a reduction in practicality, three conveyance rollers are preferably provided in this unpublished embodiment.

Needless to say, the image forming apparatus connected to the bulk feed/conveyance unit 1, 1A, 1B and bulk discharge unit 200 is not limited to the stencil printing apparatus 100, which performs printing by having an ink supplying member disposed in the interior of the printing drum 115 comprising a print cylinder on its outer periphery, as described above, contact the inner peripheral surface of the print cylinder such that ink is supplied from the inside of the print cylinder to an engraved thermal stencil master wrapped around the print cylinder. For example, the bulk feeding apparatus and bulk discharge apparatus may be connected to the main body of an image forming apparatus such as a copier, a printing machine, a facsimile, a printer including an ink jet printer, or a plotter, and used in a similar fashion.

There are no limitations on the simple control constitution and operations of the embodiments and so on described above, and if a complicated control constitution and operations is acceptable, then the disclosed content of the present invention may be modified in the following manner. For example, when the leading edge of a sheet of comparatively short paper P passing over the first through eighth sensors 50-1 to 50-8 (paper detecting devices) is detected by the seventh sensor 50-7 (or sixth sensor 50-6), the control apparatus 85 (CPU 86) may control the second motor 33-2 and third motor 33-3 (driving devices) to reduce the paper conveyance speed of the second conveyance roller 32-2 of the second paper conveyance device 30-2 and the third conveyance roller 32-3 of the third paper conveyance device 30-3 on the basis of an OFF signal generated when the seventh sensor 50-7 (or sixth sensor 50-6) detects the leading edge of the paper P such that the output signal thereof switches from ON to OFF. Alternatively, the control apparatus 85 (CPU 86) may vary the paper conveyance speed in stages in descending order of paper length. The braking force which is applied to the paper may also be varied in stages according to the paper size. Such examples do not exceed the technological scope of the present invention.

According to the present invention described above, a novel paper conveyance apparatus which solves the aforementioned problems occurring in conventional apparatuses can be provided. More specifically, according to the present invention, a control device is provided to reduce the paper conveyance speed of a plurality of paper conveyance devices when the leading edge of a sheet of paper is detected by one of a plurality of paper detecting devices, which is disposed at least one device further upstream than the furthest-downstream paper detecting device disposed furthest downstream and nearest to the main body feeding device. As a result, the inertia of the conveyed paper can be reduced during conveyance, regardless of the paper size, enabling the realization of a stable paper feeding quality with little variation in the stopping position of the paper. Moreover, damage to the edges of the paper caused by collision with the main body feed roller, for example, when the paper advances too far, and jams occurring when the paper is deformed, can be prevented.

Also according to the present invention, in addition to the control performed by the control device to reduce the paper conveyance speed, a braking force applying device for applying a braking force to the conveyed paper is provided on the intermediate conveyance path between the furthest-downstream paper detecting device and the paper detecting device that is disposed one device further upstream than the furthest-downstream paper detecting device such that as well as reducing the inertia of the conveyed paper during conveyance by having the control device reduce the paper conveyance speed, a braking force is applied to the conveyed paper by the braking force applying device. As a result, an even more stable paper feeding quality with even less variation in the stopping position of the paper is obtained, and damage to the edges of the paper caused by collision with the main body feed roller, for example, when the paper advances too far, and jams occurring when the paper is deformed can be prevented even more reliably.

Also according to the present invention, a simple elastic member is used as the braking force applying device and provided in a paper guiding member disposed in the intermediate conveyance path. Thus, in addition to the above effects, by disposing the elastic member in the vicinity of the furthest-downstream paper conveyance device, short-sized paper in particular is held (sandwiched) feedably not only by the furthest-downstream paper conveyance device and the main body feeding device, but also by the elastic member, and hence deviations to and from the stopping position of the paper caused by slight oscillation or external force can be prevented.

Also according to the present invention, the elastic members are disposed in positions of substantially linear symmetry to the center line of the conveyed paper in the paper width direction, and hence when short-sized paper in particular is conveyed such that the trailing edge of the paper is not held by the paper conveyance devices or the length of the paper that is held by the paper conveyance devices is short, a braking force can be applied to the positions of substantially linear symmetry to the center line of the conveyed paper in the paper width direction by the elastic members on both sides. As a result, skew can be prevented in small sized paper, and therefore a stable paper feeding quality with little variation in the stopping position of the paper can be obtained.

Also according to the present invention, in the vicinity of the contact site with the paper, the elastic member takes a substantially linear form to the paper conveyance direction and an upward crescent form, and hence, in addition to the above effects, a braking force can be applied to the narrow contact site at the free end of the substantially linear form and upward crescent form of the elastic member in the vicinity of the contact site with the paper at all times and with an additional degree of stability.

Also according to the present invention, the elastic member is formed from metal, and hence wear caused by contact with the paper can be suppressed, enabling an improvement in the durability of the elastic member.

Various modifications will become possible for those skilled in the art after receiving the teachings of the present disclosure, without departing from the scope thereof.

What is claimed is:

1. A paper conveyance apparatus comprising:

a stacking portion on which paper can be stacked;

a feeding mechanism portion configured to extract the paper stacked on said stacking portion one sheet at a time and to feed said paper; and an intermediate conveyance portion configured to convey said paper fed from said feeding mechanism portion to a vicinity of a feeding port faced by a main body feeding portion, on an image forming apparatus main body side, wherein said intermediate conveyance portion comprises a plurality of paper conveyance devices disposed at intervals from an upstream side to a downstream side of an intermediate conveyance path, and configured to convey said paper fed from said feeding mechanism portion, and a plurality of paper detecting devices, each paper detecting device being disposed at intervals from the upstream side to the downstream side of said intermediate conveyance path, and each paper detecting device being configured to detect at least a leading edge of said conveyed paper from among said leading edge and a trailing edge of said paper, said plurality of paper detecting devices includes a first paper detecting device located at said upstream side of said intermediate conveyance path, a second paper detecting device located 96 mm on said downstream side of said of said intermediate conveyance path from said first paper detecting device, a third paper detecting device located 52 mm on said downstream side of said of said intermediate conveyance path from said second paper detecting device, a fourth paper detecting device located 52.5 mm on said downstream side of said of said intermediate conveyance path from said third paper detecting device, a fifth paper detecting device located 48 mm on said downstream side of said of said intermediate conveyance path from said fourth paper detecting device, a sixth paper detecting device located 39.5 mm on said downstream side of said of said intermediate conveyance path from said fifth paper detecting device, a seventh paper detecting device located 32.5 mm on said downstream side of said of said intermediate conveyance path from said sixth paper detecting device and an eighth paper detecting device located 48.5 mm on said downstream side of said of said intermediate conveyance path from said seventh paper detecting device, and said paper conveyance apparatus further comprises a control device configured to reduce a paper conveyance speed of said plurality of paper conveyance devices when the leading edge of said paper is detected by one of said paper detecting devices disposed at least one device further toward said upstream side than said eighth paper detecting device, which is disposed furthest downstream of said plurality of paper detecting devices and nearest to said main body feeding portion.

2. The paper conveyance apparatus as claimed in claim 1, further comprising a braking force applying device, disposed on said intermediate conveyance path between said eighth paper detecting device and said paper detecting device disposed one device further toward said upstream side than said eighth paper detecting device, configured to apply a braking force to said paper being conveyed.

3. The paper conveyance apparatus as claimed in claim 2, wherein said braking force applying device is constituted by an elastic member, and said elastic member is provided in a paper guiding member disposed in said intermediate conveyance path.

4. The paper conveyance apparatus as claimed in claim 3, wherein said control device is further configured to determine the size of said paper on the basis of a signal from said plurality of paper detecting devices during initialization, when conveyance of one sheet of said paper over said plurality of paper detecting devices is complete, and to perform control to vary a paper conveyance control system of each of said paper conveyance devices, in said initialization state, said paper is positioned on said eighth paper conveyance device, which is nearest to a main body feeding device of said plurality of paper conveyance devices, and the leading edge of said paper is set in a position enabling said paper to be fed by said main body feeding portion, or said main body feeding device, and said elastic member is disposed in the vicinity of said eighth paper conveyance device.

5. The paper conveyance apparatus as claimed in claim 3, wherein said elastic member is disposed in a position of substantially linear symmetry to a center line of said paper being conveyed in a paper width direction.

6. The paper conveyance apparatus as claimed in claim 3, wherein said elastic member is formed from a metal.

7. A paper conveyance apparatus comprising:

a stacking portion on which paper can be stacked;

a feeding mechanism portion configured to extract the paper stacked on said stacking portion one sheet at a time and to feed said paper;

an intermediate conveyance portion configured to convey said paper fed from said feeding mechanism portion to a vicinity of a feeding port faced by a main body feeding table of a feeding portion, or a main body feeding device of said feeding portion, on an image forming apparatus main body side, the intermediate conveyance portion comprising a plurality of paper conveyance devices disposed at intervals from an upstream side to a downstream side of an intermediate conveyance path;

a plurality of paper detecting devices disposed at intervals from the upstream side to the downstream side of the intermediate conveyance path, each paper detecting device being configured to detect at least a leading edge of said paper being conveyed from among said leading edge and a trailing edge of said paper being conveyed, wherein said plurality of paper detecting devices includes a first paper detecting device located at said upstream side of said intermediate conveyance path, a second paper detecting device located 96 mm on said downstream side of said of said intermediate conveyance path from said first paper detecting device, a third paper detecting device located 52 mm on said downstream side of said of said intermediate conveyance path from said second paper detecting device, a fourth paper detecting device located 52.5 mm on said downstream side of said of said intermediate conveyance path from said third paper detecting device, a fifth paper detecting device located 48 mm on said downstream side of said of said intermediate conveyance path from said fourth paper detecting device, a sixth paper detecting device located 39.5 mm on said downstream side of said of said intermediate conveyance path from said fifth paper detecting device, a seventh paper detecting device located 32.5 mm on said downstream side of said of said intermediate conveyance path from said sixth paper detecting device and an eighth paper detecting device located 48.5 mm on said downstream side of said of said intermediate conveyance path from said seventh paper detecting device; a braking force applying device, disposed on said intermediate conveyance path between said eighth paper detecting device and a paper detecting device disposed one device further toward said upstream side than said eighth paper detecting device, and configured to apply a braking force to said paper being conveyed; and a control device configured to reduce a paper conveyance speed of said plurality of paper conveyance devices when the leading edge of said paper is detected by said paper detecting device disposed at least one device further toward said upstream side than said eighth paper detecting device, which is disposed furthest downstream of said plurality of paper detecting devices and nearest to said main body feeding device, wherein said braking force applying device is constituted by an elastic member, and said elastic member is provided in a paper guiding member disposed in said intermediate conveyance path, and wherein said elastic member takes a substantially linear form to a paper conveyance direction and an upward crescent form in the vicinity of a site of contact with said paper.

* * * * *

UNITED STATES PATENT AND TRADEMARK OFFICE

CERTIFICATE OF CORRECTION

PATENT NO. : 7,651,090 B2
APPLICATION NO. : 11/043261
DATED : January 26, 2010
INVENTOR(S) : Keiichi Satoh et al.

It is certified that error appears in the above-identified patent and that said Letters Patent is hereby corrected as shown below:

Column 20, line 37, Change "Figs. 7 and 9A and 9B" to --Fig. 7 and Figs. 9A and 9B--

Column 31, line 22, Change "Figs. 11 and 15 through 18A and 18B." to --Fig. 11 and Figs. 15 through 18A and 18B.--

Column 34, line 16, Change "soon" to --so on--

Column 35, line 27, Change "step S1" to --step S11--

Column 51, line 15, After "and" insert --Figs.--

Signed and Sealed this

Fifteenth Day of June, 2010

David J. Kappos

David J. Kappos
*Director of the United States Patent and Trademark Office*